US012588792B2

(12) United States Patent
Lee et al.

(10) Patent No.: US 12,588,792 B2
(45) Date of Patent: Mar. 31, 2026

(54) CORDLESS VACUUM CLEANER IN WHICH CLEANER BODY AND BRUSH DEVICE ARE ABLE TO COMMUNICATE

(71) Applicant: Samsung Electronics Co., Ltd., Suwon-si (KR)

(72) Inventors: Seongu Lee, Suwon-si (KR); Daehyung Kim, Suwon-si (KR); Sanghyuk Park, Suwon-si (KR); Seho Park, Suwon-si (KR); Ahyoung Lee, Suwon-si (KR); Yeongju Lee, Suwon-si (KR); Jaeshik Jeong, Suwon-si (KR); Yoonkyung Cho, Suwon-si (KR)

(73) Assignee: SAMSUNG ELECTRONICS CO., LTD., Gyeonggi-Do (KR)

( * ) Notice: Subject to any disclaimer, the term of this patent is extended or adjusted under 35 U.S.C. 154(b) by 250 days.

(21) Appl. No.: 18/135,731

(22) Filed: Apr. 17, 2023

(65) Prior Publication Data

US 2023/0329503 A1 Oct. 19, 2023

Related U.S. Application Data

(63) Continuation of application No. PCT/KR2023/004588, filed on Apr. 5, 2023.

(30) Foreign Application Priority Data

Apr. 15, 2022 (KR) ..... 10-2022-0047181
Oct. 24, 2022 (KR) ..... 10-2022-0137763

(51) Int. Cl.
*A47L 9/28* (2006.01)
*A47L 9/04* (2006.01)
*A47L 9/30* (2006.01)

(52) U.S. Cl.
CPC ..... *A47L 9/2884* (2013.01); *A47L 9/0466* (2013.01); *A47L 9/2826* (2013.01); *A47L 9/2831* (2013.01);
(Continued)

(58) Field of Classification Search
CPC ..... A47L 8/2894
See application file for complete search history.

(56) References Cited

U.S. PATENT DOCUMENTS 9,757,001 B2 9/2017 Hwang et al.
2014/0196245 A1* 7/2014 Liter ..... A47L 9/2868 15/339
(Continued)

FOREIGN PATENT DOCUMENTS

CN 112120595 A 12/2020
JP 6058627 B2 1/2017
(Continued)

OTHER PUBLICATIONS

WO2022035041 Translation (Year: 2020).*
(Continued)

*Primary Examiner* — Eric J Rosen
(74) *Attorney, Agent, or Firm* — CANTOR COLBURN LLP

(57) ABSTRACT

Provided is a cordless vacuum cleaner including a cleaner body including a first processor configured to control an operation of a first switching device connected to a signal line to transmit a first signal to a brush device through the signal line and receive a second signal from the brush device through the signal line, and the brush device including a second processor configured to control an operation of a second switching device connected to the signal line to
(Continued)

transmit the second signal to the cleaner body through the signal line and receive the first signal from the cleaner body through the signal line.

20 Claims, 34 Drawing Sheets

(52) U.S. Cl.
CPC ..... *A47L 9/2842* (2013.01); *A47L 9/2889* (2013.01); *A47L 9/2894* (2013.01); *A47L 9/30* (2013.01)

(56) References Cited

U.S. PATENT DOCUMENTS

| | | | |
|---|---|---|---|
| 2015/0342434 | A1 | 12/2015 | Martins, Jr. et al. |
| 2020/0187741 | A1 | 6/2020 | Villaroman |
| 2022/0273150 | A1 | 9/2022 | Kwon et al. |
| 2022/0361726 | A1 | 11/2022 | Kwon et al. |
| 2023/0040611 | A1 | 2/2023 | Moon |
| 2023/0104985 | A1 | 4/2023 | Kwon et al. |

FOREIGN PATENT DOCUMENTS

| | | | |
|---|---|---|---|
| JP | 2020127693 | A | 8/2020 |
| JP | 2021183054 | A | 12/2021 |
| KR | 19990084511 | A | 12/1999 |
| KR | 20040047370 | A | 6/2004 |
| KR | 100773980 | B1 | 11/2007 |
| KR | 100798325 | B1 | 1/2008 |
| KR | 101653449 | B1 | 9/2016 |
| KR | 20210090514 | A | 7/2021 |
| KR | 102291067 | B1 | 8/2021 |
| KR | 20210102133 | A | 8/2021 |
| KR | 102306753 | B1 | 9/2021 |
| KR | 20210138342 | A | 11/2021 |
| KR | 20220019990 | A | 2/2022 |
| WO | 2022008872 | A1 | 1/2022 |
| WO | 2022008873 | A2 | 1/2022 |
| WO | WO-2022035041 | A1 * | 2/2022 |

OTHER PUBLICATIONS

International Search Report with Written Opinion issued in International Application No. PCT/KR2023/004588; Application Filing Date Apr. 5, 2023; Date of Mailing Jul. 14, 2023 (13 pages).
Extended European Search Report Issued In EP Application No. 23788526.4-1015; Mail Date Apr. 23, 2025; 11 Pages.
European Office Action Issued In EP Patent Application No. 23788526.4-1015; Mail Date Dec. 1, 2025; 9 Pages.

* cited by examiner

FIG. 6

600

| | Brush Type | ID RESISTANCE (Ω) | Battery 25V Max (6S1P) | | | Battery 29.2V Max (7S1P) | | | NOTE |
|---|---|---|---|---|---|---|---|---|---|
| | | | 15.6 | 21.6 | 25.0 | 18.2 | 25.2 | 29.2 | |
| | Wet Brush | Short | 3.105 | 4.299 | 4.976 | 3.622 | 5.016 | 5.812 | |
| 401 | (AI) MULTI Brush | 330K | 1.724 | 2.387 | 2.763 | 2.011 | 2.785 | 3.227 | |
| 404 | TURBO 2.0 Brush | 910K | 0.968 | 1.340 | 1.551 | 1.129 | 1.563 | 1.811 | |
| 402 | (AI) HARD FLOOR Brush | 2.2M | 0.490 | 0.678 | 0.785 | 0.571 | 0.791 | 0.917 | |
| | SPARE | 6.8M | 0.177 | 0.284 | 0.284 | 0.207 | 0.287 | 0.332 | |
| | Soft Brush | Open | 0 | 0 | 0 | 0 | 0 | 0 | |

900

| No | CLASSIFICATION | NORMAL | NORMAL+ NOISE(±1.5V) | REMARK |
|---|---|---|---|---|
| 1 | SIGNAL LINE VOLTAGE | 13.4487V | 13.4487V ±1.5V | |
| 2 | AD VOLTAGE OF FIRST PROCESSOR | 2.78V | +1.5V : 3.08V<br>−1.5V : 2.49V<br>(2.49V ~ 3.08V) | |
| 3 | GENERAL AD PORT (3.3V) | 3.3V (High) | +1.5V : 4.8V<br>1.5V :1.8V<br>(1.8V ~ 4.8V) | MICON AD MAXIMUM VOLTAGE EXCESS |

FIG. 10

2110

1001 1002 1003

| No | OPERATING CONDITIONS | USAGE ENVIRONMENT STATES | OPERATION INFORMATION OF CORDLESS VACUUM CLEANER | | | NOTE | Start | Command (#8) | | | Parity | | | Stop |
|---|---|---|---|---|---|---|---|---|---|---|---|---|---|---|
| | | | POWER CONSUMPTION | RPM | Trip | | A | B | C | D | E | F | G | H |
| 1 | CONDITIONS #1 | HARD FLOOR | 70 | 2,000 | 4.0A | | 0 | 0 | 0 | 1 | 1 | 1 | 0 | 1 |
| 2 | CONDITIONS #2 | CARPET (NORMAL LOAD) | 115 | 3,800 | 4.9A | | 0 | 0 | 1 | 0 | 1 | 0 | 1 | 1 |
| 3 | CONDITIONS #3 | CARPET (OVERLOAD) | 40 | 2,000 | 4.9A | | 0 | 0 | 1 | 1 | 1 | 0 | 0 | 1 |
| 4 | CONDITIONS #4 | LIFT | 40 | 1,000 | 4.0A | | 0 | 1 | 0 | 0 | 0 | 1 | 1 | 1 |
| 5 | CONDITIONS #5 | MAT | 58 | 1,000 | 4.9A | | 0 | 1 | 0 | 1 | 0 | 1 | 0 | 1 |
| 6 | CONDITIONS #6 | STOP | 58 | 0 | 0 | | 0 | 1 | 1 | 0 | 0 | 0 | 1 | 1 |
| 7 | SPARE | | | | | | 0 | 1 | 1 | 1 | 0 | 0 | 0 | 1 |
| 8 | SPARE | | | | | | 0 | 0 | 0 | 0 | 1 | 1 | 1 | 1 |

FIG. 18

| No | OPERATING CONDITION | USAGE ENVIRONMENT STATE | NORMAL MODE (1801) | | AI MODE (1802) | | | REMARK |
|---|---|---|---|---|---|---|---|---|
| | | | POWER CONSUMPTION | RPM | POWER CONSUMPTION | RPM | Trip | |
| 1 | CONDITION #1 | HARD FLOOR | 115 | 3,800 | 75 | 2,000 | 4.0A | |
| 2 | CONDITION #2 | CARPET (NORMAL) | 115 | 3,800 | 115 | 3,800 | 5.0A | |
| 3 | CONDITION #3 | CARPET (OVERLOAD) | 115 | 3,800 | 58 | 2,000 | 7.0A | |
| 4 | CONDITION #4 | MAT | 115 | 3,800 | 58 | 1,000 | 4.0A | |
| 5 | CONDITION #5 | LIFTED (MOVED) | 115 | 3,800 | 58 | 1,000 | 3.0A | |
| 6 | CONDITION #6 | STOP | 115 | 0 | 58 | 0 | 0 | |
| 7 | SPARE | | | | | | | |
| 8 | SPARE | | | | | | | |

FIG. 22

2210

| No (2201) | OPERATING CONDITIONS (2201) | USAGE ENVIRONMENT STATES (2201) | OPERATION INFORMATION OF CORDLESS VACUUM CLEANER (2202) | | | NOTE (2202) | Start (2203) | | Command (2203) | | |
|---|---|---|---|---|---|---|---|---|---|---|---|
| | | | POWER CONSUMPTION | RPM | Trip | | A | B | C | D | E |
| 1 | CONDITIONS #1 | HARD FLOOR | 75 | 2,000 | 4.0A | | 0 | 0 | 0 | 1 | 1 |
| 2 | CONDITIONS #2 | CARPET (NORMAL LOAD) | 115 | 3,800 | 5.0A | | 0 | 0 | 1 | 0 | 1 |
| 3 | CONDITIONS #3 | CARPET (OVERLOAD) | 58 | 2,000 | 7.0A | | 0 | 0 | 1 | 1 | 1 |
| 4 | CONDITIONS #4 | LIFT | 58 | 1,000 | 4.0A | | 0 | 1 | 0 | 0 | 0 |
| 5 | CONDITIONS #5 | MAT | 58 | 1,000 | 3.0A | | 0 | 1 | 0 | 1 | 0 |
| 6 | CONDITIONS #6 | STOP | 58 | 0 | 0 | | 0 | 1 | 1 | 0 | 0 |
| 7 | SPARE | | | | | | 0 | 1 | 1 | 1 | 0 |
| 8 | SPARE | | | | | | 0 | 0 | 0 | 0 | 1 |

BASED ON SIGNAL LINE, 0/1 ARE
0 : High → Low
1 : Low → High
RC WHEN PROTOCOL IS APPLIED

11001 → LH LH HL HL LH

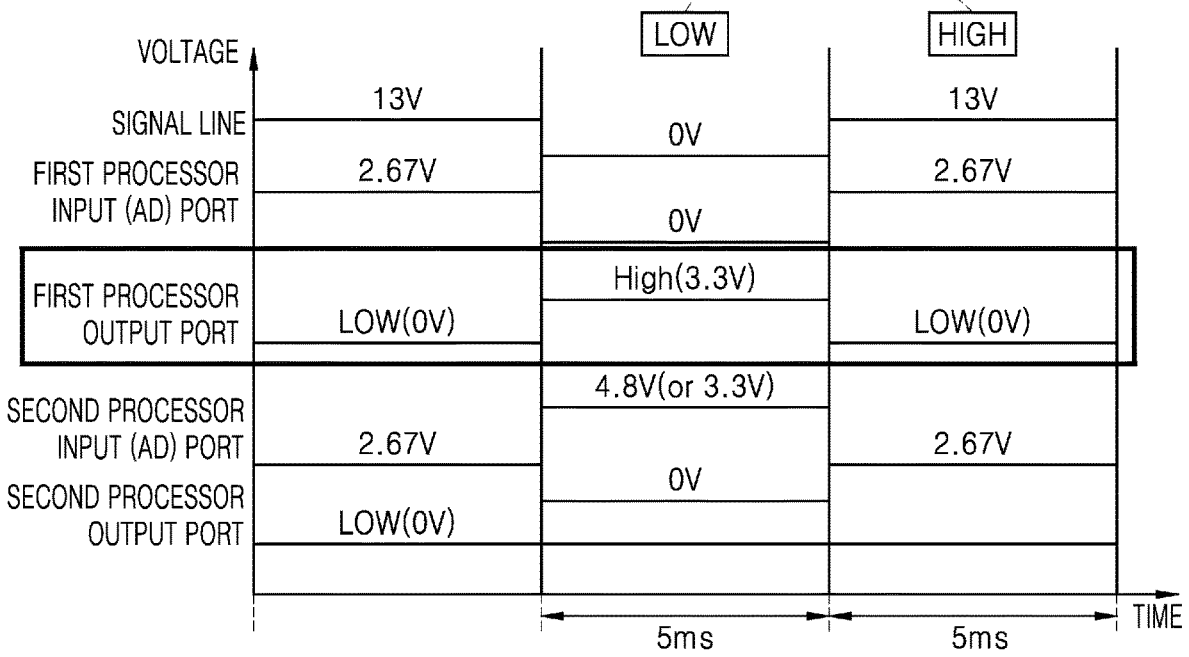

FIG. 24

| TYPE OF BRUSH DEVICE | Start | REMARK |
|---|---|---|
| A Brush | 11 | LH LH |
| B Brush | 10 | LH HL |
| C Brush | 01 | HL LH |
| D Brush | 00 | HL HL |

FIG. 26
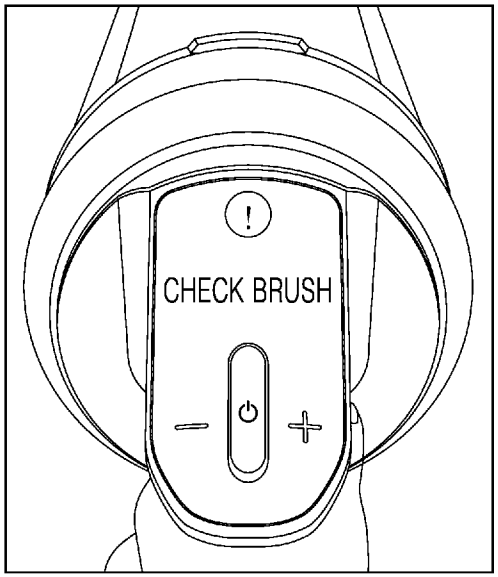
2603
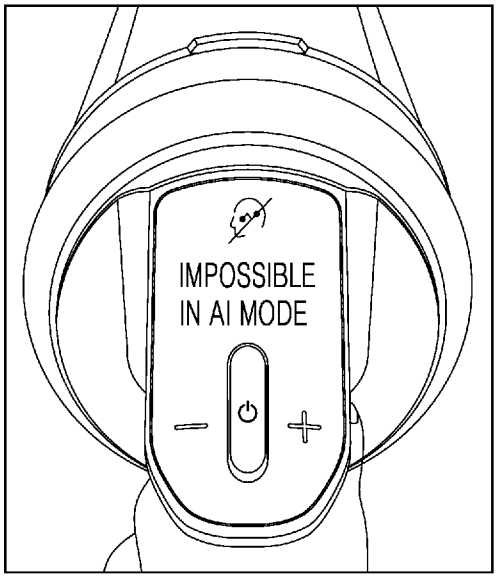
2602
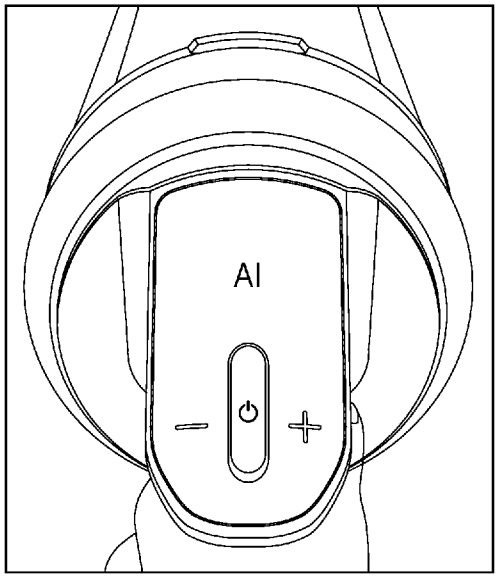
2601

CORDLESS VACUUM CLEANER IN WHICH CLEANER BODY AND BRUSH DEVICE ARE ABLE TO COMMUNICATE

CROSS-REFERENCE TO RELATED APPLICATIONS

This application is a continuation application, claiming priority under § 365(c), of International Application No. PCT/KR2023/004588, filed on Apr. 5, 2023, which is based on and claims the benefit of Korean patent application number 10-2022-0137763 filed on Oct. 24, 2022, in the Korean Intellectual Property Office and of Korean patent application number 10-2022-0047181 filed on Apr. 15, 2022, in the Korean Intellectual Property Office, the disclosures of which are incorporated by reference herein in their entireties.

TECHNICAL FIELD

An embodiment of the disclosure relates to a cordless vacuum cleaner in which a cleaner body and a brush device are able to communicate with each other.

BACKGROUND ART

A cordless vacuum cleaner is a type of cleaning device that is used by charging a battery included in the vacuum cleaner itself without having to connect a line to an outlet. The cordless vacuum cleaner includes a suction motor that generates suction power, and thus may suck up foreign materials, such as dust, together with the air, from a cleaner head (brush) through the suction power generated in the suction motor, and collect the sucked up foreign material by separating the sucked up foreign material from the air.

Recently, types of cleaner heads (brushes) connected to a body of the cordless vacuum cleaner have been modified and diversified. The brushes of the cordless vacuum cleaner may now be divided into a main brush that is generally used when cleaning a floor, and a supplementary brush that is used for a special purpose. Types of supplementary brushes that are used for special purposes are being further subdivided for use in various cleaning environments.

In this regard, various types of cleaner heads (brushes) are being developed, but there is remains difficulty in implementing communications between the body of the cordless vacuum cleaner and the cleaner head (brush) connected to the body. In particular, it can be difficult to implement stable communications between the body and the brush because devices (for example, the brush, a tool, and a pipe) are often detached, a physical impact often occurs (for example, hitting a wall), there is an electric shock (battery detachment), and micro-vibration also occurs, due to environmental characteristics of using the cordless vacuum cleaner.

DESCRIPTION OF EMBODIMENTS

Solution to Problem

A cordless vacuum cleaner according to an embodiment of the disclosure includes power lines configured to transmit power supplied from a battery to a cleaner body and a brush device connected to the cleaner body, a signal line that is different from the power lines and configured to transmit and receive a signal between the cleaner body and the brush device when the brush device is connected to the cleaner body, the cleaner body including a first processor configured to control an operation of a first switching device connected to the signal line to transmit a first signal to the brush device through the signal line and receive a second signal from the brush device through the signal line, and the brush device including a second processor configured to control an operation of a second switching device connected to the signal line to transmit the second signal to the cleaner body through the signal line and receive the first signal from the cleaner body through the signal line.

BRIEF DESCRIPTION OF DRAWINGS

FIG. 6 is a table for describing an identification (ID) resistor of a brush device, according to an embodiment of the disclosure.

FIG. 10 is a table for describing a data format included in a signal transmitted between a cleaner body and a brush device, according to an embodiment of the disclosure.

FIG. 18 is a table for describing operation information of a cordless vacuum cleaner according to a usage environment state of a brush device, according to an embodiment of the disclosure.

FIG. 22 is a table for describing an operation by which a cleaner body transmits a signal to a brush device, according to an embodiment of the disclosure.

FIG. 24 is a table for describing an operation by which a cleaner body identifies a type of a brush device, based on a signal received from the brush device, according to an embodiment of the disclosure.

FIG. 26 is a collection of images for describing a graphics user interface (GUI) of a cordless vacuum cleaner, according to an embodiment of the disclosure.

MODE OF DISCLOSURE

Figure 1:
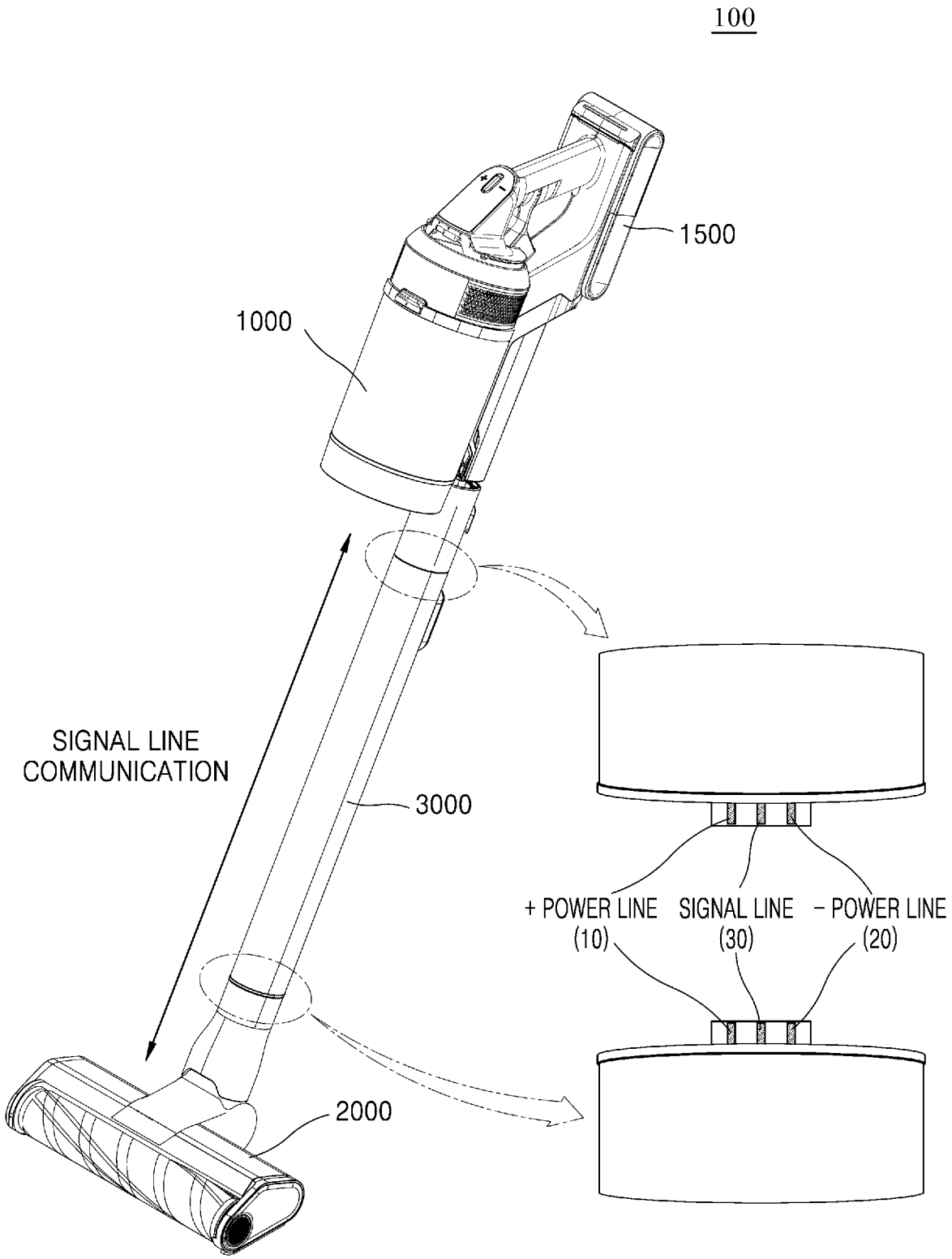
FIG. 1 is a perspective diagram for describing a cordless vacuum cleaner according to an embodiment of the disclosure.

The terms used in the disclosure will be briefly defined, and an embodiment of the disclosure will be described in detail.

The terms used herein are general terms currently widely used in the art, in consideration of functions in regard to an embodiment of the disclosure. However, the terms may have different meanings according to the intention of one of ordinary skill in the art, precedent cases, or the appearance of new technologies. Also, some terms may be arbitrarily selected by the applicant, and in this case, the meaning of the selected terms will be described in detail in the detailed description of embodiments of the disclosure. Thus, the terms used herein have to be defined based on the meaning of the terms together with the description throughout the specification.

Throughout the disclosure, the expression "at least one of a, b or c" indicates only a, only b, only c, both a and b, both a and c, both b and c, all of a, b, and c, or variations thereof.

When a part "includes" or "comprises" an element, unless there is a particular description contrary thereto, the part may further include other elements, not excluding the other elements. In addition, terms such as "unit", "-er/or", and "module" described in the present specification denote a unit that processes at least one function or operation, which may be implemented in hardware or software, or implemented in a combination of hardware and software.

Hereinafter, an embodiment of the disclosure will be described in detail with reference to the accompanying drawings such that one of ordinary skill in the art may easily implement the embodiment of the disclosure. However, the disclosure may be implemented in various different forms and is not limited to the embodiment of the disclosure described herein. Also, in the drawings, parts irrelevant to the description are omitted in order to clearly describe embodiments of the disclosure, and like reference numerals designate like elements throughout the specification.

FIG. 1 is a diagram for describing a cordless vacuum cleaner according to an embodiment of the disclosure.

Referring to FIG. 1, a cordless vacuum cleaner 100 according an embodiment of the disclosure may be a stick type vacuum cleaner including a cleaner body 1000, a brush device 2000, and an extension pipe 3000. However, not all of the components shown in FIG. 1 are essential components. The cordless vacuum cleaner 100 may be implemented by more components than those illustrated in FIG. 1 or by fewer components than those illustrated in FIG. 1. For example, the cordless vacuum cleaner 100 may include the cleaner body 1000 and the brush device 2000 without the extension pipe 3000. Also, the cordless vacuum cleaner 100 may further include a cleaning station (not shown) for discharging dust in the cleaner body 1000 and charging a battery. Each component will now be described below.

The cleaner body 1000 may include a suction motor configured to form a vacuum inside the cordless vacuum cleaner 100, and a dust collecting container (dust container) in which foreign materials sucked up from a surface to be cleaned are accommodated (for example, a floor, bedding, or a sofa). The cleaner body 1000 can be moved by being held by a user during cleaning. The cleaner body 1000 may further include a battery for supplying power to the suction motor, a user interface, and at least one processor, but is not limited thereto. A specific configuration of the cleaner body 1000 will be described in detail below with reference to FIG. 2.

The brush device 2000 is a device configured to suck up the air and foreign materials of the surface to be cleaned by being pressed against the surface to be cleaned. The brush device 2000 may also be referred to as a cleaner head. The brush device 2000 may be rotatably combined to the extension pipe 3000. The brush device 2000 may include a motor and a drum to which a rotating brush is attached, but is not limited thereto. According to an embodiment of the disclosure, the brush device 2000 may further include at least one processor configured to control communication with the cleaner body 1000. A type of the brush device 2000 may vary, and types of the brush device 2000 will be described in detail below with reference to FIG. 4.

The extension pipe 3000 may be formed as a pipe having certain rigidity or a flexible hose. The extension pipe 3000 may be configured to transmit suction power generated through the suction motor of the cleaner body 1000 to the brush device 2000, and transfer the air and foreign material sucked up through the brush device 2000 to the cleaner body 1000. The extension pipe 3000 may be detachably connected to the brush device 2000. The extension pipe 3000 may be formed in multiple stages between the cleaner body 1000 and the brush device 2000. There may be two or more extension pipes 3000.

According to an embodiment of the disclosure, each of the cleaner body 1000, the brush device 2000, and the extension pipe 3000 included in the cordless vacuum cleaner 100 may include power lines (for example, a+power line 10 and a−power line 20) and a signal line 30.

The power lines 10 and 20 may be lines for transmitting power supplied from a battery 1500 to the cleaner body 1000 and the brush device 2000 connected to the cleaner body 1000. The signal line 30 is different from the power lines 10 and 20 and may be a line for transmitting and receiving a signal between the cleaner body 1000 and the brush device 2000. The signal line 30 may be implemented for connection to the power lines 10 and 20 inside the brush device 2000.

According to an embodiment of the disclosure, each of a processor of the cleaner body 1000 and a processor of the brush device 2000 may be configured to control operations of a switching device connected to the signal line 30 for bi-directional communication between the cleaner body 1000 and the brush device 2000. Hereinafter, communication between the cleaner body 1000 and the brush device 2000 will be defined as signal line communication because the cleaner body 1000 and the brush device 2000 communicate with each other through the signal line 30. The signal line communication will be described in detail below with reference to FIGS. 7A through 14.

In the cordless vacuum cleaner 100, it can be difficult to stably establish a wireless or wired communication channel between the cleaner body 1000 and the brush device 2000, because of detachment of an assistive tool (for example, the brush device 2000, a tool, or the extension pipe 3000), a physical impact (for example, hitting a wall), an electric shock (for example, detachment of the battery 1500), and micro-vibration due to usage environmental characteristics during cleaning. Also, when the cordless vacuum cleaner 100 uses a power line communication method (i.e., a method of communicating by varying a pulse width modulation (PWM) frequency of the + and −power lines 10 and 20), power supply from the cleaner body 1000 to the brush device 2000 may be restricted. For example, when power of 10 W is supplied at 60% PWM frequency, only 6 W is supplied to the brush device 2000. Also, in the power line communication method characterized in that a PWM frequency is varied, it can be difficult to transmit various signals due to noise and vibration (resonance), and it can also be difficult to transmit various types of data.

However, according to an embodiment of the disclosure, the cleaner body 1000 and the brush device 2000 of the cordless vacuum cleaner 100 communicate by using the signal line 30, and thus stable bi-directional communication is possible and various types of data are transmittable, despite of internal/external influences (a physical impact, power noise, and electro-static discharge (ESD)). Also, according to an embodiment of the disclosure, the cleaner body 1000 may identify a type of the brush device 2000, in addition to detecting detachment of the brush device 2000, and adaptively control an operation of the brush device 2000 (for example, RPM of the rotating brush (drum)) according to a usage environment state of the brush device 2000 (for example, a hard floor, a carpet, a mat, a corner, or a state of being lifted from a surface to be cleaned). A method by which the cleaner body 1000 adaptively controls the operation of the brush device 2000 (for example, RPM of the rotating brush (drum)) will be described in detail below with reference to FIG. 15, and hereinafter, the cleaner body 1000 will be described in more detail with reference to FIG. 2.

Figure 2:
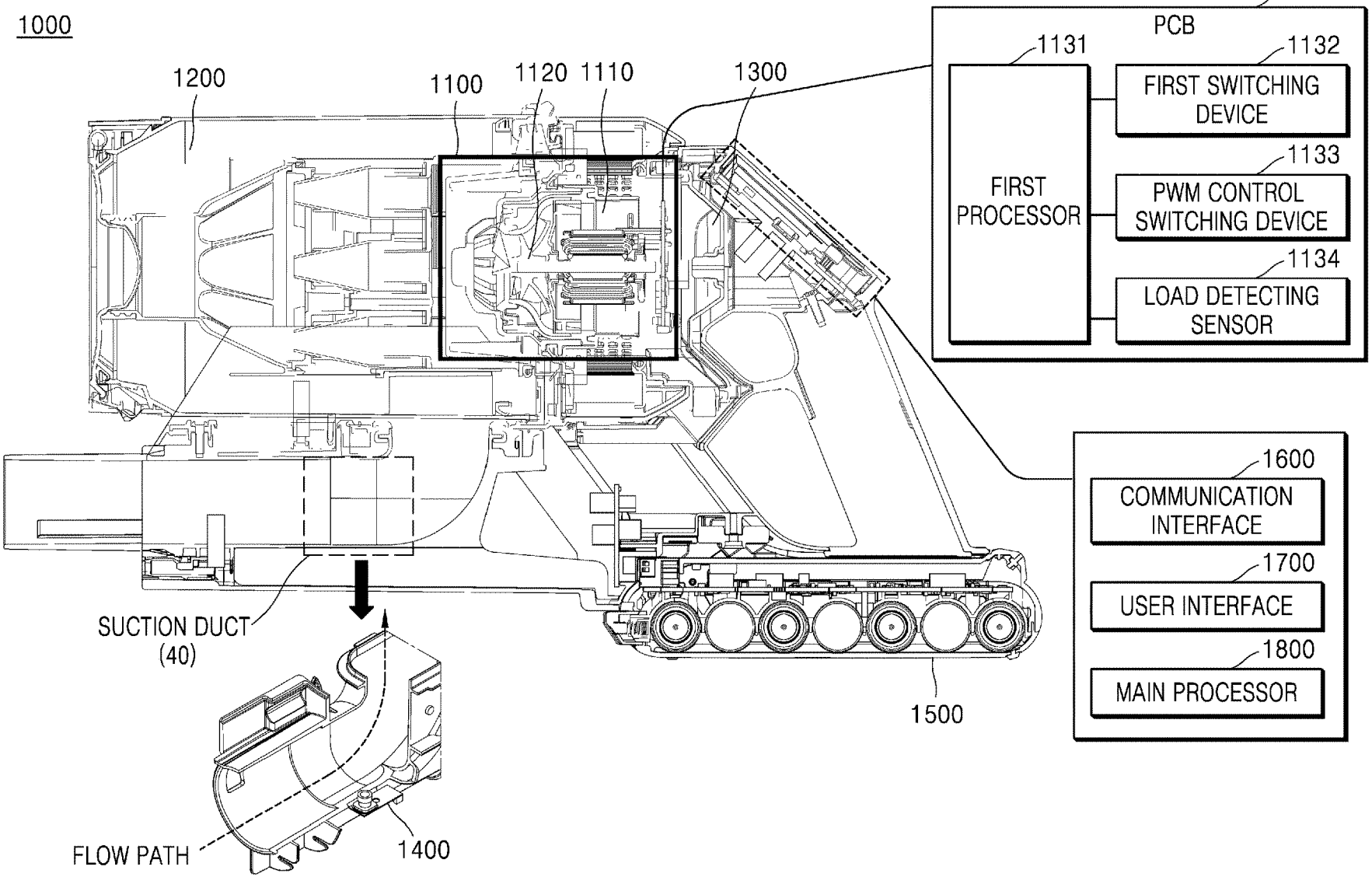
FIG. 2 is a schematic diagram for describing a cleaner body according to an embodiment of the disclosure.

FIG. 2 is a schematic diagram for describing the cleaner body 1000 according to an embodiment of the disclosure.

The cleaner body 1000 may include a handle to be grabbed by the user. Accordingly, the cleaner body 1000 may also be referred to as a handy body. The user may grab the handle and move the cleaner body 1000 and the brush device 2000 back and forth.

Referring to FIG. 2, the cleaner body 1000 may include a suction power generating device (hereinafter, referred to as a motor assembly 1100) for generating suction power required to suck up foreign materials on the surface to be cleaned, a dust collecting container 1200 (also referred to as a dust container) in which the foreign materials sucked up from the surface to be cleaned are accommodated, a filter unit 1300, a pressure sensor 1400, a battery 1500 supplying power to the motor assembly 1100, a communication interface 1600, a user interface 1700, and at least one processor (for example, a main processor 1800). However, not all of the components shown in FIG. 2 are essential components. The cleaner body 1000 may be implemented by more or fewer components than those illustrated in FIG. 2. For example, the cleaner body 1000 may further include a memory (not shown). The memory may store programs for processes and control by the processor, and may store pieces of input/output data (for example, a pre-trained artificial intelligence (AI) model (support vector machine (SVM) algorithm), state data of a suction motor 1110, a measurement value of the pressure sensor 1400, state data of the battery 1500, state data of the brush device 2000, error occurrence data, power consumption of the suction motor 1110 corresponding to an operating condition, drum RPM, and a trip level). The trip level is for preventing overload of the brush device 2000, and may denote a reference load value (for example, a reference current value) for stopping an operation of the brush device 2000.

Each component will now be described below.

The motor assembly 1100 may include the suction motor 1110 configured to switch electric force to mechanical rotating force, a fan 1120 that is rotatable by being connected to the suction motor 1110, and a printed circuit board (PCB) 1130 connected to the suction motor 1110. The suction motor 1110 may form a vacuum inside the cordless vacuum cleaner 100. As used herein, the vacuum denotes a state lower than the atmospheric pressure. The suction motor 1110 may include a brushless direct current (BLDC) motor, but is not limited thereto.

The PCB 1130 may include a processor (hereinafter, a first processor 1131) configured to control the suction motor 1110 and control communication with the brush device 2000, a first switching device 1132 connected to the signal line 30, a switching device (hereinafter, a PWM control switching device 1133) (for example, a field-effect transistor (FET), a transistor, or an insulated gate bipolar transistor (IGBT)) configured to control power supply to the brush device 2000, and a load detecting sensor 1134 (for example, a shunt resistor, a shunt resistor and an amplification circuit (operational amplifier (OP-AMP)), a current detecting sensor, or a magnetic field detecting sensor (non-contact manner)) configured to detect a load of the brush device 2000. Hereinafter, for convenience of descriptions, an FET may be described as an example of the PWM control switching device 1133, and a shunt resistor may be described as an example of the load detecting sensor 1134.

The first processor 1131 may be configured to obtain data (hereinafter, referred to as state data) related to a state of the suction motor 1110, and transmit the state data of the suction motor 1110 to the main processor 1800. Also, the first processor 1131 may be configured to transmit a signal (hereinafter, a first signal) to the brush device 2000 through the signal line 30 by controlling (for example, turning on or off) an operation of the first switching device 1132 connected to the signal line 30. The first switching device 1132 is a device that enables a state of the signal line 30 to become low. For example, the first switching device 1132 is a device that enables a voltage of the signal line 30 to be 0 V. The first signal may include data indicating at least one of a target RPM of a rotating brush of the brush device 2000 (hereinafter, also referred to as drum RPM), a target trip level of the brush device 2000, or a power consumption of the suction motor 1110, but is not limited thereto. For example, the first signal may include data for controlling a lighting device included in the brush device 2000. The first signal may be realized in a pre-set number of bits. For example, the first signal may be realized in 5 bits or 8 bits, and have a transmission cycle of 10 ms per bit, but is not limited thereto.

The first processor 1131 may be configured to detect a signal (hereinafter, a second signal) transmitted from the brush device 2000 through the signal line 30. The second signal may include data indicating a current state of the brush device 2000, but is not limited thereto. For example, the second signal may include data related to a condition being currently operated (for example, current drum RPM, a current trip level, or a current lighting device setting value). Also, the second signal may further include data indicating a type of the brush device 2000. The first processor 1131 may be configured to transmit, to the main processor 1800, the data indicating the current state of the brush device 2000 or the data indicating the type of the brush device 2000, included in the second signal. The PCB 1130 of the motor assembly 1100 will be described in detail below with reference to FIG. 8.

The motor assembly 1100 may be located in the dust collecting container 1200. The dust collecting container 1200 may be configured to filter out dust or dirt in the air that is introduced through the brush device 2000, and collect the same. The dust collecting container 1200 may be provided to be attached to or detached from the cleaner body 1000.

The dust collecting container 1200 may collect foreign materials through a cyclone method of separating the foreign material by using centrifugal force. The air from which the foreign materials are removed through the cyclone method may be discharged out of the cleaner body 1000, and the foreign materials may be contained in the dust collecting container 1200. A multi-cyclone may be arranged inside the dust collecting container 1200. The dust collecting container 1200 may be provided such that the foreign materials are collected below the multi-cyclone. The dust collecting container 1200 may include a dust collecting container door provided such that the dust collecting container 1200 is opened when connected to a cleaning station. The dust collecting container 1200 may include a first dust collecting portion where relatively large foreign materials collected primarily are collected, and a second dust collecting portion where relatively small foreign materials collected by the multi-cyclone are collected. The first dust collecting portion and the second dust collecting portion may both be provided to be externally opened when the dust collecting container door is opened.

The filter unit 1300 may filter out fine particulate matters and the like, which are not filtered out by the dust collecting container 1200. The filter unit 1300 may include a discharge port for discharging the air that passed through a filter of the filter unit 1300 to the outside of the cordless vacuum cleaner 100. The filter unit 1300 may include a motor filter or a high-efficiency particulate air (HEPA) filter, but is not limited thereto.

The pressure sensor 1400 may measure pressure inside a flow path (hereinafter, also referred to as flow path pressure). The pressure sensor 1400 provided at a suction end (for example, a suction duct 40) may measure a flow rate change at a corresponding location by measuring static pressure. The pressure sensor 1400 may be an absolute pressure sensor or a relative pressure sensor. When the pressure sensor 1400 is an absolute pressure sensor, the main processor 1800 may sense a first pressure value before the suction motor 1110 is operated, by using the pressure sensor 1400. Then, the main processor 1800 may sense a second pressure value after the suction motor 1110 is operated at the target RPM, and use a difference between the first pressure value and the second pressure value as a pressure value inside the flow path. Here, the first pressure value may be a pressure value according to internal/external influences, such as the weather, an altitude, a state of the cordless vacuum cleaner 100, and an amount of dust inflow, the second pressure value may be a pressure value according to an operation of the suction motor 1110 and the pressure value according to the internal/external influences, such as the altitude, the state of the cordless vacuum cleaner 100, and the amount of dust inflow. The difference between the first pressure value and the second pressure value may be the pressure value according to an operation of the suction motor 1110. Accordingly, when the difference between the first pressure value and the second pressure value is used as the pressure value inside the flow path, the internal/external influence other than the suction motor 1110 may be reduced.

The flow path pressure measured by the pressure sensor 1400 may be used to identify a current usage environment state of the brush device 2000 (for example, a state of the surface to be cleaned (a hard floor, a carpet, a mat, or a corner) or a state of being lifted from the surface to be cleaned), and may be used to measure suction power that changes according to a contamination degree or a dust collected degree of the dust collecting container 1200.

The pressure sensor 1400 may be located at the suction end (for example, the suction duct 40). The suction duct 40 may be a structure that connects the dust collecting container 1200 and the extension pipe 3000 to each other or the dust collecting container 1200 and the brush device 2000 to each other such that a fluid including the foreign materials may move to the dust collecting container 1200. Considering contamination of dirt/dust, the pressure sensor 1400 may be located at an end of a straight portion (or an inflection point of the straight portion and a curved portion) of the suction duct 40, but is not limited thereto. The pressure sensor 1400 may be located at a center of the straight portion of the suction duct 40. Meanwhile, when the pressure sensor 1400 is located at the suction duct 40, the pressure sensor 1400 is located at a front end of the suction motor 1110 that generates suction power, and thus the pressure sensor 1400 may be implemented as a negative pressure sensor.

In the disclosure, the pressure sensor 1400 is located at the suction duct 40, but an embodiment of the disclosure is not limited thereto. The pressure sensor 1400 may be located at the discharge port (for example, inside the motor assembly 1100). When the pressure sensor 1400 is located at the discharge port, the pressure sensor 1400 is located at a rear end of the suction motor 1110. Thus the pressure sensor 1400 may be implemented as a positive pressure sensor. Also, a plurality of the pressure sensors 1400 may be provided in the cordless vacuum cleaner 100.

The battery 1500 may be detachably mounted on the cleaner body 1000. The battery 1500 may be electrically connected to a charging terminal provided at the cleaning station. The battery 1500 may be charged by receiving power from the charging terminal. The cleaning station may be a device for discharging dust of the cordless vacuum cleaner 100 or for charging the battery 1500. The cordless vacuum cleaner 100 may be mounted (docked) on the cleaning station to discharge dust, charge the battery 1500, or be stored.

The cleaner body 1000 may include the communication interface 1600 for performing communication with an external device. For example, the cleaner body 1000 may communicate with the cleaning station (or a server device) through the communication interface 1600. The communication interface 1600 may include a short-range wireless communication interface and a long-range wireless communication interface. The short-range wireless communication interface may include a Bluetooth communication interface, a Bluetooth low energy (BLE) communication interface, a near field communication (NFC) interface, a wireless local area network (WLAN) (Wi-Fi) communication interface, a Zigbee communication interface, an infrared data association (IrDA) communication interface, a Wi-Fi direct (WFD) communication interface, an ultra-wideband (UWB) communication interface, or an Ant+ communication interface, but is not limited thereto.

The user interface 1700 may be provided at the handle. The user interface 1700 may include an input interface and an output interface. The cleaner body 1000 may receive a user input related to an operation of the cordless vacuum cleaner 100 or output information related to an operation of the cordless vacuum cleaner 100, through the user interface 1700. The input interface may include a power button, a suction power strength adjusting button, and the like. The output interface may include a light-emitting diode (LED) display, a liquid crystal display (LCD), or a touch screen, but is not limited thereto.

The cleaner body 1000 may include at least one processor. The cleaner body 1000 may include one processor or a plurality of processors. For example, the cleaner body 1000 may include the main processor 1800 connected to the user interface 1700 and the first processor 1131 connected to the suction motor 1110. The at least one processor may control all operations of the cordless vacuum cleaner 100. For example, the at least one processor may determine the power consumption of the suction motor 1110, the drum RPM of the brush device 2000, and the trip level of the brush device 2000.

The at least one processor according to an embodiment of the disclosure may include at least one of a central processing unit (CPU), a graphics processing unit (GPU), an accelerated processing unit (APU), a many integrated core (MIC), a digital signal processor (DSP), or a neural processing unit (NPU). The at least one processor may be implemented in the form of an integrated system-on-chip (SoC) including one or more electronic components. The at least one processor may each be implemented as individual hardware. The at least one processor may be referred to as a microprocessor controller (MICOM), a micro-processor unit (MPU), or a micro-controller unit (MCU).

The at least one processor according to an embodiment of the disclosure may be implemented as a single core processor or a multicore processor.

Hereinafter, operations of the at least one processor of the cleaner body 1000 will be described in detail with reference to FIG. 3.

Figure 3:
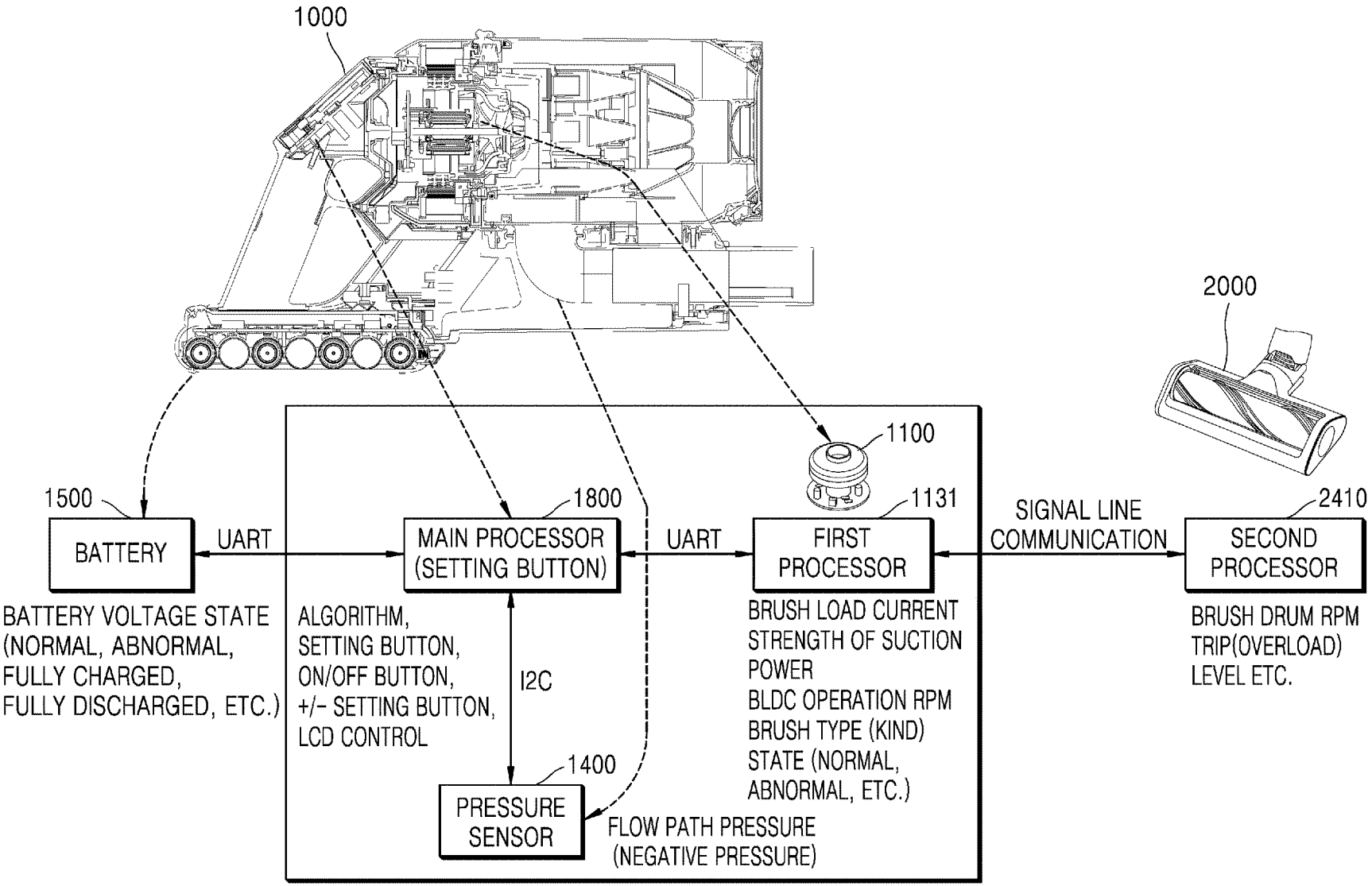
FIG. 3 is a schematic diagram for describing operations of at least one processor, according to an embodiment of the disclosure.

FIG. 3 is a schematic diagram for describing operations of at least one processor, according to an embodiment of the disclosure.

Referring to FIG. 3, the main processor 1800 may identify states of components in the cordless vacuum cleaner 100 by communicating with the battery 1500, the pressure sensor 1400, and the first processor 1131 in the motor assembly 1100. Here, the main processor 1800 may communicate with each component by using a universal asynchronous receiver/transmitter (UART) or an inter-integrated circuit (I2C), but is not limited thereto. For example, the main processor 1800 may obtain, from the battery 1500 by using UART, data related to a voltage state (for example, normal, abnormal, fully charged, or fully discharged) of the battery 1500. The main processor 1800 may obtain, from the pressure sensor 1400, data related to flow path pressure by using the I2C.

Also, the main processor 1800 may obtain, from the first processor 1131 connected to the suction motor 1110 by using the UART, data related to suction power strength, RPM of the suction motor 1110, and a state (for example, normal or abnormal) of the suction motor 1110. Suction power is electric force consumed to operate the cordless vacuum cleaner 100, and may be referred to as power consumption. The main processor 1800 may obtain, from the first processor 1131, data related to load of the brush device 2000 and data about a type of the brush device 2000.

Meanwhile, the first processor 1131 may obtain, from the brush device 2000 through signal line communication with a second processor 2410 of the brush device 2000, state data (for example, drum RPM, a trip level, normal, or abnormal) of the brush device 2000. Here, the first processor 1131 may transmit the state data of the brush device 2000 to the main processor 1800 through the UART. According to an embodiment of the disclosure, the first processor 1131 may transmit, to the main processor 1800, state data of the suction motor 1110 and the state data of the brush device 2000 at different intervals. For example, the first processor 1131 may transmit the state data of the suction motor 1110 to the main processor 1800 every 0.02 seconds, and transmit the state data of the brush device 2000 to the main processor 1800 every 0.2 seconds, but is not limited thereto.

When the first processor 1131 of the cleaner body 1000 and the second processor 2410 of the brush device 2000 are connected to each other through the UART or I2C, a high impedance effect caused by an internal line of the extension pipe 3000, and damaging of a circuit device (for example, a maximum value excess of a MICOM AD port) caused by ESD and/or an over voltage can or may become issues. Thus, according to an embodiment of the disclosure, the first processor 1131 of the cleaner body 1000 and the second processor 2410 of the brush device 2000 communicate with each other through the signal line communication instead of the UART or I2C. Here, a circuit for the signal line communication may include a voltage distributing circuit (hereinafter, referred to as a voltage distributer) to prevent the damaging of the circuit device caused by over voltage, power noise, surge, electrical overstress (ESD), or electrical discharge (EOS), etc.

Meanwhile, the main processor 1800 may receive a user input on a setting button (for example, an on/off button or a +/− setting button) included in the user interface 1700 or control an output of an LCD. The main processor 1800 may identify the usage environment state (for example, a state of a surface to be cleaned (a hard floor, a carpet, a mat, or a corner) and a state of being lifted from the surface to be cleaned), by using a pre-trained AI model (for example, a SVM algorithm), and determine operating information (for example, power consumption, drum RPM, or trip level of the suction motor 1110) of the cordless vacuum cleaner 100 suitable to the usage environment state of the brush device 2000. Here, the main processor 1800 may transmit, to the first processor 1131, the operating information of the cordless vacuum cleaner 100 suitable to the usage environment state of the brush device 2000. The first processor 1131 may adjust the strength of suction power (power consumption or RPM) of the suction motor 1110 according to the operating information of the cordless vacuum cleaner 100, and transmit the operating information of the cordless vacuum cleaner 100 suitable to the usage environment state of the brush device 2000, to the second processor 2410 through the signal line communication. In this case, the second processor 2410 may adjust the drum RPM, trip level, and lighting device (for example, an LED display) according to the operating information of the cordless vacuum cleaner 100. Operations by which the main processor 1800 identifies the usage environment state of the brush device 2000 by using the pre-trained AI model (for example, the SVM algorithm) and determines the operating information of the cordless vacuum cleaner 100 suitable to the usage environment state of the brush device 2000 will be described in detail below with reference to FIG. 15, and hereinafter, the brush device 2000 will be described in more detail with reference to FIG. 4.

Figure 4:
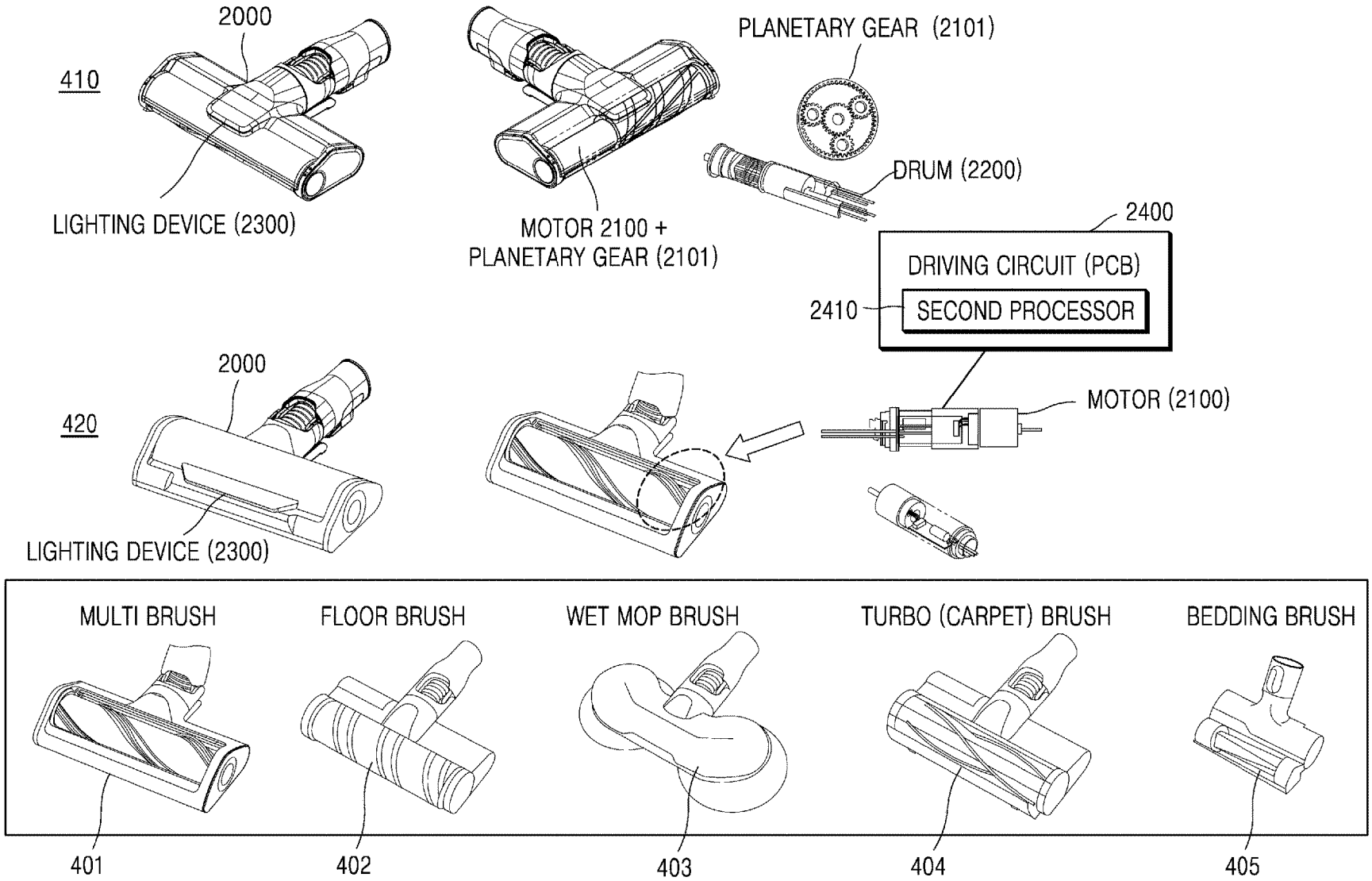
FIG. 4 is a collection of perspective diagrams for describing a brush device according to an embodiment of the disclosure.

FIG. 4 is a collection of perspective diagrams for describing the brush device 2000 according to an embodiment of the disclosure.

Referring to FIG. 4, the brush device 2000 may include a motor 2100, a drum 2200 to which a rotating brush is attached, and a lighting device 2300, but is not limited thereto. The motor 2100 of the brush device 2000 may be provided inside the drum 2200 or outside the drum 2200. When the motor 2100 is provided outside the drum 2200, the drum 2200 may receive power from the motor 2100 through a belt.

Referring to reference numeral 410 of FIG. 4, the motor 2100 may be a planet geared motor. The planet geared motor may have a form in which a planet gear 2101 is combined to or with a direct current (DC) motor. The planet gear 2101 adjusts an RPM of the drum 2200 according to a gear ratio. In the planet geared motor, the RPM of the motor 2100 and the RPM of the drum 2200 may have a constant or varied ratio. Referring to a reference numeral 420 of FIG. 4, the motor 2100 may be a BLDC motor, but is not limited thereto. In the BLDC motor, the RPM of the motor 2100 and the RPM of the drum 2200 may be the same.

The lighting device 2300 lights up a dark surface to be cleaned, lights up dust or foreign materials of the surface to be cleaned to be easily identified, or indicates a state of the brush device 2000, and may be provided in front of or at the top of the brush device 2000. The lighting device 2300 may include an LED display, but is not limited thereto. For example, the lighting device 2300 may be a laser. The lighting device 2300 may automatically operate when the motor 2100 operates, or may operate according to control by the second processor 2410. According to an embodiment of the disclosure, the lighting device 2300 may change a color or brightness according to control by the second processor 2410.

Referring to the reference numeral 420 of FIG. 4, the brush device 2000 may further include a PCB 2400. The PCB 2400 may include a circuit for the signal line communication with the cleaner body 1000. For example, the PCB 2400 may include the second processor 2410, a switching device (hereinafter, also referred to as a second switching device) (not shown) connected to the signal line 30, and an identification (ID) resistor (not shown) indicating a type of the brush device 2000, but is not limited thereto. The PCB 2400 will be described in detail below with reference to FIG. 8.

Meanwhile, a type of the brush device 2000 may vary. For example, the brush device 2000 may include a multi-brush 401, a hard floor brush 402, a damp cloth brush 403, a turbo (carpet) brush 404, a bedding brush 405, a bristle brush (not shown), a gap brush (not shown), and a pet brush, but is not limited thereto.

According to an embodiment of the disclosure, the type of the brush device 2000 may be distinguished by the ID resistor included in the brush device 2000. Operations by which the cleaner body 1000 identifies a type of the brush device 2000 combined to the cordless vacuum cleaner 100 will be described with reference to FIG. 5.

Figure 5:
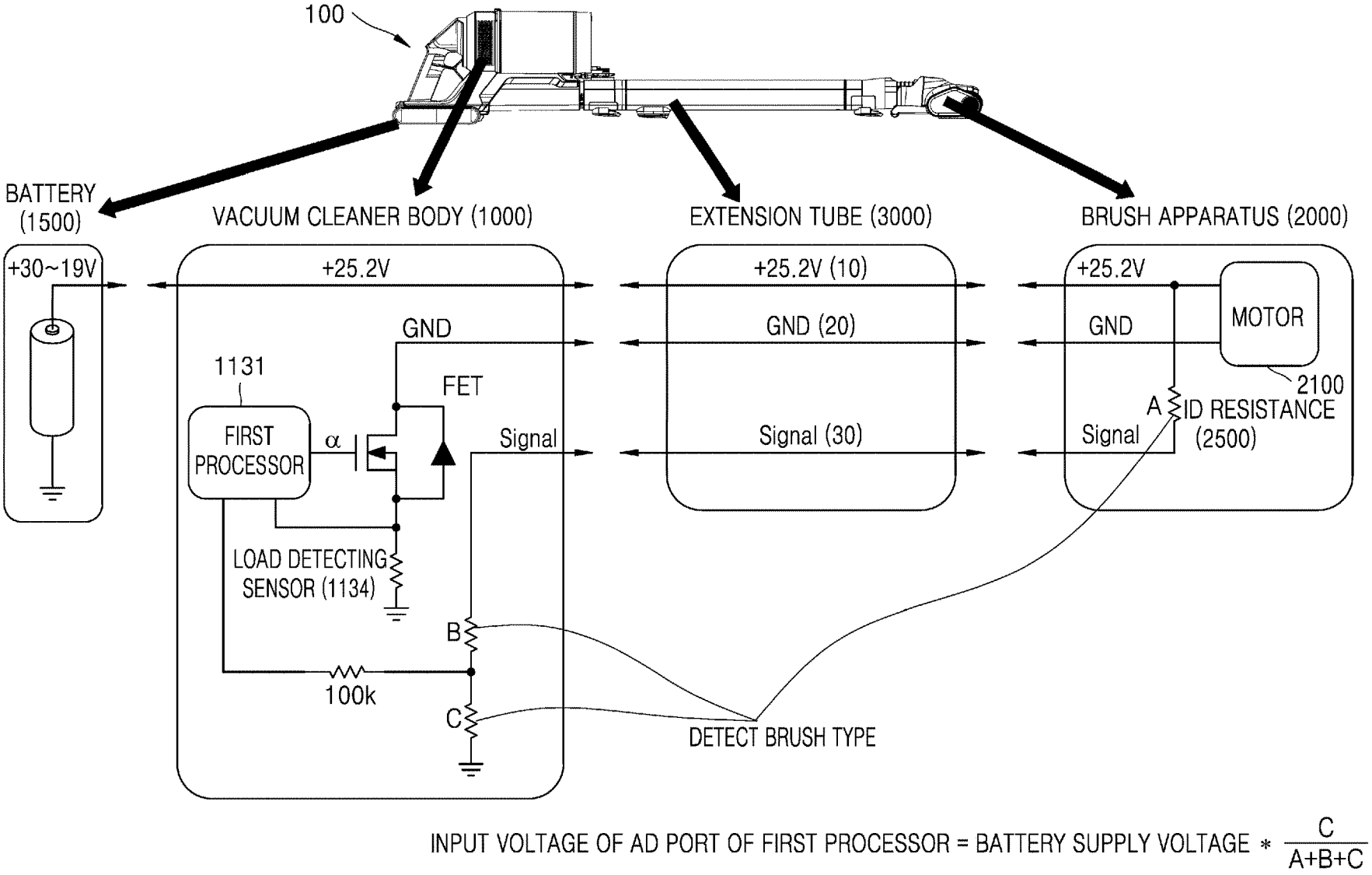
FIG. 5 is a schematic diagram for describing an operation by which a cleaner body identifies a type of a brush device, according to an embodiment of the disclosure.

FIG. 5 is a schematic diagram for describing an operation by which the cleaner body 1000 identifies a type of the brush device 2000, according to an embodiment of the disclosure.

Referring to FIG. 5, the motor assembly 1100 of the cleaner body 1000 may include the first processor 1131 and a load detecting sensor 1134 (for example, a shunt resistor), and the brush device 2000 may include an ID resistor 2500. The ID resistor 2500 may be located between the power lines 10 and 20 and the signal line 30. The ID resistor 2500 indicates a type of the brush device 2000 and may vary according to the type of brush device 2000. For example, the ID resistor 2500 of the multi-brush 401 (see FIG. 4) may be 330 KΩ, the ID resistor 2500 of the hard floor brush 402 (see FIG. 4) may be 2.2 MΩ, and the ID resistor 2500 of the turbo (carpet) brush 404 (see FIG. 4) may be 910 KΩ, but the ID resistor 2500 is not limited thereto.

The first processor 1131 may detect detachment of the brush device 2000 by using the load detecting sensor 1134. For example, when the brush device 2000 is not combined to the cordless vacuum cleaner 100 (for example, a handy mode), an operating current of the brush device 2000, detected by the load detecting sensor 1134, may be 0 A (zero). On the other hand, when the brush device 2000 is combined to the cordless vacuum cleaner 100 (for example, a brush mode), the operating current of the brush device 2000, detected by the load detecting sensor 1134, may be equal to or greater than 50 mA. Accordingly, the first processor 1131 may determine that the brush device 2000 is detached when the operating current of the brush device 2000, detected by the load detecting sensor 1134, is 0 A, and that the brush device 2000 is combined when the operating current of the brush device 2000, detected by the load detecting sensor 1134, is equal to or greater than 50 mA. A value of a reference operating current for determining that the brush device 2000 is combined is not limited to 50 mA, and may vary.

When it is determined that the brush device 2000 is combined to the cordless vacuum cleaner 100, the first processor 1131 may identify a type of the brush device 2000, based on a voltage value input to an input port of the first processor 1131. For example, when the brush device 2000 includes an ID resistor A, and the PCB 1130 of the cleaner body 1000 includes voltage distributers (a resistor B and a resistor C) connected to the signal line 30, a voltage input to the input port of the first processor 1131 may be as follows.

$$\text{AD Port Input Voltage}=\text{Battery Supply Voltage}*C/A+B+C$$

The voltage value input to the input port of the first processor 1131 may decrease when a value of the ID resistor 2500 increases. When the resistor B and the resistor C are constant, the voltage value input to the input port varies according to a value of the ID resistor A. Thus the first processor 1131 may identify a type of the brush device 2000 corresponding to the ID resistor 2500, based on the voltage value input to the input port. FIG. 6 may be referenced.

FIG. 6 is a table for describing an ID resistor of the brush device 2000, according to an embodiment of the disclosure.

Referring to a table 600 of FIG. 6, an ID resistor of the multi-brush 401 may be 330 KΩ, an ID resistor of the hard floor brush 402 may be 2.2 MΩ, and an ID resistor of the turbo (carpet) brush 404 may be 910 KΩ. When a voltage of the battery 1500 is 25.2 V, the voltage value input to the input port of the first processor 1131 is 2.785 V when the multi-brush 401 is combined to the cordless vacuum cleaner 100, the voltage value input to the input port of the first processor 1131 is 0.791 V when the hard floor brush 402 is combined to the cordless vacuum cleaner 100, and the voltage value input to the input port of the first processor 1131 is 1.563 V when the turbo (carpet) brush 404 is combined to the cordless vacuum cleaner 100. Accordingly, when it is determined that the brush device 2000 is combined to the cordless vacuum cleaner 100 and the voltage of the battery 1500 is 25.2 V, the first processor 1131 identifies that the multi-brush 401 is combined when the voltage value input to the input port is 2.785 V, identifies that the hard floor brush 402 is combined when the voltage value input to the input port is 0.791 V, and identifies that the turbo (carpet) brush 404 is combined when the voltage value input to the input port is 1.563 V.

Hereinafter, a configuration of the cordless vacuum cleaner 100 for the signal line communication between the cleaner body 1000 and the brush device 2000 will be described with reference to FIGS. 7A and 7B.

Figure 7A:
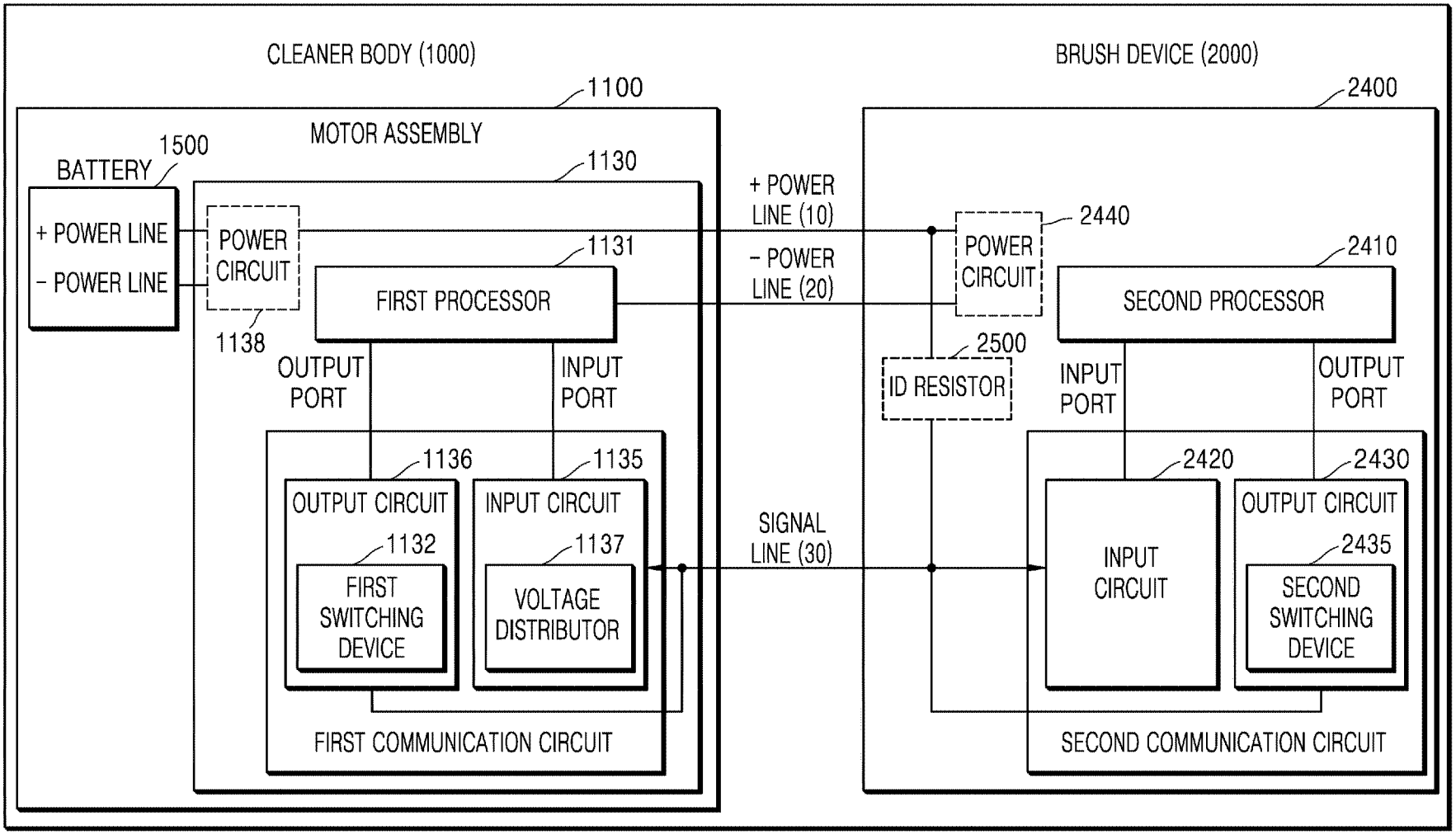
FIG. 7A is a block diagram for describing functions of a cordless vacuum cleaner for signal line communication, according to an embodiment of the disclosure.

FIG. 7A is a block diagram for describing functions of the cordless vacuum cleaner 100 for signal line communication, according to an embodiment of the disclosure.

The PCB 1130 in the motor assembly 1100 for the signal line communication may include the first processor 1131, an input circuit 1135, an output circuit 1136, and a power circuit 1138, but is not limited thereto.

The input circuit 1135 is a circuit for identifying a type of the brush device 2000 through an ID resistor of the brush device 2000, or detecting (receiving) the second signal transmitted from the brush device 2000. The input circuit 1135 may include a voltage distributer 1137 (hereinafter, also referred to as a first voltage distributer). The voltage distributer 1137 is configured to distribute a voltage input from the signal line 30 to the input port of the first processor 1131. The voltage distributer 1137 will be described in detail below with reference to FIG. 9.

The output circuit 1136 is a circuit for transmitting the first signal to the brush device 2000. The output circuit 1136 may include the first switching device 1132. The first switching device 1132 may be an FET or a bipolar junction transistor (BJT), and is a device that enables a voltage of the signal line 30 to become 0 V (ground (GND) or low) through a switching operation.

The first processor 1131 may transmit the first signal to the brush device 2000 through the signal line 30 and detect the second signal transmitted from the brush device 2000 through the signal line 30, by controlling operations of the first switching device 1132 connected to the signal line 30. The first processor 1131 may control the brush device 2000 by transmitting the first signal through the output circuit 1136. For example, the first processor 1131 may control the drum RPM, the trip level, or the like of the brush device 2000 by transmitting, to the brush device 2000, the first signal including data indicating at least one of target RPM of the drum 2200 of the brush device 2000, a target trip level of the brush device 2000, or power consumption of the suction motor 1110.

The power circuit 1138 may be a circuit connected to the battery 1500 and supplying power to the motor assembly 1100. The power circuit 1138 may be a step-down converter, for example, a DC/DC converter.

The PCB 2400 of the brush device 2000 for the signal line communication may include the second processor 2410, an input circuit 2420, an output circuit 2430, a power circuit 2440, and the ID resistor 2500, but is not limited thereto.

The input circuit 2420 is a circuit for detecting (receiving) the first signal transmitted from the cleaner body 1000. The input circuit 2420 may include a switching device (for example, a PNP transistor or a P-channel FET), but is not limited thereto. The input circuit 2420 may include a second voltage distributor. A case where the input circuit 2420 of the brush device 2000 includes the second voltage distributor will be described in detail below with reference to FIG. 20.

The output circuit 2430 is a circuit for transmitting the second signal to the cleaner body 1000. The output circuit 2430 may include a second switching device 2435. The second switching device 2435 may be an FET or a BJT, and is a device that enables a voltage of the signal line 30 to become 0 V (ground (GND) or low) through a switching operation.

The second processor 2410 may transmit the second signal to the cleaner body 1000 through the signal line 30 and may detect the first signal transmitted from the cleaner body 1000 through the signal line 30, by controlling operations of the second switching device 2435 connected to the signal line 30. According to the first signal, the second processor 2410 may adjust the RPM of the drum 2200 to the target RPM or adjust the trip level to the target trip level. Also, when the first signal includes data for controlling the lighting device 2300 included in the brush device 2000, the second processor 2410 may control an output or brightness intensity of the lighting device 2300, based on the first signal. For example, when the first signal indicating that there is abnormality in the cleaner body 1000 is received, the second processor 2410 may control the lighting device 2300 to change a color to indicate the abnormality of the cleaner body 1000. The second processor 2410 may control the lighting device 2300 to output a color corresponding to the current usage environment state of the brush device 2000 (for example, a state of a surface to be cleaned (hard floor, carpet, mat, or corner) or a state of being lifted from the surface to be cleaned). The second processor 2410 may change a color of the lighting device 2300 to a certain color (for example, red), when it is detected that a foreign material is stuck in the drum 2200.

Figure 7B:
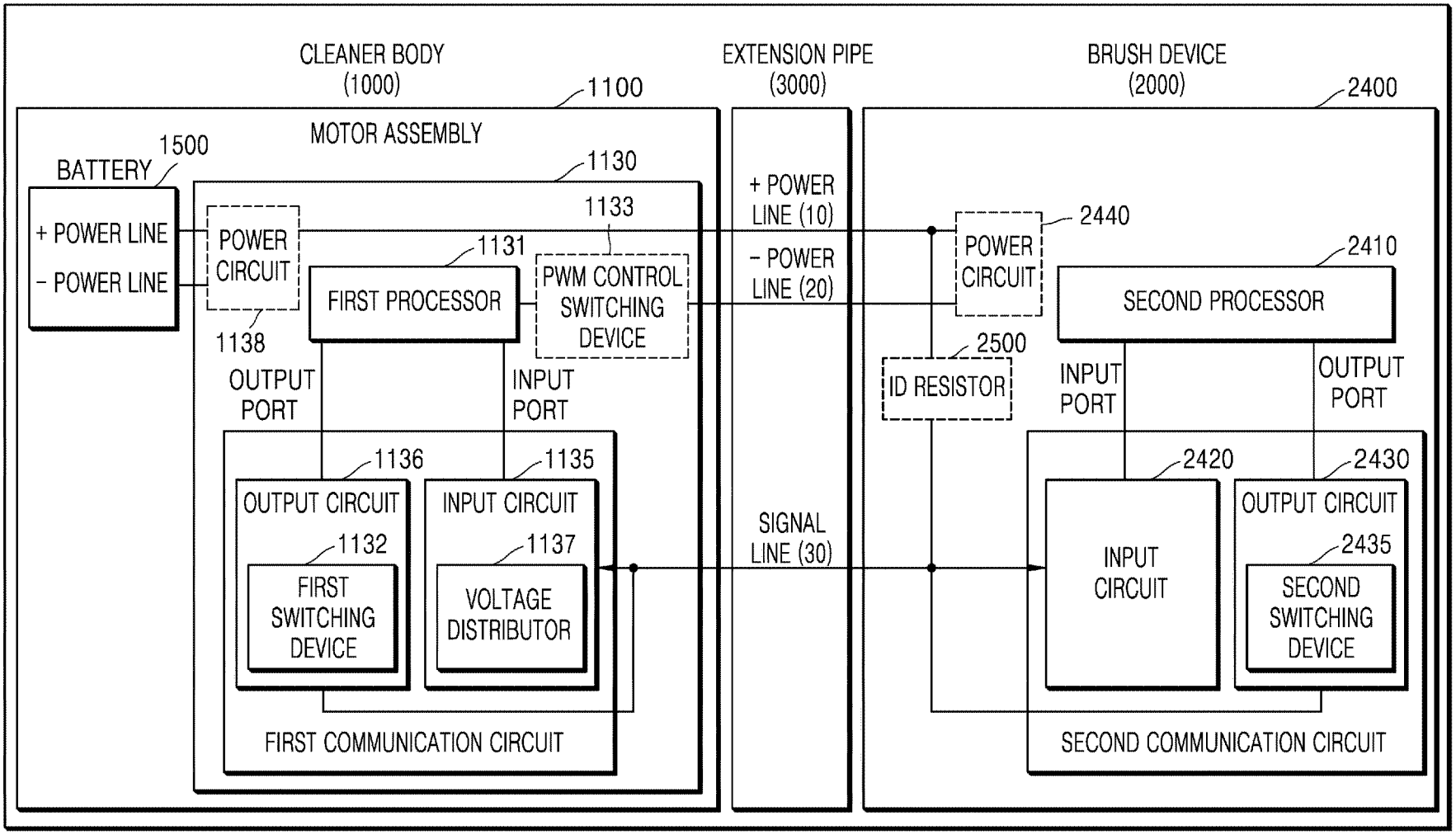
FIG. 7B is a block diagram for describing functions of a cordless vacuum cleaner including an extension pipe, according to an embodiment of the disclosure.

FIG. 7B is a block diagram for describing functions of the cordless vacuum cleaner 100 including the extension pipe 3000, according to an embodiment of the disclosure.

The PCB 1130 of the motor assembly 1100 shown in FIG. 7B may correspond to the PCB 1130 of the motor assembly 1100 shown in FIG. 7A, and the PCB 2400 of the brush device 2000 shown in FIG. 7B may correspond to the PCB 2400 shown in FIG. 7A.

Referring to FIG. 7B, the cleaner body 1000 and the brush device 2000 may be physically connected to each other through the extension pipe 3000. Here, the extension pipe 3000 may include the +power line 10, the −power line 20, and the signal line 30. Accordingly, even when the cleaner body 1000 and the brush device 2000 are connected through the extension pipe 3000, the cleaner body 1000 and the brush device 2000 may stably perform the signal line communication.

According to an embodiment of the disclosure, the motor assembly 1100 may include a switching device (hereinafter, referred to as the PWM control switching device 1133) for controlling PWM to control power of the battery 1500 supplied to the motor 2100 of the brush device 2000. The PWM control switching device 1133 is a component for the first processor 1131 of the cleaner body 1000 to control power supply to the brush device 2000, and may be referred to as a third switching device. The PWM control switching device 1133 may be an FET, but is not limited thereto.

According to an embodiment of the disclosure, the first processor 1131 may control a power supply to the brush device 2000 by controlling the PWM control switching device 1133 according to a type of the brush device 2000. For example, when the brush device 2000 is a multi-brush including the PCB 2400 (see the reference numeral 420 of FIG. 4), the first processor 1131 may continuously output a high signal to the PWM control switching device 1133 such that power is continuously supplied to the brush device 2000. In this case, the PWM control switching device 1133 continuously maintains an on-state, the PCB 2400 of the brush device 2000 may continuously receive power.

On the other hand, when the brush device 2000 is a general brush not including the PCB 2400 (see the reference numeral 410 of FIG. 4), the first processor 1131 may output a high signal and a low signal alternately to the PWM control switching device 1133 such that the PWM control switching device 1133 may repeat the on-state and an off-state. In this case, the PWM control switching device 1133 may control power of the battery 1500 supplied to the motor 2100 thereby satisfying an output required according to features by use of each brush device 2000. In other words, the first processor 1131 may adjust an output of the motor 2100 by adjusting a duty value (hereinafter, also referred to as a duty) of the PWM control switching device 1133 to be high for a first brush device that requires a high output and supplying power to the first brush device, and by adjusting the duty value to be low for a second brush device that requires a low output and supplying power to the second brush device. As used herein, the duty value denotes a duty cycle of a pulse width when a cycle is uniform, and in particular, may denote a ratio of an interval (on duty interval) where power is transmitted and an interval (off duty interval) where power is blocked. When the duty value increases, an overall time a current flows in the motor 2100 increases, and thus average power supplied to the brush device 2000 may increase.

Also, for the cordless vacuum cleaner 100 to which the battery 1500 is applied, a voltage supplied from the battery 1500 tends to decrease as the battery 1500 is discharged. When the motor 2100 of the brush device 2000 is operated with a uniform duty value, the voltage of the battery 1500 may decrease as a cleaning time elapses, and thus a phenomenon in which the drum RPM of the brush device 2000 decreases may occur. Accordingly, the first processor 1131 of the cleaner body 1000 may compensate for the phenomenon in which the drum RPM of the brush device 2000 decreases, by increasing the duty value (an interval where the PWM control switching device 1133 is turned on and power is supplied for a single cycle) as the voltage of the battery 1500 is decreased.

Hereinafter, for convenience of descriptions, the cordless vacuum cleaner 100 includes the extension pipe 3000 and the cleaner body 1000 includes the PWM control switching device 1133, but an embodiment of the disclosure is not limited thereto. An example of a circuit for the signal line communication of the cordless vacuum cleaner 100 will be described in detail with reference to FIG. 8.

Figure 8:
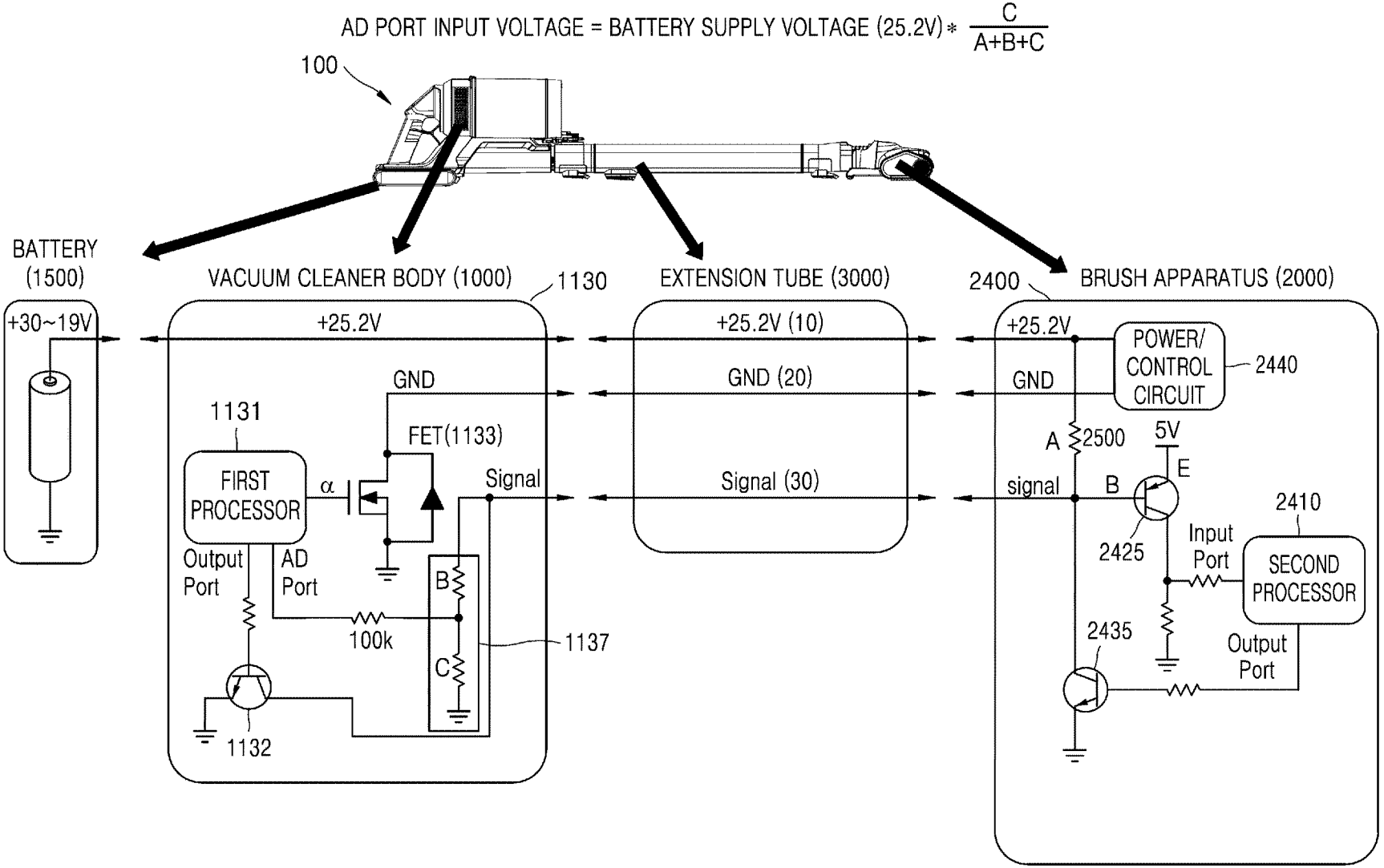
FIG. 8 is a schematic diagram for describing a circuit for signal line communication of a cordless vacuum cleaner, according to an embodiment of the disclosure.

FIG. 8 is a schematic diagram for describing the circuit for the signal line communication of the cordless vacuum cleaner 100, according to an embodiment of the disclosure. In FIG. 8, for convenience of descriptions, an example in which A is 330 KΩ, B is 330 KΩ, and C is 82 KΩ will be described.

The first processor 1131 may identify a type of the brush device 2000 based on a voltage input to the input port (AD port). For example, an input voltage of the AD port of the first processor 1131 is 2.785 V (=Battery Supply Voltage*C/A+B+C), and thus the first processor 1131 may identify that the multi-brush 401 having the ID resistor 2500 of 330 KΩ (A) corresponding to the 2.785 V that is the input voltage of the AD port is connected (see Table 600 of FIG. 6).

When the brush device 2000 combined to the cordless vacuum cleaner 100 is identified as the multi-brush 401 including the PCB 2400, the cleaner body 1000 may perform the signal line communication with the brush device 2000.

The first processor 1131 of the cleaner body 1000 may receive a signal by using the input port and may transmit a signal by using the output port. For example, when the first processor 1131 outputs a low signal through the output port, the first switching device 1132 may be turned off. When the first switching device 1132 is turned off, a voltage of the signal line 30 may be about 14 V (=Battery Supply Voltage*C/A+B+C), and thus in a high state. When the voltage of the signal line 30 is about 14 V, the voltage is greater than 5 V, and thus a PNP transistor 2425 may be turned off and a low (0 V) signal may be input to the input port of the second processor 2410. On the other hand, when the first processor 1131 outputs a high signal through the output port, the first switching device 1132 may be turned on. When the first switching device 1132 is turned on, the voltage of the signal line 30 is changed to 0 V (GND), and thus in a low state. When the voltage of the signal line 30 is 0 V, the PNP transistor 2425 is turned on and a high signal (about 4.8 V) may be input to the input port of the second processor 2410. In other words, when the first processor 1131 outputs the low signal through the output port, the low signal may be input to the input port of the second processor 2410, and when the first processor 1131 outputs the high signal through the output port, the high signal may be input to the input port of the second processor 2410.

The second processor 2410 of the brush device 2000 may receive a signal by using the input port and transmit a signal by using the output port. For example, when the second processor 2410 outputs a high signal through the output port, the second switching device 2435 may be turned on. When the second switching device 2435 is turned on, the voltage of the signal line 30 is changed to 0 V (GND), and thus in a low state. When the voltage of the signal line 30 is 0 V, a low signal (0 V) may be input to the input port of the first processor 1131. On the other hand, when the second processor 2410 outputs a low signal through the output port, the second switching device 2435 may be turned off. When the second switching device 2435 is turned off, the voltage of the signal line 30 may be about 14 V (=Battery Supply Voltage*C/A+B+C), and thus in a high state. When the voltage of the signal line 30 is about 14 V, 2.785 V may be input to the input port of the first processor 1131. Here, the PCB 1130 of the cleaner body 1000 includes the voltage distributer 1137, and thus a high voltage (14 V) of the signal line 30 may be distributed and 2.785 V may be input to the input port of the first processor 1131. In other words, when the second processor 2410 outputs the high signal through the output port, the low signal (0 V) may be input to the input port of the first processor 1131, and when the second processor 2410 outputs the low signal through the output port, 2.785 V (about 2.8 V) may be input to the input port of the first processor 1131.

In FIG. 8, the PNP transistor 2425 is included in the PCB 2400 of the brush device 2000 as a switching device, but an embodiment of the disclosure is not limited thereto. For example, a P-channel FET may be used as a switching device instead of the PNP transistor 2425.

According to an embodiment of the disclosure, the PCB 1130 for the signal line communication of the cleaner body 1000 includes the voltage distributer 1137. Thus, when the first processor 1131 receives a signal from the second processor 2410, stable signal transmission is possible by reducing a noise effect of the signal line 30. This will be described in more detail with reference to FIG. 9.

Figure 9:
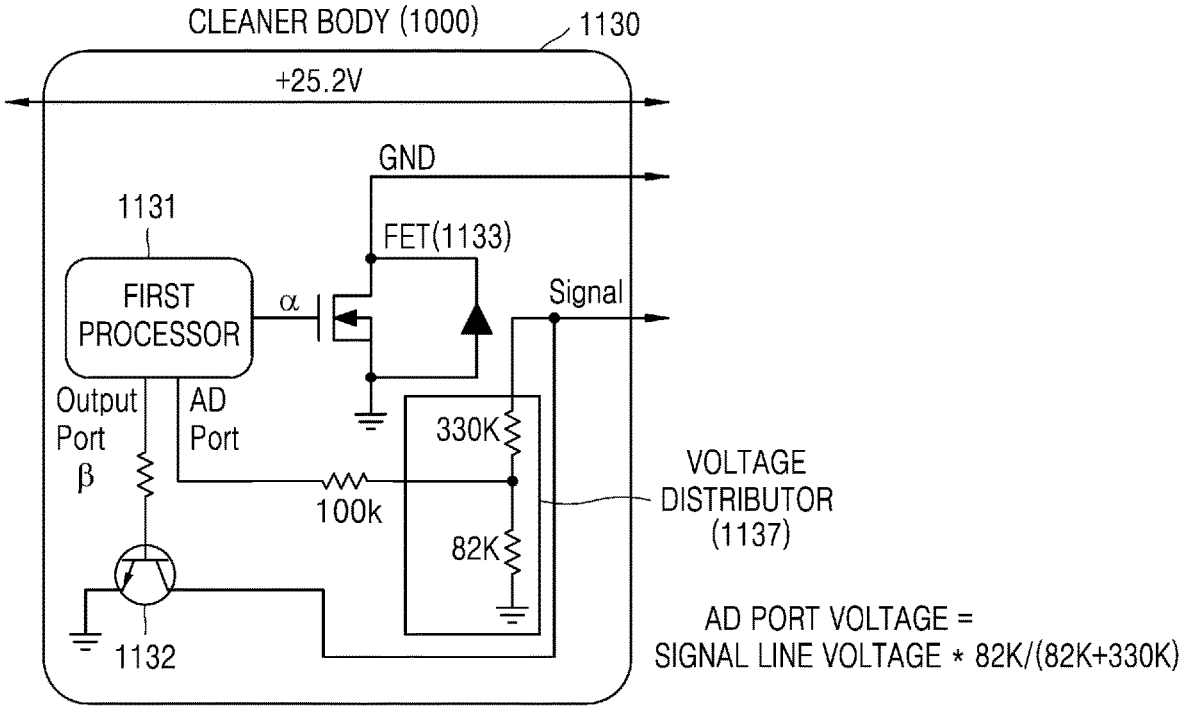
FIG. 9 is a schematic diagram for describing a driving circuit of a cleaner body, according to an embodiment of the disclosure.

FIG. 9 is a schematic diagram for describing the PCB 1130 of the cleaner body 1000, according to an embodiment of the disclosure. The PCB 1130 of FIG. 9 may correspond to the PCB 1130 of FIG. 8, and thus redundant descriptions are omitted.

Referring to FIG. 9, the PCB 1130 of the cleaner body 1000 may include the voltage distributer 1137. Thus, even when a noise voltage is applied to the signal line 30, the noise voltage may also be distributed and input to the input port (AD port) of the first processor 1131. A case in which noise of ±1.5 V occurs will be described as an example.

Referring to a table 900 of FIG. 9, in a general circuit, an AD port voltage may be 3.3 V in a situation (normal) where noise does not occur, and the AD port voltage may be from 1.8 V to 4.8 V in a situation where noise of ±1.5 V occurs. In other words, when noise occurs in the general circuit, the AD port voltage may exceed an AD port maximum voltage (for example, 3.3 V) of MICOM, and thus the first processor 1131 may be easily damaged. Also, in the general circuit, a high signal may be misrecognized as a low signal (or a low signal as a high signal) by noise (±1.5 V).

However, in the PCB 1130 according to an embodiment of the disclosure, the voltage of the input port of the first processor 1131 may be 2.78 V in a situation (normal) where noise does not occur, and even when noise of ±1.5 V occurs, the voltage of the input port of the first processor 1131 may be 2.49 V to 3.08 V. In other words, according to the PCB 1130 including the voltage distributer 1137, even when noise occurs, the voltage of the input port of the first processor 1131 does not exceed the AD port maximum voltage (for example, 3.3 V) of the MICOM, and thus robust signal transmission is possible. Also, even when noise of ±1.5 V occurs in the signal line 30, about ±0.3 V affects the input port of the first processor 1131, and thus a signal distortion phenomenon (for example, a high signal being misrecognized as a low signal or a low signal being misrecognized as a high signal) may be reduced.

Hereinafter, signal transmission between the cleaner body 1000 and the brush device 2000 will be described in more detail with reference to FIGS. 10 through 12.

FIG. 10 is a table for describing a data format included in a signal transmitted between the cleaner body 1000 and the brush device 2000, according to an embodiment of the disclosure.

Referring to FIG. 10, a lookup table 1010 including operating information 1002 of the cordless vacuum cleaner 100, corresponding to an operating condition 1001, and data 1003 indicating the operating condition 1001 may be stored in each of a memory of the cleaner body 1000 and a memory of the brush device 2000. Here, the operating information 1002 of the cordless vacuum cleaner 100, corresponding to the operating condition 1001, may include the power consumption of the suction motor 1110, the drum RPM of the brush device 2000, and the trip level of the brush device 2000, but is not limited thereto. Also, the data 1003 indicating the operating condition 1001 may be 8-bit data, but is not limited thereto. For example, the data 1003 indicating the operating condition 1001 may be 5-bit data.

According to an embodiment of the disclosure, when the data 1003 indicating the operating condition 1001 is in 8 bits, the data 1003 indicating the operating condition 1001 may include one start bit, three command bits, three parity bits, and one stop bit. In FIG. 10, there are three command bits, and thus the operating condition 1001 is classified into 8 bits, but there may be more operating conditions when the number of command bits increases.

The operating condition 1001 may be classified depending on a type of the brush device 2000, a usage environment state (for example, a state (hard floor, carpet, mat, or corner) of a surface to be cleaned or a state of being lifted from the surface to be cleaned) of the brush device 2000, and an abnormality of the suction motor 1110.

Referring to the lookup table 1010 of FIG. 10, a first operating condition indicates a case where the state of the surface to be cleaned is a hard floor, and first operating information in the first operating condition may be "power consumption of suction motor 1110: 70 W, drum RPM: 2000, trip level: 4.0 A". In other words, when the main processor 1800 identifies that the current state of the surface to be cleaned is a hard floor, the cordless vacuum cleaner 100 may determine to operate based on the first operating information corresponding to the first operating condition. Accordingly, the main processor 1800 may transmit information about the first operating condition to the first processor 1131, and the first processor 1131 may identify the first operating information corresponding to the first operating condition and adjust the power consumption of the suction motor 1110 to 70 W. Also, the first processor 1131 may transmit, to the second processor 2410, data (00011101) indicating the first operating condition. When the data (00011101) indicating the first operating condition is received, the second processor 2410 may identify the first operating information corresponding to the first operating condition, adjust the drum RPM to 2000 rpm, and set the trip level to 4.0 A.

A second operating condition indicates a case where the state of the surface to be cleaned is a carpet (normal load), and second operating information in the second operating condition may be "power consumption of suction motor 1110: 115 W, drum RPM: 3800, trip level: 4.9 A". In other words, when the main processor 1800 identifies that the current state of the surface to be cleaned is a carpet (normal load), the cordless vacuum cleaner 100 may determine to operate based on the second operating information corresponding to the second operating condition. Accordingly, the main processor 1800 may transmit information about the second operating condition to the first processor 1131, and the first processor 1131 may identify the second operating information corresponding to the second operating condition and adjust the power consumption of the suction motor 1110 to 115 W. Also, the first processor 1131 may transmit, to the second processor 2410, data (00101011) indicating the second operating condition. When the data (00101011) indicating the second operating condition is received, the second processor 2410 may identify the second operating information corresponding to the second operating condition, adjust the drum RPM to 3800 rpm, and set the trip level to 4.9 A. The power consumption (suction power strength) of the suction motor 1110 is greater when the state of the surface to be cleaned is a carpet than when the state of the surface to be cleaned is a hard floor, and thus the trip level may also increase from 4.0 A to 4.9 A. The trip level is for preventing overload of the brush device 2000, and the motor 2100 may stop when the load of the brush device 2000 reaches 4.9 A.

A third operating condition indicates a case where the state of the surface to be cleaned is a carpet (overload, high-density carpet), and third operating information in the third operating condition may be "power consumption of suction motor 1110: 40 W, drum RPM: 2000, trip level: 4.9 A". The brush device 2000 may be excessively pressed against the surface to be cleaned when the state of the surface to be cleaned is the carpet (overload) than when the state of the surface to be cleaned is the carpet (normal load), and thus the cleaner body 1000 may reduce the power consumption of the suction motor 1110 and reduce the drum RPM of the brush device 2000. When the main processor 1800 identifies that the current state of the surface to be cleaned is a carpet (overload), the cordless vacuum cleaner 100 may determine to operate based on the third operating information corresponding to the third operating condition. Accordingly, the main processor 1800 may transmit information about the third operating condition to the first processor 1131, and the first processor 1131 may identify the third operating information corresponding to the third operating condition and adjust the power consumption of the suction motor 1110 to 40 W. Also, the first processor 1131 may transmit, to the second processor 2410, data (00111001) indicating the third operating condition. When the data (00111001) indicating the third operating condition is received, the second processor 2410 may identify the third operating information corresponding to the third operating condition, adjust the drum RPM to 2000 rpm, and set the trip level to 4.9 A.

A fourth operating condition indicates a case where the state of the brush device 2000 is being lifted from the surface to be cleaned, and fourth operating information corresponding to the fourth operating condition may be "power consumption of suction motor 1110: 40 W, drum RPM: 1000, trip level: 4.0 A". In the lifted state, the suction power strength is not required to be high, and thus the cleaner body 1000 may reduce the power consumption of the suction motor 1110 to minimum power consumption (for example, 40 W), and reduce the drum RPM of the brush device 2000 to minimum RPM (1000 rpm). When the main processor 1800 identifies that the current state of the surface to be cleaned is the lifted state, the cordless vacuum cleaner 100 may determine to operate based on the fourth operating information corresponding to the fourth operating condition. Accordingly, the main processor 1800 may transmit information about the fourth operating condition to the first processor 1131, and the first processor 1131 may identify the fourth operating information corresponding to the fourth operating condition and adjust the power consumption of the suction motor 1110 to 40 W. Also, the first processor 1131 may transmit, to the second processor 2410, data (01000111) indicating the fourth operating condition. When the data (01000111) indicating the fourth operating condition is received, the second processor 2410 may identify the fourth operating information corresponding to the fourth operating condition, adjust the drum RPM to 1000 rpm, and set the trip level to 4.0 A.

A fifth operating condition indicates a case where the state of the surface to be cleaned is a mat, and fifth operating information in the fifth operating condition may be "power consumption of suction motor 1110: 58 W, drum RPM: 1000, trip level: 4.9 A". In other words, when the main processor 1800 identifies that the current state of the surface to be cleaned is a mat, the cordless vacuum cleaner 100 may determine to operate based on the fifth operating information corresponding to the fifth operating condition. Accordingly, the main processor 1800 may transmit information about the fifth operating condition to the first processor 1131, and the first processor 1131 may identify the fifth operating information corresponding to the fifth operating condition and adjust the power consumption of the suction motor 1110 to 58 W. Also, the first processor 1131 may transmit, to the second processor 2410, data (01010101) indicating the fifth operating condition. When the data (01010101) indicating the fifth operating condition is received, the second processor 2410 may identify the fifth operating information corresponding to the fifth operating condition, adjust the drum RPM to 1000 rpm, and set the trip level to 4.9 A.

A sixth operating condition indicates a case where an operation of the cordless vacuum cleaner 100 needs to be stopped, and sixth operating information in the sixth operating condition may be "power consumption of suction motor 1110: 58 W, drum RPM: 0, trip level: 0 A". For example, when abnormality of the motor 2100 (hereinafter, also referred to as a brush motor 2100) included in the brush device 2000 is identified, the cleaner body 1000 may determine to stop the operation of the brush motor 2100. The main processor 1800 may identify the abnormality of the brush motor 2100 and stop the operation of the brush motor 2100, or the first processor 1131 may identify the abnormality of the brush motor 2100 and stop the operation of the brush motor 2100. Upon determining to stop the operation of the brush motor 2100, the first processor 1131 may transmit, to the second processor 2410 of the brush device 2000 through the signal line 30, a signal (for example, the data (01100011) indicating the sixth operating condition) for stopping the operation of the brush device 2000 by controlling an on/off operation of the first switching device 1132. Upon receiving the data (01100011) indicating the sixth operating condition, the second processor 2410 may identify the sixth operating information (drum RPM: 0, trip level: 0 A) corresponding to the sixth operating condition and stop the operation of the brush motor 2100.

Hereinafter, an example in which the first processor 1131 of the cleaner body 1000 transmits 8-bit data (01010101) indicating the fifth operating condition (mat) to the second processor 2410 of the brush device 2000 will be described in detail with reference to FIG. 11.

Figure 11:
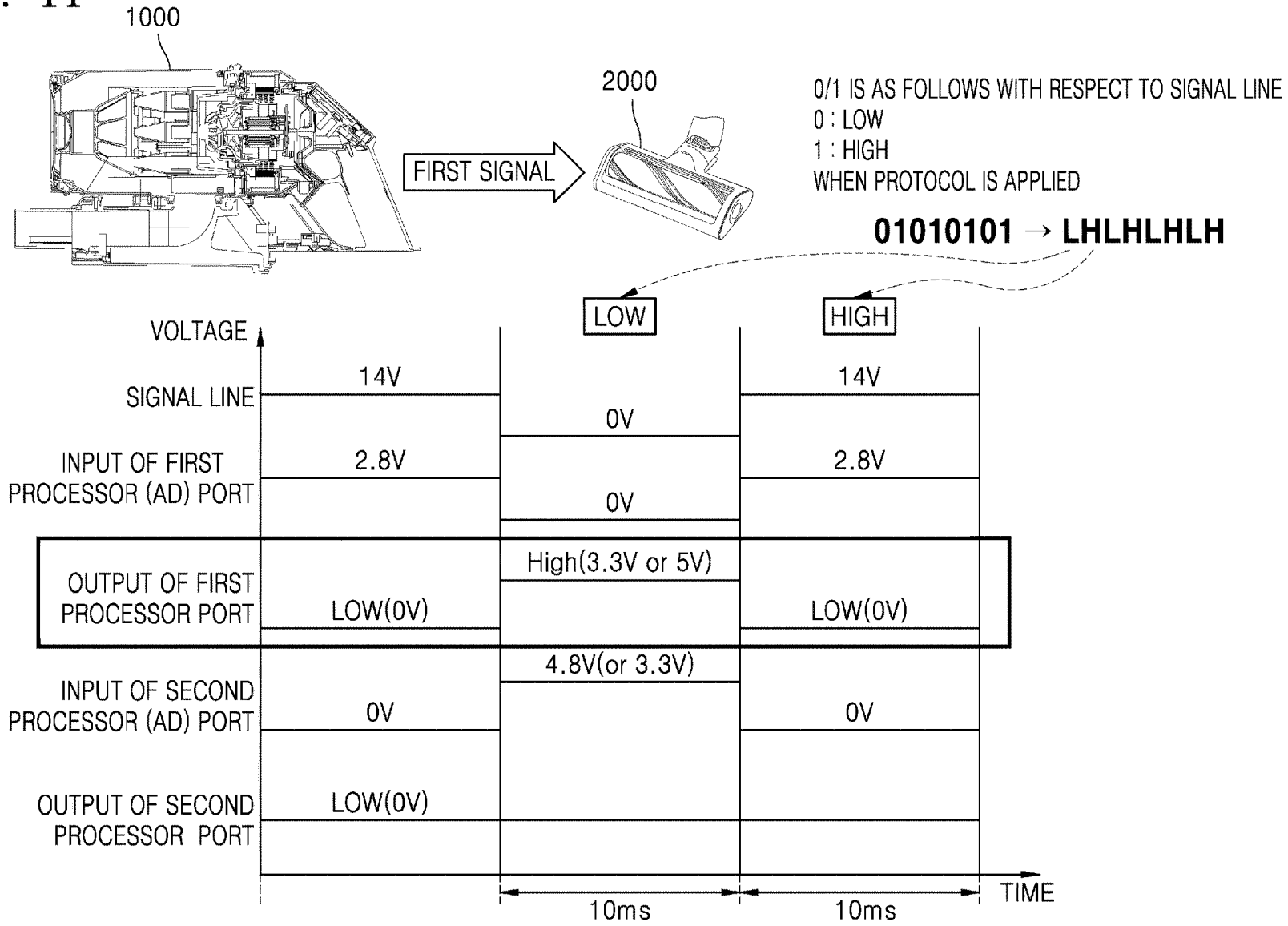
FIG. 11 is a schematic diagram for describing an operation by which a cleaner body transmits a signal to a brush device, according to an embodiment of the disclosure.

FIG. 11 is a schematic diagram for describing an operation by which the cleaner body 1000 transmits a signal to the brush device 2000, according to an embodiment of the disclosure.

In FIG. 11, a case in which the cleaner body 1000 transmits an 8-bit signal (01010101) indicating the fifth operating condition to the brush device 2000 and a transmission time is 10 ms per bit will be described as an example.

According to a communication protocol according to an embodiment of the disclosure, 0 and 1 may be classified based on a state of the signal line 30. For example, 0 may be transmitted when the signal line 30 is in a low state (L), and 1 may be transmitted when the signal line 30 is in a high state (H). Accordingly, the first processor 1131 may turn on the first switching device 1132 such that a voltage of a first level lower than a threshold value is applied to the signal line 30 to transmit code 0, and turn off the first switching device 1132 such that a voltage of a second level higher than the threshold value is applied to the signal line 30 to transmit code 1.

The first processor 1131 may enable the state of the signal line 30 to become LHLHLHLH so as to transmit, to the second processor 2410, 01010101 indicating the fifth operating condition. For example, the first processor 1131 may repeat, four times, operations of turning on the first switching device 1132 by outputting a high signal (5 V or 3.3 V) through the output port for first 10 ms to make the state of the signal line 30 to become low (0 V), and turning off the first switching device 1132 by outputting a low signal (0 V) through the output port for the next 10 ms to make the state of the signal line 30 to become high (14 V). In this case, the first processor 1131 may transmit, to the second processor 2410, 01010101 for 80 ms. While the first processor 1131 transmits a signal, the output port of the second processor 2410 may maintain a low (0 V) state.

Upon receiving the first signal (01010101) indicating the fifth operating condition from the cleaner body 1000, the second processor 2410 may identify, from the lookup table 1010 stored in the memory of the brush device 2000, the fifth operating information (power consumption of suction motor 1110: 58 W, drum RPM: 1000, trip level: 4.9 A) corresponding to the fifth operating condition. Also, the second processor 2410 may adjust the drum RPM to 1000 rpm and set the trip level to 4.9 A. Then, in response to the first signal, the second processor 2410 may transmit, to the first processor 1131, the second signal indicating the current state. For example, since the settings are changed based on the fifth operating information corresponding to the fifth operating condition, the second processor 2410 may transmit, to the first processor 1131, the second signal (for example, 01010101) indicating that the current state corresponds to the fifth operating condition. An operation by which the second processor 2410 transmits the second signal (for example, 01010101) indicating the current state to the first processor 1131 will be described with reference to FIG. 12.

Figure 12:
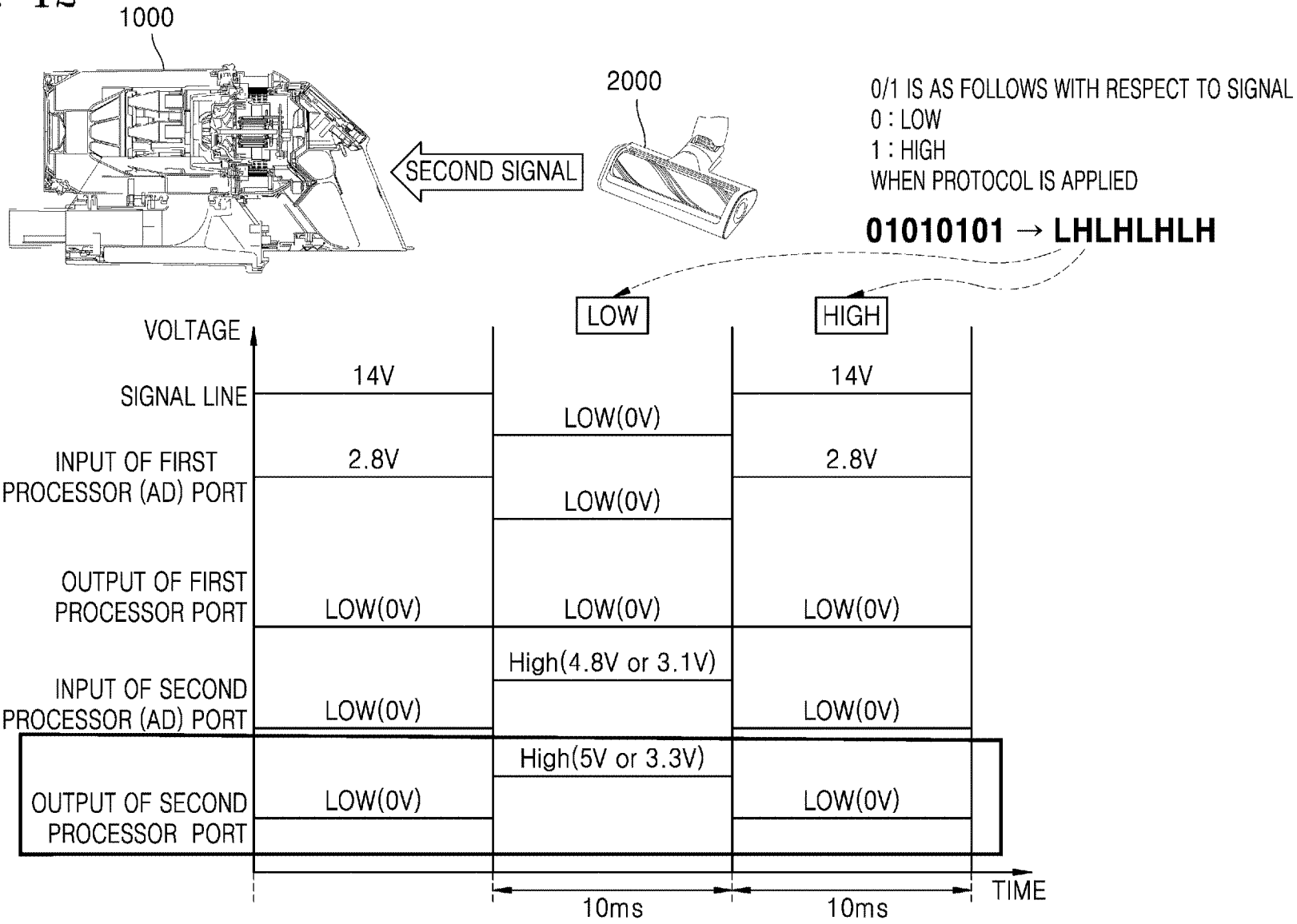
FIG. 12 is a schematic diagram for describing an operation by which a brush device transmits a signal to a cleaner body, according to an embodiment of the disclosure.

FIG. 12 is a schematic diagram for describing an operation by which the brush device 2000 transmits a signal to the cleaner body 1000, according to an embodiment of the disclosure.

In FIG. 12, a case in which the brush device 2000 transmits the second signal (for example, 01010101) indicating that the current state corresponds to the fifth operating condition to the cleaner body 1000, and a transmission time is 10 ms per bit will be described as an example.

According to a communication protocol according to an embodiment of the disclosure, 0 and 1 may be classified based on a state of the signal line 30. For example, 0 may be transmitted when the signal line 30 is in a low state (L), and 1 may be transmitted when the signal line 30 is in a high state (H). Accordingly, the second processor 2410 may turn on the second switching device 2435 such that a voltage of the first level lower than the threshold value is applied to the signal line 30 to transmit code 0, and turn off the second switching device 2435 such that a voltage of the second level higher than the threshold value is applied to the signal line 30 to transmit code 1.

The second processor 2410 may enable the state of the signal line 30 to become LHLHLHLH so as to transmit, to the first processor 1131, the second signal (for example, 01010101) indicating that the current state corresponds to the fifth operating condition. For example, the second processor 2410 may repeat, four times, operations of turning on the second switching device 2435 by outputting a high signal (5 V or 3.3 V) through the output port for first 10 ms to make the state of the signal line 30 to become low (0 V), and turning off the second switching device 2435 by outputting a low signal (0 V) through the output port for next 10 ms to make the state of the signal line 30 to become high (14 V). In this case, the second processor 2410 may transmit, to the second processor 2410, 01010101 for 80 ms. While the second processor 2410 transmits a signal, the output port of the first processor 1131 may maintain a low (0 V) state.

Upon receiving the second signal (for example, 01010101) indicating the fifth operating condition from the second processor 2410 of the brush device 2000, the first processor 1131 may identify the fifth operating information (power consumption of suction motor 1110: 58 W, drum RPM: 1000, trip level: 4.9 A) corresponding to the fifth operating condition, from the lookup table 1010 stored in the memory of the cleaner body 1000. Also, the first processor 1131 may identify that the current drum RPM of the brush device 2000 is 1000 rpm and the current trip level is 4.9 A.

An operation of transmitting and receiving signals between the cleaner body 1000 and the brush device 2000 will be described in more detail with reference to FIG. 13.

Figure 13:
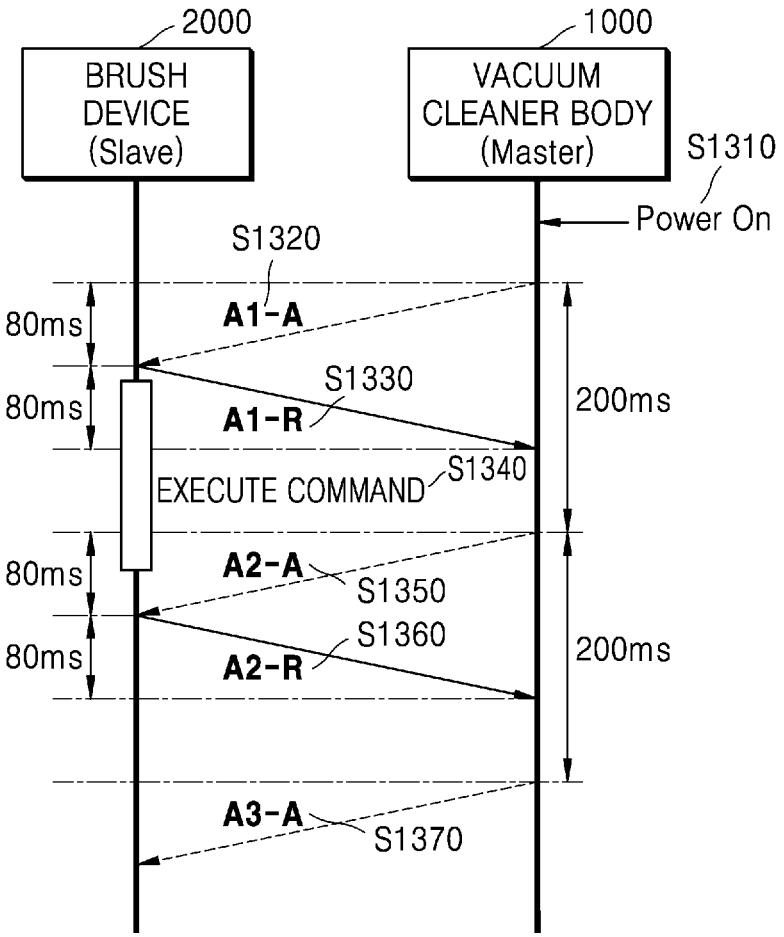
FIG. 13 is a flowchart for describing an operation of transmitting a signal between a cleaner body and a brush device, according to an embodiment of the disclosure.

FIG. 13 is a flowchart for describing an operation of transmitting a signal between the cleaner body 1000 and the brush device 2000, according to an embodiment of the disclosure. In FIG. 13, a case in which the cleaner body 1000 operates as a master device and the brush device 2000 operates as a slave device will be described as an example.

The cleaner body 1000 may receive a user input of turning power on (operation S1310). When cleaner body 1000 is turned on, the cleaner body 1000 may perform communication with the brush device 2000 combined to the cordless vacuum cleaner 100, through the signal line 30. For example, the cleaner body 1000 may transmit an A1 signal A1-A indicating the first operating condition to the brush device 2000 (operation S1320). The A1 signal A1-A may be transmitted for 80 ms. When the brush device 2000 receives the A1 signal A1-A, the brush device 2000 may transmit, to the cleaner body 1000, an A1 response signal A1-R indicating the current state (operation S1330). The A1 response signal A1-R may also be transmitted for 80 ms.

The brush device 2000 may execute an instruction according to the A1 signal A1-A (operation S1340). For example, the brush device 2000 may adjust the drum RPM and the trip level, based on the first operating information corresponding to the first operating condition.

When a certain time has elapsed after the A1 signal A1-A is transmitted, the cleaner body 1000 may transmit an A2 signal A2-A to the brush device 2000 (operation S1350). In FIG. 13, the certain time is 200 ms, but is not limited thereto.

When the usage environment state (for example, hard floor, carpet, mat, corner, or lifted state) of the brush device 2000 does not change from when the A1 signal A1-A is transmitted to when the A2 signal A2-A is transmitted, the A2 signal A2-A may continue to indicate the first operating condition. On the other hand, when the usage environment state of the brush device 2000 changes between the transmission of the A1 signal A1-A and the transmission of the A2 signal A2-A, the A2 signal A2-A may indicate the second operating condition instead of the first operating condition.

When the brush device 2000 receives the A2 signal A2-A, the brush device 2000 may transmit, to the cleaner body 1000, an A2 response signal A2-R indicating the current state (operation S1360). The A2 response signal A2-R may also be transmitted for 80 ms. Here, the A2 response signal A2-R may include an instruction execution result of the brush device 2000. For example, when the brush device 2000 has adjusted the drum RPM and the trip level, based on the first operating information corresponding to the first operating condition, the A2 response signal A2-R may include data indicating the first operating condition (or data indicating the drum RPM and the trip level).

When a certain time (200 ms) has elapsed after the A2 signal A2-A is transmitted, the cleaner body 1000 may transmit an A3 signal A3-A to the brush device 2000 (operation S1370). Upon receiving the A3 signal A3-A, the brush device 2000 may transmit, to the cleaner body 1000, the A3 signal A3-A indicating the current state.

Accordingly, by continuously communicating with the brush device 2000 at certain time intervals (200 ms), the cleaner body 1000 may adaptively control operations of the brush device 2000, according to the usage environment state (for example, hard floor, carpet, mat, corner, or lifted state) of the brush device 2000.

For example, when the user is cleaning a hard floor with the cordless vacuum cleaner 100, the cleaner body 1000 transmits, to the brush device 2000, the data indicating the first operating condition corresponding to the hard floor, and the brush device 2000 may change the drum RPM to 2000 rpm, based on the first operating condition corresponding to the hard floor. While the user cleans the hard floor, the cleaner body 1000 may transmit, to the brush device 2000, the data indicating the first operating condition corresponding to the hard floor every 200 ms, and the brush device 2000 may respond to the cleaner body 1000 with the current state (operating based on the first operating condition corresponding to the hard floor). When the user is cleaning a carpet (normal load) instead of the hard floor, the cleaner body 1000 may transmit, to the brush device 2000, data indicating the second operating condition corresponding to the carpet (normal load), and the brush device 2000 may change the drum RPM to 3800 rpm, based on the second operating condition corresponding to the carpet (normal load). Also, the brush device 2000 may respond to the cleaner body 1000 with the current state (operating based on the second operating condition corresponding to a carpet).

According to an embodiment of the disclosure, when the second signal is not received from the brush device 2000 for a certain time after the first signal is transmitted through the signal line 30, the cleaner body 1000 may determine that communication with the brush device 2000 is not possible. For example, when a response signal (second signal) is not received from the brush device 2000 while the first signal is transmitted to the brush device 2000 three times, the cleaner body 1000 may determine that the communication with the brush device 2000 is not possible.

Upon determining that the communication with the brush device 2000 is not possible, the cleaner body 1000 may switch an operating mode from an AI mode to a normal mode. The AI mode may be a mode in which the suction power strength of the suction motor 1110 or the drum RPM of the brush device 2000 is automatically adjusted according to the usage environment state of the brush device 2000, and the normal mode may be a mode in which the suction power strength of the suction motor 1110 is manually adjusted by the user. When the communication with the brush device 2000 is not possible, the cleaner body 1000 is unable to transmit, to the brush device 2000, data to adjust the drum RPM of the brush device 2000, and thus may be unable to operate in the AI mode.

When it is determined that the communication with the brush device 2000 is not possible, the cleaner body 1000 may output, through an output interface, a notification indicating that an operation in the AI mode is not possible. An operation by which the cleaner body 1000 outputs the notification will be described in detail below with reference to FIG. 26.

Figure 14:
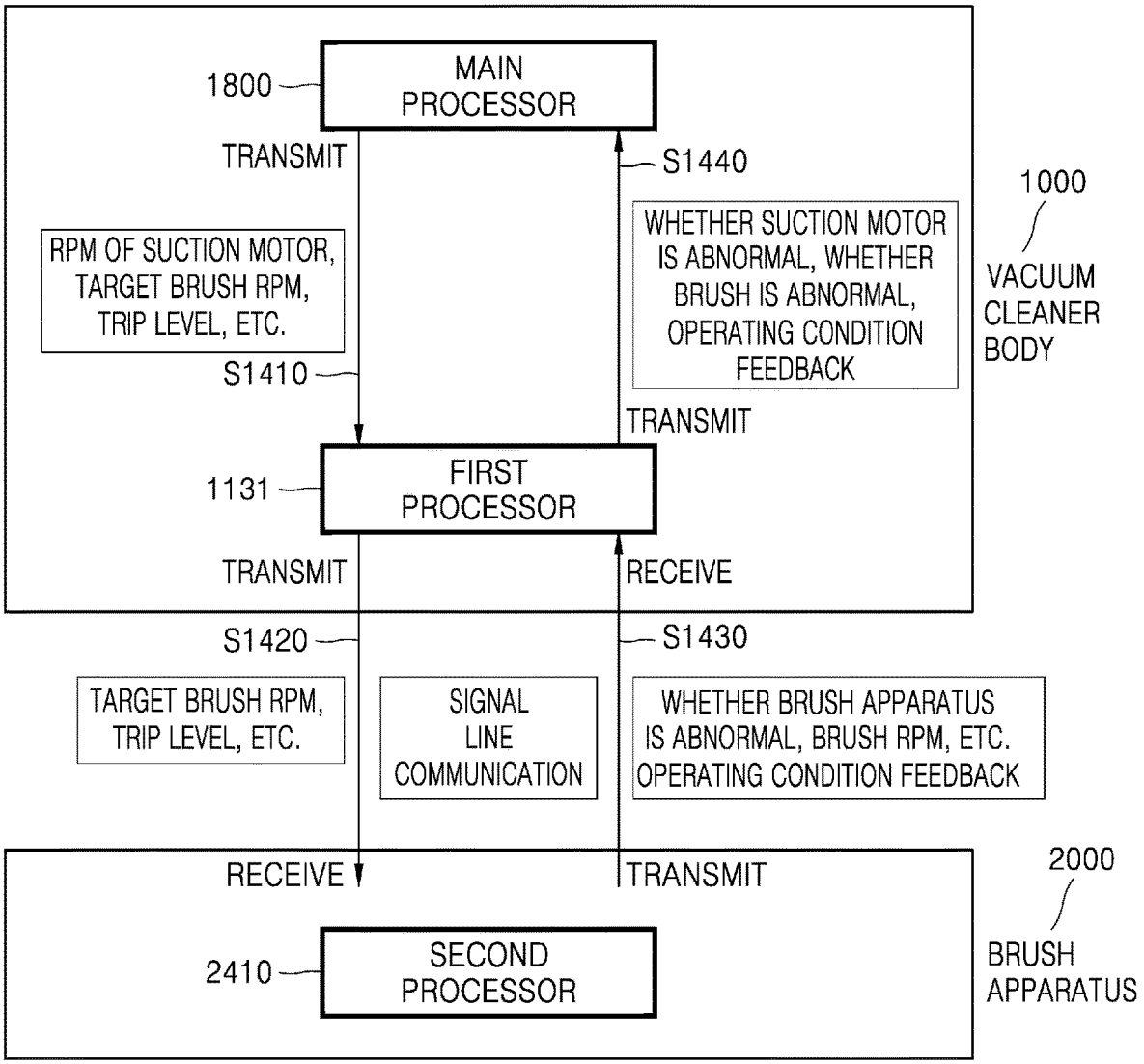
FIG. 14 is a flow diagram for describing an operation by which a main processor communicates with a second processor through a first processor, according to an embodiment of the disclosure.

Meanwhile, the first processor 1131 may transmit data to the second processor 2410 according to an instruction of the main processor 1800, or transmit data received from the second processor 2410 to the main processor 1800. FIG. 14 may be referenced.

FIG. 14 is a flow diagram for describing an operation by which the main processor 1800 communicates with the second processor 2410 through the first processor 1131, according to an embodiment of the disclosure.

Referring to FIG. 14, the main processor 1800 may determine, by using a pre-stored algorithm, the RPM (power consumption or suction power strength) of the suction motor 1110, the target RPM of the drum 2200 of the brush device 2000, and the trip level. The main processor 1800 may determine the RPM of the suction motor 1110, based on a suction strength adjustment input of the user through the user interface 1700.

In operation S1410, the main processor 1800 may transmit data including the RPM (power consumption or suction power strength) of the suction motor 1110, the target RPM of the drum 2200 of the brush device 2000, and the target trip level to the first processor 1131. For example, the main processor 1800 may transmit the data to the first processor 1131 by using the UART, but is not limited thereto.

In operation S1420, the first processor 1131 may transmit data related to control of the brush device 2000 from among data received from the main processor 1800 to the second processor 2410 through the signal line communication. For example, the first processor 1131 may transmit data including the target RPM of the drum 2200 and the target trip level to the second processor 2410. Here, the first processor 1131 may transmit data indicating an operating condition corresponding to the target RPM and target trip level to the second processor 2410 (see FIG. 10).

When the data related to the control is received from the first processor 1131, the second processor 2410 may control operations of the brush device 2000. For example, the second processor 2410 may change the RPM of the drum 2200 to the target RPM or change the trip level to the target trip level.

In operation S1430, when the data related to the control is received from the first processor 1131, the second processor 2410 may transmit operating state feedback data to the first processor 1131 through the signal line communication. The operating state feedback data may include whether there is an abnormality in the brush device 2000, the current RPM of the drum 2200, and the like, but is not limited thereto.

In operation S1440, when the operating state feedback data is received from the second processor 2410, the first processor 1131 may transmit the operating state feedback data of the second processor 2410 to the main processor 1800. The first processor 1131 may transmit the operating state feedback data of the second processor 2410 to the main processor 1800 through the UART. In addition to the operating state feedback data of the second processor 2410, the first processor 1131 may further transmit data including whether there is an abnormality in the suction motor 1110, the suction power strength of the suction motor 1110, the load of the brush device 2000, and the type of the brush device 2000 to the main processor 1800.

The main processor 1800 may determine an operating state of the suction motor 1110 and an operating state of the brush device 2000, based on the data received from the first processor 1131. Then, the main processor 1800 may monitor the usage environment state of the brush device 2000 and continuously control operations of the brush device 2000 according to the usage environment state of the brush device 2000. For example, operations S1410 through S1440 are repeatedly performed such that the first processor 1131 transmits a control command of the main processor 1800 to the second processor 2410.

Hereinafter, a method by which the main processor 1800 of the cleaner body 1000 controls operations of the brush device 2000 according to the usage environment state of the brush device 2000 will be described in detail with reference to FIG. 15.

Figure 15:
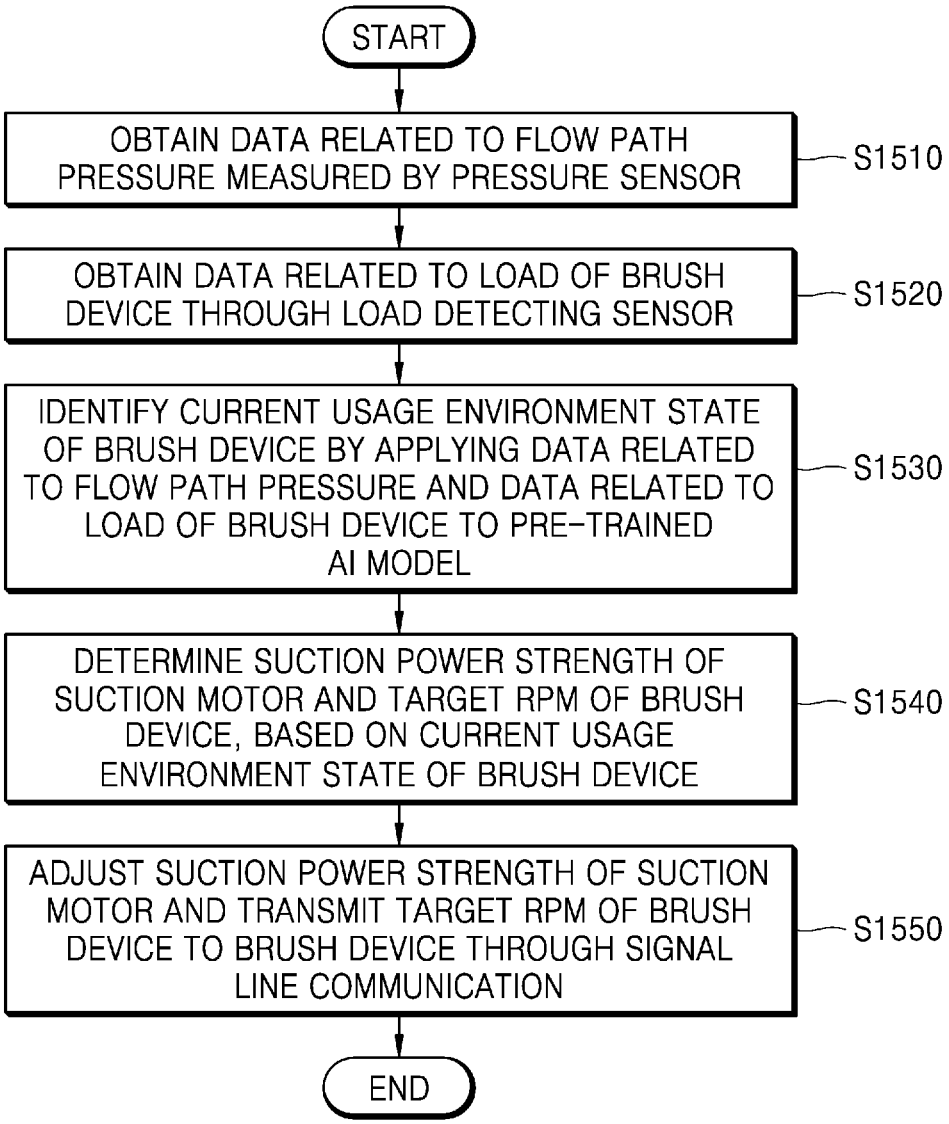
FIG. 15 is a flowchart of a method by which a cleaner body adaptively controls an operation of a brush device according to a usage environment state of the brush device, according to an embodiment of the disclosure.

FIG. 15 is a flowchart of a method by which the cleaner body 1000 adaptively controls an operation of the brush device 2000 according to the usage environment state of the brush device 2000, according to an embodiment of the disclosure.

In operation S1510, the cleaner body 1000 may obtain data related to flow path pressure measured by the pressure sensor 1400.

The main processor 1800 of the cleaner body 1000 may obtain a pressure value measured by the pressure sensor 1400 from the pressure sensor 1400 through I2C communication. The pressure sensor 1400 may be located inside a flow path and measure pressure inside the flow path (flow path pressure). For example, the pressure sensor 1400 may be located inside the suction duct 40 or motor assembly 1100, but is not limited thereto.

The pressure sensor 1400 may be an absolute pressure sensor or a relative pressure sensor. When the pressure sensor 1400 is an absolute pressure sensor, the main processor 1800 may use the pressure sensor 1400 to sense a first pressure value before the suction motor 1110 is operated and a second pressure value after the suction motor 1110 is operated at a target RPM, and use a difference between the first pressure value and the second pressure value as the pressure value inside the flow path. When the difference between the first pressure value and the second pressure value is used as the pressure value inside the flow path, internal/external influences other than the suction motor 1110 may be reduced.

In operation S1520, the cleaner body 1000 may obtain data related to a load of the brush device 2000 through the load detecting sensor 1134.

According to an embodiment of the disclosure, the load detecting sensor 1134 may be located inside the PCB 1130 of the motor assembly 1100 and include a shunt resistor, a current detecting circuit, and a load detecting circuit, but is not limited thereto. The cleaner body 1000 may receive the data related to the load of the brush device 2000 from the first processor 1131 inside the motor assembly 1100.

According to an embodiment of the disclosure, the data related to the load of the brush device 2000 may include at least one of an operating current of the brush device 2000, a voltage applied to the brush device 2000, or power consumption of the brush device 2000, but is not limited thereto. The power consumption of the brush device 2000 may be power consumption of the motor 2100, and calculated by multiplying the operating current of the brush device 2000 and the voltage applied to the brush device 2000. When the brush device 2000 includes the lighting device 2300 (for example, an LED display), the load of the brush device 2000 may be calculated by adding a load of the motor 2100 and a load of the lighting device 2300.

In operation S1530, the cleaner body 1000 may identify a current usage environment state of the brush device 2000 by applying the data related to the flow path pressure and the data related to the load of the brush device 2000 to a pre-trained AI model.

According to an embodiment of the disclosure, the AI model may be a machine learning algorithm trained to infer a usage environment state of the brush device 2000. The AI model may be trained or renewed (refined) by an external device (for example, a server device or an external computing device), or may be trained or renewed (refined) by the cleaner body 1000. For example, the cleaner body 1000 may receive the trained AI model from the external device and store the same in the memory, or at least one processor of the cleaner body 1000 may create the AI model for inferring the usage environment state of the brush device 2000 through learning.

This means that predefined operation rules or an AI model configured to perform desired characteristics (or purposes) are generated by training a basic AI model by using a plurality of pieces of training data via a learning algorithm. The AI model may include a plurality of neural network layers. Each of the neural network layers includes a plurality of weight values, and performs a neural network arithmetic operation via an arithmetic operation between an arithmetic operation result of a previous layer and the plurality of weight values.

Inference and prediction are a technology for logically inferring and predicting information by determining the information, and includes knowledge (probability)-based reasoning, optimization prediction, preference-based planning, and recommendation.

According to an embodiment of the disclosure, the AI model may include at least one of an SVM model, a neural network model, a random forest model, or a graphical model, but is not limited thereto.

The SVM model may be an algorithm that generates a hyper plane of a maximum margin, which may classify data in a stereoscopic space by using a kernel function. The random forest model may be an ensemble algorithm for training a plurality of decision-making trees and making prediction by combining results of the plurality of decision-making trees. The neural network model may be an algorithm that derives an output by combining a conversion function and a weight for each input value. The graphical model may be an algorithm for representing independency between probability variables in a graph. Here, the probability variable is represented as a node, and conditional independency between the probability values may be represented as an edge.

The SVM model has relatively high accuracy and a fast response speed, and thus operations of the cordless vacuum cleaner 100 may be quickly switched to an optimum specification. Thus, a case where the AI model is the SVM model will be mainly described as an example.

According to an embodiment of the disclosure, the usage environment state of the brush device 2000 may be related to an environment in which the brush device 2000 is being used during cleaning. For example, the usage environment state of the brush device 2000 may include at least one of a state of a surface to be cleaned where the brush device 2000 is located, a relative location state of the brush device 2000 in the surface to be cleaned, or a state of the brush device 2000 being lifted from the surface to be cleaned, but is not limited thereto. Here, the surface to be cleaned may denote a surface of a floor, bed, or sofa, which contacts the brush device 2000. The state of the surface to be cleaned may denote a material of the surface to be cleaned, for example, a hard floor, a normal carpet (normal load), a high-density carpet (overload), or a mat. The relative location state may include a floor center, a floor side surface (wall), or a corner, but is not limited thereto. Hereinafter, for convenience of descriptions, a mat state, a hard floor state, a carpet state, and a lifted state from among various usage environment state will be described as examples.

According to an embodiment of the disclosure, the main processor 1800 of the cleaner body 1000 may input, to a pre-stored AI model, the data related to the flow path pressure obtained from the pressure sensor 1400 and the data related to the load of the brush device 2000 obtained from the first processor 1131, and obtain the current usage environment state of the brush device 2000 as an inference result of the AI model.

According to an embodiment of the disclosure, the AI model for inferring the usage environment state of the brush device 2000 may vary depending on a type of the brush device 2000. Accordingly, the cleaner body 1000 may store, in the memory, a plurality of AI models according to types of brush device 2000, select an AI model corresponding to a type of the brush device 2000 after the type of the brush device 2000 is identified, and identify the current usage environment state of the brush device 2000. The main processor 1800 of the cleaner body 1000 may select a first AI model corresponding to a first type of the brush device 2000 from among the plurality of AI models, and identify the current usage environment state of the brush device 2000 by applying, to the selected first AI model, the data related to the flow path pressure and the data related to the load of the brush device 2000. For example, when the brush device 2000 is the multi-brush 401, the main processor 1800 may select an AI model corresponding to the multi-brush 401, and identify the current usage environment state of the multi-brush 401 by applying, to the selected AI model, the data related to the flow path pressure and the data related to the load of the multi-brush 401.

According to an embodiment of the disclosure, a value of the load of the brush device 2000, which is used as an input value of the AI model, may vary depending on a type of the brush device 2000. For example, when the brush device 2000 is the hard floor brush 402, the main processor 1800 may input operating current data of the hard floor brush 402 to an AI model corresponding to the hard floor brush 402. On the other hand, when the brush device 2000 is the multi-brush 401, power consumption (or an operating current or applied voltage) of the multi-brush 401 may be input to an AI model corresponding to the multi-brush 401.

According to an embodiment of the disclosure, a parameter value of an AI model may vary according to suction power strength of the suction motor 1110. Accordingly, the main processor 1800 of the cleaner body 1000 may modify the parameter value of the AI model by applying the suction power strength of the suction motor 1110 before inputting, to the AI model, the data related to the flow path pressure and the data related to the load of the brush device 2000. Also, the main processor 1800 may identify the current usage environment state of the brush device 2000 by applying, to the AI model in which the parameter value has been modified, the data related to the flow path pressure and the data related to the load of the brush device 2000.

In operation S1540, the cleaner body 1000 may determine the suction power strength of the suction motor 1110 and the target RPM of the brush device 2000, based on the current usage environment state of the brush device 2000.

The suction power is electric power (input power) consumed to operate the cordless vacuum cleaner 100, and the suction power strength of the suction motor 1110 may be referred to as the power consumption of the suction motor 1110.

According to an embodiment of the disclosure, when the current usage environment state of the brush device 2000 is a state of cleaning a hard floor, the cleaner body 1000 may determine the suction power strength of the suction motor 1110 to first strength that is medium strength, and determine the target RPM of the brush device 2000 to a medium level. For example, the cleaner body 1000 may determine the power consumption of the suction motor 1110 to 75 W and the target RPM of the brush device 2000 to 2000 rpm.

When the current usage environment state of the brush device 2000 is a state of cleaning a mat (or a high-density carpet), the cleaner body 1000 may determine the suction power strength of the suction motor 1110 to second strength that is lower than the first strength. When the user is cleaning the mat or high-density carpet, the brush device 2000 is over-pressed against the surface to be cleaned, and thus it is difficult to move the cordless vacuum cleaner 100. Accordingly, the cleaner body 1000 may determine the suction power strength to be lower when cleaning the mat or high-density carpet than when cleaning the hard floor. For example, the cleaner body 1000 may determine the power consumption of the suction motor 1110 to 58 W. Also, when the current usage environment state of the brush device 2000 is a state of cleaning the mat, the cleaner body 1000 may determine the target RPM of the brush device 2000 to be lowest (for example, 1000 rpm). According to an embodiment of the disclosure, the cleaner body 1000 may enhance convenience of use of the user by automatically reducing the suction power strength of the suction motor 1110 and the RPM of the brush device 2000 when the user moves the brush device 2000 onto the mat.

When the current usage environment state of the brush device 2000 is a state of cleaning a normal carpet, the cleaner body 1000 may determine the suction power strength of the suction motor 1110 to third strength that is higher than the first strength. Greater suction power may be required to suck up dust or foreign materials from the normal carpet than the hard floor. Accordingly, the cleaner body 1000 may determine the suction power strength to be higher when cleaning the normal carpet than the hard floor, and also determine the target RPM of the brush device 2000 to be higher. For example, the cleaner body 1000 may determine the power consumption of the suction motor 1110 to 115 W and the target RPM of the brush device 2000 to 3800 rpm. According to an embodiment of the disclosure, the cleaner body 1000 may enhance cleaning performance on a carpet by automatically increasing the suction power strength of the suction motor 1110 and the RPM of the brush device 2000 when the user moves the brush device 2000 onto the carpet.

According to an embodiment of the disclosure, when the current usage environment state of the brush device 2000 is a state of being lifted from a surface to be cleaned by a certain distance or greater (hereinafter, referred to as a lifted state), the cleaner body 1000 may determine the suction power strength of the suction motor 1110 to minimum strength, and determine the target RPM of the brush device 2000 to be lowest. For example, the cleaner body 1000 may determine the power consumption of the suction motor 1110 to 58 W and the target RPM of the brush device 2000 to 1000 rpm. When the brush device 2000 is in the lifted state (or an idle state), the cleaner body 1000 may reduce the power consumption of the suction motor 1110 and the RPM of the brush device 2000 to reduce unnecessary power consumption, and thus hours of use of the battery 1500 may also be extended.

Meanwhile, according to an embodiment of the disclosure, when the current usage environment state of the brush device 2000 is a state of cleaning a wall corner, the cleaner body 1000 may determine the suction power strength of the suction motor 1110 to maximum strength. For example, the cleaner body 1000 may determine the power consumption of the suction motor 1110 to 200 W. Accordingly, when the user cleans the wall corner, the cleaner body 1000 may automatically increase the suction power strength of the suction motor 1110, thereby enhancing cleaning performance at the wall corner.

In operation S1550, the cleaner body 1000 may adjust the suction power strength of the suction motor 1110 and transmit the target RPM of the brush device 2000 to the brush device 2000 through the signal line communication.

According to an embodiment of the disclosure, the main processor 1800 may transmit, to the first processor 1131, the determined suction power strength and the target RPM of the brush device 2000. Here, the first processor 1131 may adjust the suction power strength of the suction motor 1110 to the determined suction power strength. Also, the first processor 1131 may control operations of the first switching device 1132 connected to the signal line 30 to transmit the target RPM of the brush device 2000 to the second processor 2410. Operations by which the first processor 1131 transmits a signal to the second processor 2410 have been described in detail above, and thus redundant descriptions are omitted. Upon receiving the target RPM of the brush device 2000 from the cleaner body 1000, the second processor 2410 may adjust the drum RPM of the brush device 2000 to the target RPM.

The cordless vacuum cleaner 100 according to an embodiment of the disclosure uses the AI model to identify the current usage environment state of the brush device 2000 and automatically adjust the suction power strength of the suction motor 1110 and the RPM of the brush device 2000 according to the usage environment state of the brush device 2000, and thus the user does not need to change a brush according to a floor state during cleaning, the hours of use of the battery 1500 may be extended, and cleaning performance and efficiency may also increase.

Hereinafter, the SVM model will be described as an example of the AI model for inferring the usage environment state of the brush device 2000, with reference to FIG. 16.

Figure 16:
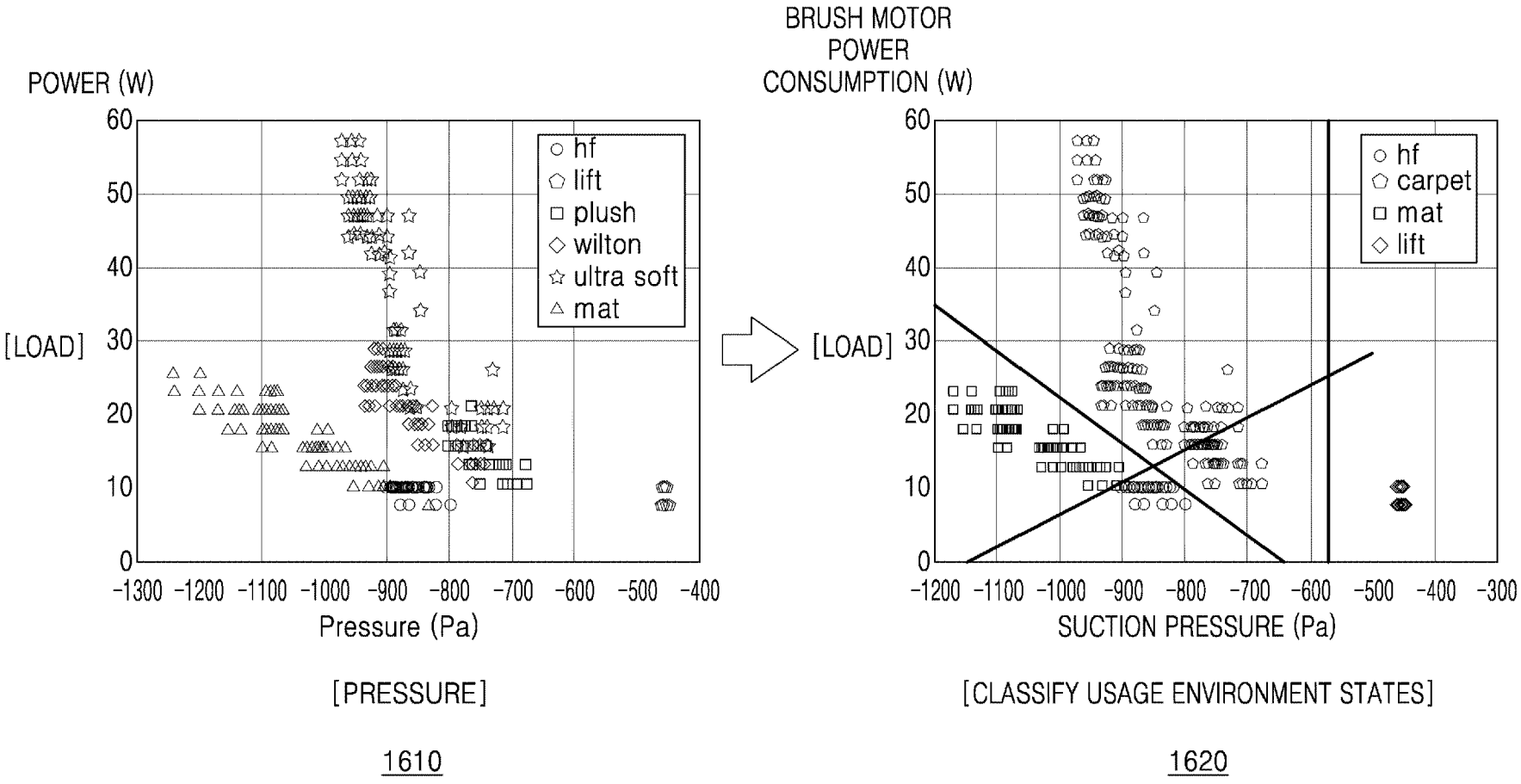
FIG. 16 is a graphical illustration describing a support vector machine (SVM) model for inferring a usage environment state of a brush device, according to an embodiment of the disclosure.

FIG. 16 is a graphical illustration for describing the SVM model for inferring the usage environment state of a brush device 2000, according to an embodiment of the disclosure.

Referring to a reference numeral 1610 of FIG. 16, the SVM model may be generated through supervised learning. The SVM model is a model configured to learn training data with labels, and then determine to which group, from among learned groups, newly input data belongs. According to an embodiment of the disclosure, the SVM model may be trained by using, as the training data, a load value of the brush device 2000 and a pressure value of the suction motor 1110, in a specific usage environment state.

For example, a first flow path pressure value and a first load value of the brush device 2000 obtained when a hard floor is cleaned, a second flow path pressure value and a second load value of the brush device 2000 obtained when a carpet is cleaned, a third flow path pressure value and a third load value of the brush device 2000 when a mat is cleaned, and a fourth flow path pressure value and a fourth load value of the brush device 2000 when the brush device 2000 is lifted from a floor, may be used as the training data. Also, the SVM model may be trained by using, as a label (ground-truth), a usage environment state (for example, a hard floor, a carpet, a mat, or a lifted state) when the load value of the brush device 2000 and the flow path pressure value are obtained.

The SVM model may be trained by an external device (for example, a server device or an external computing device) or by the cleaner body 1000.

Referring to a reference numeral 1620 of FIG. 16, the trained SVM model may be configured as at least one hyper plane for classifying usage environment states. For example, the SVM model for predicting a usage environment state may be configured as a hyper plane for classifying a hard floor and a carpet, and a hyper plane for classifying a hard floor and a mat, and a hyper plane for classifying a carpet and a lifted state. Each hyper plane may be represented by a linear equation ($y=ax+b$). In the linear equation, a and b may be parameters, and the parameter may be modified according to the suction power strength of the suction motor 1110, the type of the brush device 2000, and the state (for example, a dust amount) of the cordless vacuum cleaner 100. An equation of the hyper plane may be a higher order equation (for example, $y=ax^2+b$, $y=ax^3+b$).

In FIG. 16, the SVM model is described as an example of an AI model for inferring the usage environment state of the brush device 2000, but the AI model is not limited thereto. The cleaner body 1000 may receive, from an external source, or learn various types of AI models.

A function related to AI according to the disclosure operates through a processor and a memory. The processor may be configured as one or more processors. In this case, the one or more processors may be a general-purpose processor such as a central processing unit (CPU), an application processor (AP), or a digital signal processor (DSP), a dedicated graphics processor such as a graphics processing unit (GPU) or a vision processing unit (VPU), or a dedicated AI processor such as a neural processing unit (NPU). The one or more processors may control input data to be processed according to predefined operation rules or an AI model stored in a memory. Alternatively, when the one or more processors are a dedicated AI processor, the dedicated AI processor may be designed with a hardware structure specialized for processing a specific AI model.

The predefined operation rules or AI model may be generated via training. This means that the predefined operation rules or AI model set to perform desired characteristics (or purposes) are generated by training a basic AI model with a learning algorithm that utilizes a large number of training data. The training may be performed by a device itself (for example, the cleaner body 1000) where A1 according to the disclosure is being performed, or performed through a separate server and/or system. Examples of the learning algorithm may include supervised learning, unsupervised learning, semi-supervised learning, and reinforcement learning, but are not limited thereto.

The AI model may include a plurality of neural network layers. Each of the neural network layers includes a plurality of weight values, and performs a neural network arithmetic operation via an arithmetic operation between an arithmetic operation result of a previous layer and the plurality of weight values. A plurality of weight values in each of the neural network layers may be optimized by a result of training the AI model. For example, the plurality of weight values may be updated to reduce or minimize a loss or cost value obtained by the AI model during the training. An artificial neural network may include, for example, a convolutional neural network (CNN), a DNN, a recurrent neural network (RNN), a restricted Boltzmann machine (RBM), a deep belief network (DBN), a bidirectional recurrent DNN (BRDNN), or deep Q-networks (DQN), but is not limited thereto.

Figure 17:
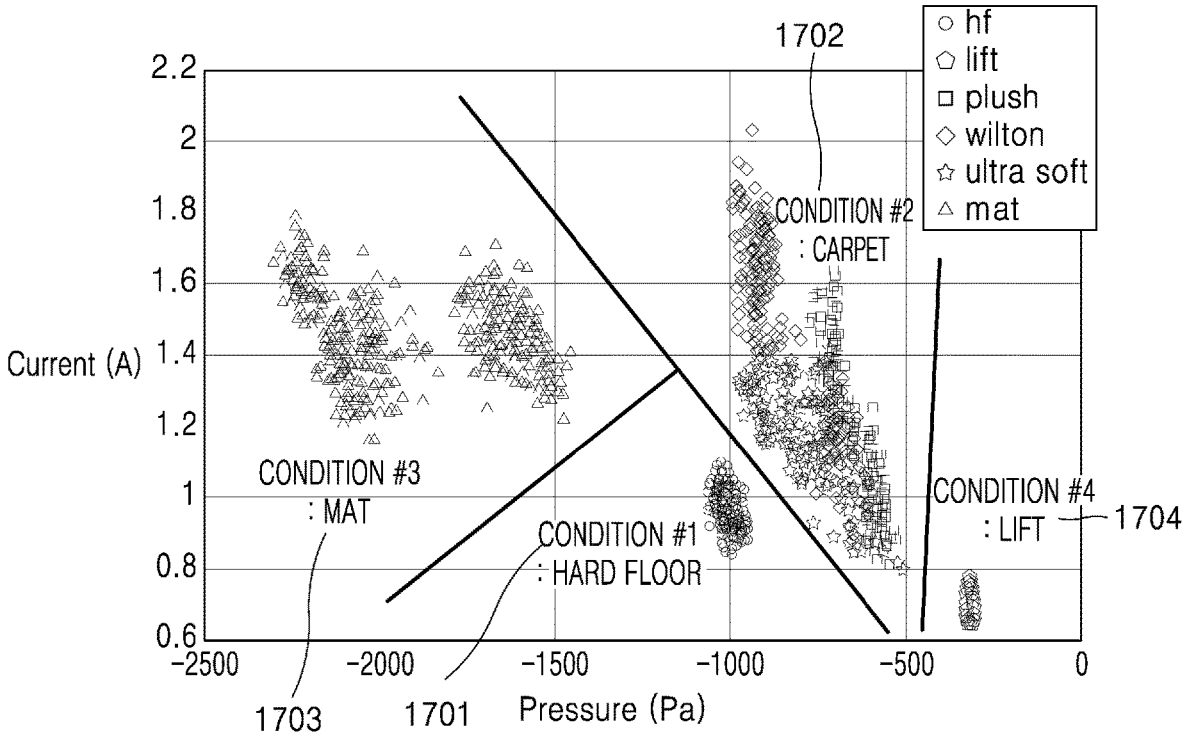
FIG. 17 is a graphical illustration describing an operation by which a cleaner body identifies a usage environment state of a brush device by using an SVM model, according to an embodiment of the disclosure.

FIG. 17 is a graphical illustration for describing an operation by which the cleaner body 1000 identifies the usage environment state of the brush device 2000 by using the SVM model, according to an embodiment of the disclosure.

In FIG. 17, a case, in which the usage environment states of the brush device 2000 are classified into four, i.e., a hard floor (hf) 1701, a carpet 1702, a mat 1703, and a lifted state 1704, will be described as an example.

When the hard floor 1701 is cleaned, the flow path pressure and the load of the brush device 2000 are normal, but when the mat 1703 is cleaned, the flow path pressure and the load of the brush device 2000 may greatly increase. When the carpet 1702 is cleaned, the flow path pressure may be normal but the load of the brush device 2000 may greatly increase. When the brush device 2000 is in the lifted state 1704, the flow path pressure and the load of the brush device 2000 may greatly decrease. Accordingly, the SVM model may output the hard floor 1701 as the usage environment state of the brush device 2000 when a normal flow path pressure value and a normal load value are applied, output the mat 1703 as the usage environment state of the brush device 2000 when a high flow path pressure value and a high load value are applied, output the carpet 1702 as the usage environment state of the brush device 2000 when a normal flow path pressure value and a high load value are applied, and output the lifted state 1704 as the usage environment state of the brush device 2000 when a low flow path pressure value and a low load value are applied. Here, the hard floor 1701 may be mapped to the first operating condition, the carpet 1702 may be mapped to the second operating condition, the mat 1703 may be mapped to the third operating condition, and the lifted state 1704 may be mapped to the fourth operating condition.

According to an embodiment of the disclosure, the main processor 1800 may control operations of the suction motor 1110 and brush device 2000, according to the usage environment state of the brush device 2000, identified through the SVM model. For example, when the usage environment state of the brush device 2000 is identified as the hard floor 1701, the main processor 1800 may control the suction motor 1110 and the brush device 2000 to operate based on the first operating information corresponding to the first operating condition (the hard floor 1701).

Hereinafter, operations of controlling the suction motor 1110 or brush device 2000 according to the usage environment state of the brush device 2000, inferred by the SVM model, will be described in more detail with reference to FIG. 18.

FIG. 18 is a table for describing operation information of the cordless vacuum cleaner 100 according to the usage environment state of the brush device 2000, according to an embodiment of the disclosure.

Referring to FIG. 18, the cordless vacuum cleaner 100 may include a normal mode 1801 and an AI mode 1802. According to an embodiment of the disclosure, the user may select an operating mode of the cordless vacuum cleaner 100 from among the normal mode 1801 and the AI mode 1802.

The normal mode 1801 is a mode in which the power consumption of the suction motor 1110 or the RPM of the brush device 2000 are not changed according to the usage environment state of the brush device 2000. For example, in the normal mode 1801, when the user has adjusted the suction power strength to "strong", the power consumption of the suction motor 1110 may maintain 115 W and the drum RPM of the brush device 2000 may maintain 3800 rpm, even when the usage environment state of the brush device 2000 is changed.

The AI mode 1802 may be a mode in which the power consumption of the suction motor 1110 and the RPM of the brush device 2000 are adaptively changed according to the usage environment state of the brush device 2000, even when the user does not change the suction power strength. For example, when the user has selected the AI mode 1802 through the user interface 1700, the cleaner body 1000 may identify the usage environment state of the brush device 2000 by applying the flow path pressure value and the load value of the brush device 2000 to the AI model, and adjust the suction power strength of the suction motor 1110 and the drum RPM of the brush device 2000 according to the usage environment state of the brush device 2000.

In FIG. 18, a case in which a hard floor is defined as the first operating condition, a normal carpet (normal load) is defined as the second operating condition, a high-density carpet (overload) is defined as the third operating condition, a mat is defined as the fourth operating condition, a lifted state (moved) is defined as the fifth operating condition, and a stop state is defined as the sixth operating condition will be described as an example.

In the AI mode 1802, when it is identified that the brush device 2000 is located on the hard floor, the cordless vacuum cleaner 100 may adjust the power consumption of the suction motor 1110 to 75 W, the drum RPM to 2000 rpm, and the trip level to 4.0 A, based on the first operating information corresponding to the first operating condition. In the AI mode 1802, when it is identified that the brush device 2000 is located on the normal carpet (normal load), the cordless vacuum cleaner 100 may adjust the power consumption of the suction motor 1110 to 115 W, the drum RPM to 3800 rpm, and the trip level to 5.0 A, based on the second operating information corresponding to the second operating condition. In the AI mode 1802, when it is identified that the brush device 2000 is located on the high-density carpet (overload), the cordless vacuum cleaner 100 may adjust the power consumption of the suction motor 1110 to 58 W, the drum RPM to 2000 rpm, and the trip level to 7.0 A, based on the third operating information corresponding to the third operating condition. In the AI mode 1802, when it is identified that the brush device 2000 is located on the mat, the cordless vacuum cleaner 100 may adjust the power consumption of the suction motor 1110 to 58 W, the drum RPM to 1000 rpm, and the trip level to 4.0 A, based on the fourth operating information corresponding to the fourth operating condition. In the AI mode 1802, when it is identified that the brush device 2000 is lifted from a floor and moving, the cordless vacuum cleaner 100 may adjust the power consumption of the suction motor 1110 to 58 W, the drum RPM to 1000 rpm, and the trip level to 3.0 A, based on the fifth operating information corresponding to the fifth operating condition. In the AI mode 1802, when it is identified that the brush device 2000 needs to be stopped, the cordless vacuum cleaner 100 may adjust the power consumption of the suction motor 1110 to 58 W, the drum RPM to 0 rpm, and the trip level to 0 A, based on the sixth operating information corresponding to the sixth operating condition.

Accordingly, compared to the normal mode 1801, the drum RPM of the brush device 2000 and the suction power strength of the suction motor 1110 are suitably adjusted in the AI mode 1802 according to the usage environment state of the brush device 2000, and thus the hours of use of the battery 1500 may be increased, and cleaning efficiency and user convenience may be increased.

Figure 19:
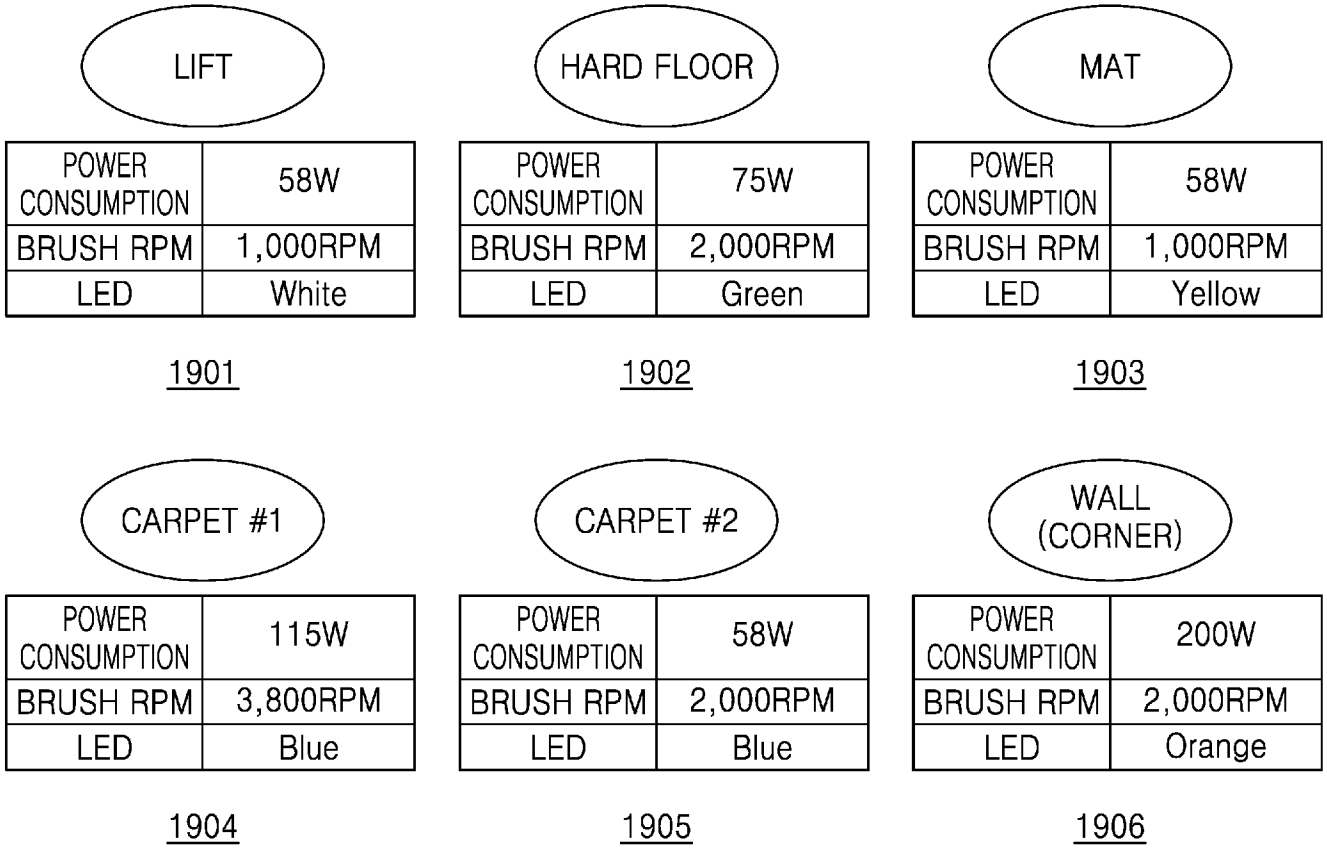
FIG. 19 is a collection of graphical diagrams for describing an operation of controlling a lighting device according to a usage environment state of a brush device, according to an embodiment of the disclosure.

FIG. 19 is a collection of graphical diagrams for describing an operation of controlling the lighting device 2300 according to the usage environment state of the brush device 2000, according to an embodiment of the disclosure.

According to an embodiment of the disclosure, the cleaner body 1000 may determine lighting brightness and lighting color of the brush device 2000, in addition to the power consumption of the suction motor 1110 and the drum RPM of the brush device 2000, according to the usage environment state (for example, a hard floor, a mat, a normal carpet, a high-density carpet, lifted, or a wall corner) of the brush device 2000.

Also, the cleaner body 1000 may transmit data related to the determined lighting brightness or the determined lighting color to the second processor 2410 of the brush device 2000 through the signal line communication. Here, the second processor 2410 of the brush device 2000 may control the lighting device 2300, based on the lighting brightness or lighting color determined by the cleaner body 1000.

For example, when the usage environment state of the brush device 2000 is lifted 1901, the cleaner body 1000 may determine a color of the lighting device 2300 to white, and the lighting device 2300 may output white light according to control by the cleaner body 1000. Also, when the usage environment state of the brush device 2000 is a hard floor 1902, the cleaner body 1000 may determine the color of the lighting device 2300 to green, when the usage environment state of the brush device 2000 is a mat 1903, the cleaner body 1000 may determine the color of the lighting device 2300 to yellow, when the usage environment state of the brush device 2000 is a carpet 1904 or 1905, the cleaner body 1000 may determine the color of the lighting device 2300 to blue, and when the usage environment state of the brush device 2000 is a wall (corner) 1906, the cleaner body 1000 may determine the color of the lighting device 2300 to orange.

According to an embodiment of the disclosure, the user may recognize a change in the usage environment state of the brush device 2000 through a change in the color of the lighting device 2300.

Figure 20:
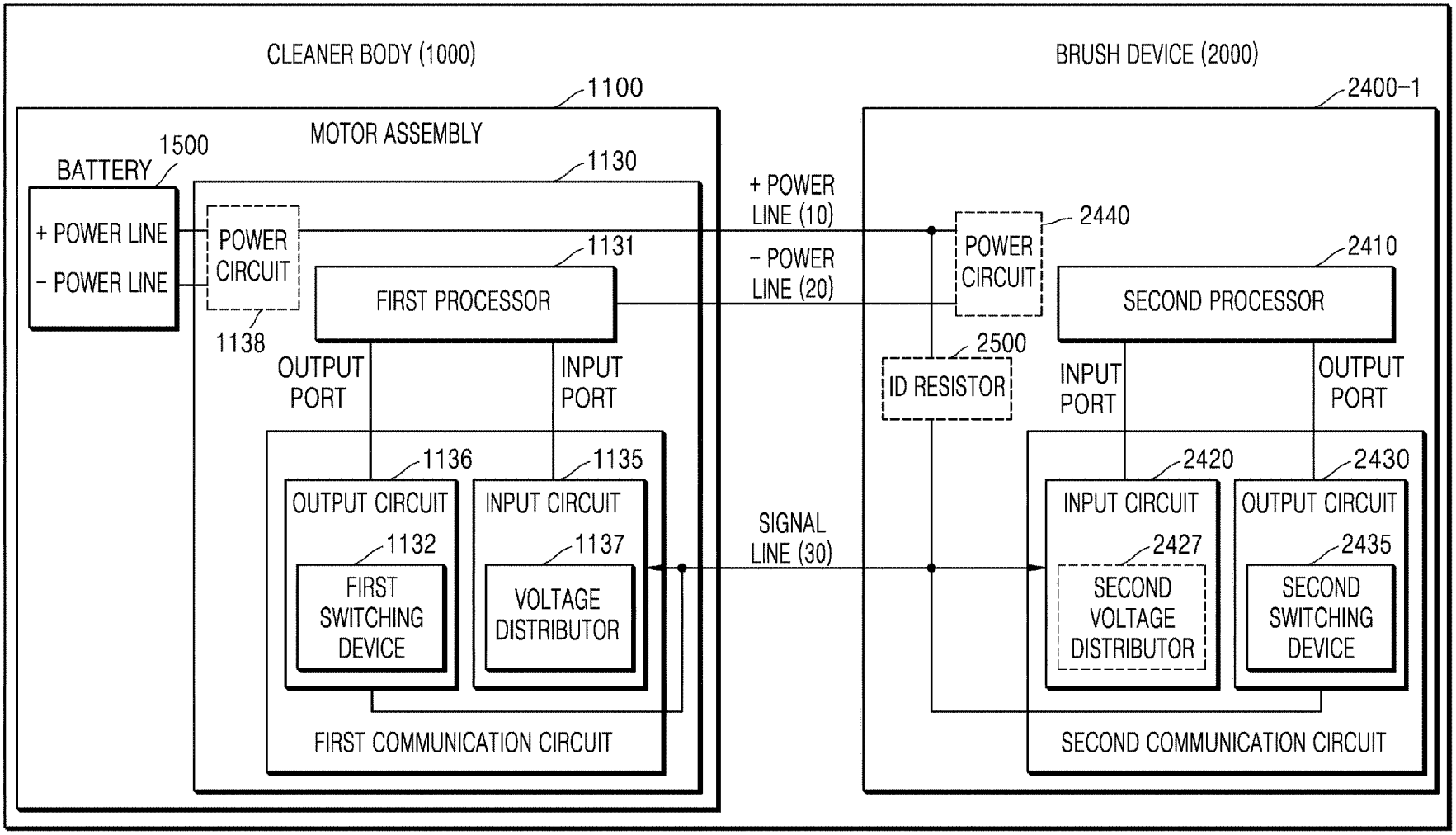
FIG. 20 is a block diagram for describing functions of a cordless vacuum cleaner, according to an embodiment of the disclosure.

FIG. 20 is a block diagram for describing functions of the cordless vacuum cleaner 100, according to an embodiment of the disclosure.

The PCB 1130 of the cleaner body 1000 shown in FIG. 20 may correspond to the PCB 1130 of the cleaner body 1000 shown in FIG. 7A, and a PCB 2400-1 of the brush device 2000 shown in FIG. 20 may correspond to the PCB 2400 shown in FIG. 7A, and thus redundant descriptions are omitted.

Referring to FIG. 20, the PCB 2400-1 of the brush device 2000 may include a voltage distributor like the PCB 1130 of the cleaner body 1000. Thus, for convenience of descriptions, a voltage distributor of the cleaner body 1000 will be referred to as a first voltage distributer 1137 and a voltage distributor of the brush device 2000 will be referred to as a second voltage distributor 2427.

The second voltage distributor 2427 is configured to distribute a voltage input from the signal line 30 to the input port of the second processor 2410. When the PCB 2400-1 of the brush device 2000 includes the second voltage distributor 2427, a noise voltage may be distributed and input to the input port (AD port) of the second processor 2410 even when the noise voltage is applied to the signal line 30.

Thus, according to an embodiment of the disclosure, the PCB 2400-1 of the brush device 2000 for the signal line communication includes the second voltage distributor 2427, and thus when the second processor 2410 receives a signal from the first processor 1131, stable signal reception is possible by reducing a noise effect of the signal line 30. An operation by which the second processor 2410 receives a signal from the first processor 1131 will be described in more detail with reference to FIG. 21.

Figure 21:
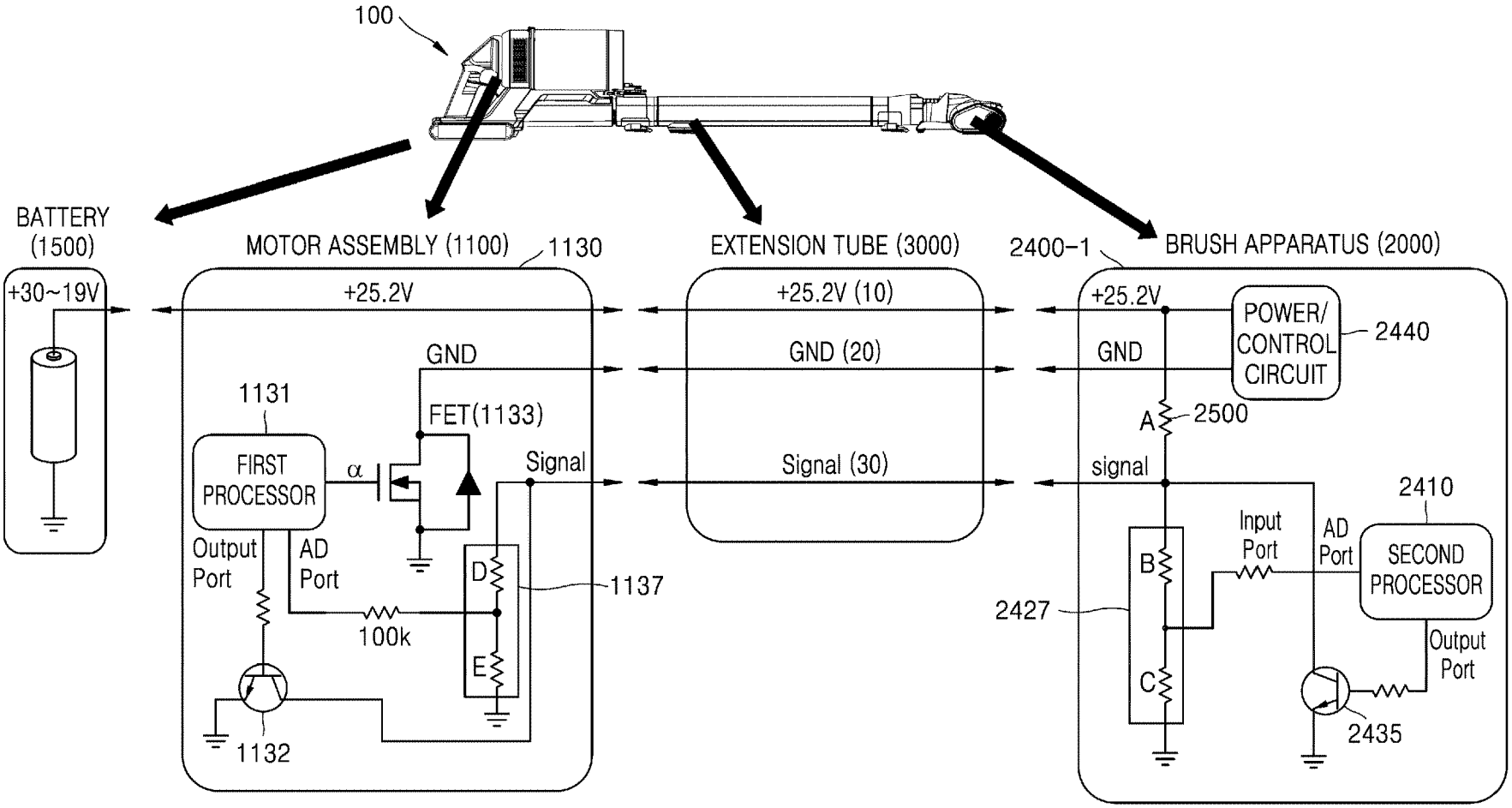
FIG. 21 is a schematic diagram for describing a circuit for signal line communication of a cordless vacuum cleaner, according to an embodiment of the disclosure.

FIG. 21 is a schematic diagram for describing a circuit for the signal line communication of the cordless vacuum cleaner 100, according to an embodiment of the disclosure.

In FIG. 21, for convenience of descriptions, a case in which A is 180 KΩ, B is 330 KΩ, C is 82 KΩ, D is 330 KΩ, and E is 82 KΩ will described as an example. Here, a signal line voltage may be $$13.4487\ \text{V}\left(= \text{Battery Supply Voltage} * \frac{(D+E)\|(B+C)}{A+(D+E)\|(B+C)} = 25.2\ \text{V} * \frac{206}{386}\right).$$

The first processor 1131 may identify a type of the brush device 2000, based on a voltage input to the input port (AD port). For example, when the input voltage of the AD port of the first processor 1131 is $$2.677\ \text{V}\left(= \text{Signal Line Voltage} * \frac{E}{D+E} = 13.4487\ \text{V} * \frac{82\ \text{K}}{(82\ \text{K}+330\ \text{K})}\right),$$

the first processor 1131 may identify that the multi-brush 401 having the ID resistor 2500 of 180 KΩ (A) corresponding to the 2.677 V that is the input voltage of the AD port is connected.

When the brush device 2000 combined to the cordless vacuum cleaner 100 is identified as the multi-brush 401 including the PCB 2400-1, the cleaner body 1000 may perform the signal line communication with the brush device 2000.

The first processor 1131 of the cleaner body 1000 may receive a signal by using the input port and transmit a signal by using the output port. For example, when the first processor 1131 outputs a low signal through the output port, the first switching device 1132 may be turned off. When the first switching device 1132 is turned off, a voltage of the signal line 30 may be about 13.4487 V, and thus in a high state. When the voltage of the signal line 30 is $$13.4487\ \text{V},$$

$$2.677\ \text{V}\left(= \text{Signal Line Voltage} * \frac{C}{B+C} = 13.4487\ \text{V} * \frac{82\ \text{K}}{(82\ \text{K} + 330\ \text{K})}\right)$$

may be input to the input port of the second processor 2410. Here, the PCB 2400-1 of the brush device 2000 includes the second voltage distributor 2427, and thus only 2.677 V may be input to the input port of the second processor 2410 as a high voltage (13.4487 V) of the signal line 30 is distributed. On the other hand, when the first processor 1131 outputs a high signal through the output port, the first switching device 1132 may be turned on. When the first switching device 1132 is turned on, the voltage of the signal line 30 is changed to 0 V (GND), and thus in a low state. When the voltage of the signal line 30 is 0 V, a low signal (0 V) may be input to the input port of the second processor 2410. In other words, when the first processor 1131 outputs the low signal through the output port, the high signal (2.677 V) may be input to the input port of the second processor 2410, and when the first processor 1131 outputs the high signal through the output port, the low signal may be input to the input port of the second processor 2410.

The second processor 2410 of the brush device 2000 may receive a signal by using the input port and transmit a signal by using the output port. For example, when the second processor 2410 outputs a high signal through the output port, the second switching device 2435 may be turned on. When the second switching device 2435 is turned on, the voltage of the signal line 30 is changed to 0 V (GND), and thus in a low state. When the voltage of the signal line 30 is 0 V, a low signal (0 V) may be input to the input port of the first processor 1131. On the other hand, when the second processor 2410 outputs a low signal through the output port, the second switching device 2435 may be turned off. When the second switching device 2435 is turned off, the voltage of the signal line 30 may be about 13.4487 V, and thus in a high state. When the voltage of the signal line 30 is about 13.4487 V, 2.677 V may be input to the input port of the first processor 1131. Here, the PCB 1130 of the cleaner body 1000 includes the first voltage distributer 1137, and thus a high voltage (13.4487 V) of the signal line 30 may be distributed and 2.677 V may be input to the input port of the first processor 1131. In other words, when the second processor 2410 outputs the high signal through the output port, the low signal (0 V) may be input to the input port of the first processor 1131, and when the second processor 2410 outputs the low signal through the output port, the high signal (2.677 V) may be input to the input port of the second processor 2410.

Hereinafter, signal transmission between the cleaner body 1000 and the brush device 2000 will be described in more detail with reference to FIG. 22.

FIG. 22 is a table for describing an operation by which the cleaner body 1000 transmits a signal to the brush device 2000, according to an embodiment of the disclosure.

Referring to FIG. 22, a lookup table 2210 including operating information 2202 of the cordless vacuum cleaner 100, corresponding to an operating condition 2201, and data 2203 indicating the operating condition 2201 may be stored in each of the memory of the cleaner body 1000 and the memory of the brush device 2000. Here, the operating information 2202 of the cordless vacuum cleaner 100, corresponding to the operating condition 2201, may include the power consumption of the suction motor 1110, the drum RPM of the brush device 2000, and the trip level of the brush device 2000, but is not limited thereto. Also, the data 2203 indicating the operating condition 2201 may be 5-bit data, but is not limited thereto.

According to an embodiment of the disclosure, when the data 2203 indicating the operating condition 2201 is in 5 bits, the data 2203 indicating the operating condition 2201 may include two start bits and three command bits. In FIG. 22, there are three command bits, and thus the operating condition 2201 is classified into 8, but there may be more operating conditions when the number of command bits increases. The operating condition 2201 may include a hard floor, a normal carpet (normal load), a high-density carpet (overload), a mat, lifted (moved), or stop, but is not limited thereto.

In FIG. 22, a case in which the cleaner body 1000 transmits a 5-bit signal (11001) indicating the first operating condition to the brush device 2000 and a transmission time is 10 ms per bit will be described as an example.

According to a communication protocol according to an embodiment of the disclosure, 0 and 1 may be classified based on a state of the signal line 30. For example, 1 may be transmitted when the signal line 30 is changed from low (L) to high (H) and 0 may be transmitted when the signal line 30 is changed from high (H) to low (L). Accordingly, the first processor 1131 may turn on the first switching device 1132 for 5 ms such that the voltage of the first level lower than the threshold value is applied to the signal line 30, and turn off the first switching device 1132 for remaining 5 ms such that the voltage of the second level higher than the threshold value is applied to the signal line 30 to transmit code 1. Also, the first processor 1131 may turn off the first switching device 1132 for 5 ms such that the voltage of the second level higher than the threshold value is applied to the signal line 30, and turn on the first switching device 1132 for remaining 5 ms such that the voltage of the first level lower than the threshold value is applied to the signal line 30 to transmit code 0.

According to an embodiment of the disclosure, the first processor 1131 may make the state of the signal line 30 to "LH LH HL HL LH" to transmit 11001 indicating the first operating condition (hard floor) to the second processor 2410. While the first processor 1131 transmits a signal, the output port of the second processor 2410 may maintain a low (0 V) state. Meanwhile, when the first processor 1131 and the second processor 2410 are not communicating with each other, the output port of the first processor 1131 and the output port of the second processor 2410 may both be in a low (0 V) state.

Upon receiving the first signal (11001) indicating the first operating condition from the cleaner body 1000, the second processor 2410 may identify, from the lookup table 2210 stored in the memory of the brush device 2000, the first operating information (power consumption of suction motor 1110: 75 W, drum RPM: 2000, trip level: 4.0 A) corresponding to the first operating condition. Also, the second processor 2410 may adjust the drum RPM to 2000 rpm and set the trip level to 4.0 A. Then, in response to the first signal, the second processor 2410 may transmit, to the first processor 1131, the second signal indicating the current state. For example, since the settings are changed based on the first operating information corresponding to the first operating condition (hard floor), the second processor 2410 may transmit, to the first processor 1131, the second signal (for example, 11001) indicating that the current state corresponds to the first operating condition (hard floor).

An operation of transmitting and receiving signals between the cleaner body 1000 and the brush device 2000 will be described in more detail with reference to FIG. 23.

Figure 23:
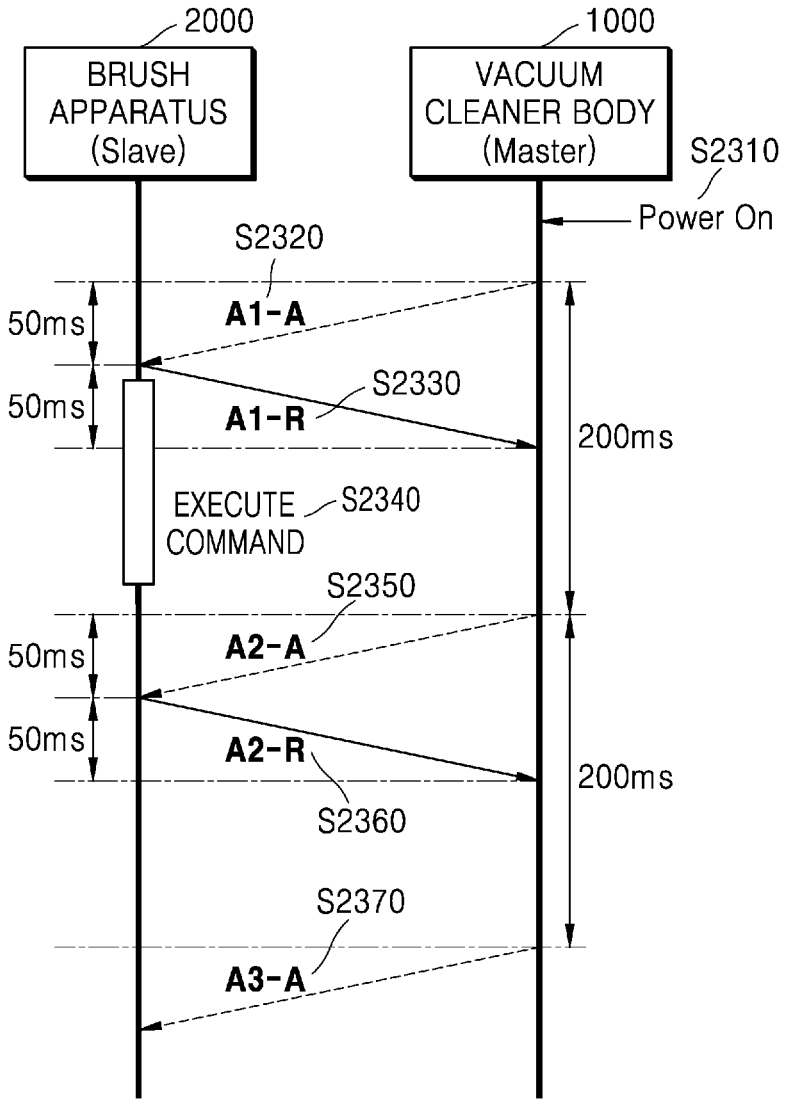
FIG. 23 is a flowchart for describing an operation of transmitting a signal between a cleaner body and a brush device, according to an embodiment of the disclosure.

FIG. 23 is a flowchart for describing an operation of transmitting a signal between the cleaner body 1000 and the brush device 2000, according to an embodiment of the disclosure. In FIG. 23, a case in which the cleaner body 1000 operates as a master device and the brush device 2000 operates as a slave device will be described as an example.

The cleaner body 1000 may receive a user input of turning power on (operation S2310). When cleaner body 1000 is turned on, the cleaner body 1000 may perform communication with the brush device 2000 combined to the cordless vacuum cleaner 100, through the signal line 30. For example, the cleaner body 1000 may transmit the A1 signal A1-A indicating the first operating condition to the brush device 2000 (operation S2320). The A1 signal A1-A may be transmitted for 50 ms. When the brush device 2000 receives the A1 signal A1-A, the brush device 2000 may transmit, to the cleaner body 1000, the A1 response signal A1-R indicating the current state (operation S2330). The A1 response signal A1-R may also be transmitted for 50 ms.

The brush device 2000 may execute an instruction according to the A1 signal A1-A (operation S2340). For example, the brush device 2000 may adjust the drum RPM and the trip level, based on the first operating information corresponding to the first operating condition.

When a certain time (for example, 200 ms) has elapsed after the A1 signal A1-A is transmitted, the cleaner body 1000 may transmit the A2 signal A2-A to the brush device 2000 (operation S2350). In FIG. 23, the certain time is 200 ms, but is not limited thereto. When the usage environment state (for example, hard floor, carpet, mat, corner, or lifted state) of the brush device 2000 does not change from when the A1 signal A1-A is transmitted to when the A2 signal A2-A is transmitted, the A2 signal A2-A may continue to indicate the first operating condition. On the other hand, when the usage environment state of the brush device 2000 changes between the transmission of the A1 signal A1-A and the transmission of the A2 signal A2-A, the A2 signal A2-A may indicate the second operating condition instead of the first operating condition.

When the brush device 2000 receives the A2 signal A2-A, the brush device 2000 may transmit the A2 response signal A2-R indicating the current state to the cleaner body 1000 (operation S2360). The A2 response signal A2-R may also be transmitted for 50 ms. Here, the A2 response signal A2-R may include an instruction execution result of the brush device 2000. For example, when the brush device 2000 has adjusted the drum RPM and the trip level, based on the first operating information corresponding to the first operating condition, the A2 response signal A2-R may include data indicating the first operating condition (or data indicating the drum RPM and the trip level).

When a certain time (200 ms) has elapsed after the A2 signal A2-A is transmitted, the cleaner body 1000 may transmit the A3 signal A3-A to the brush device 2000 (operation S2370). Upon receiving the A3 signal A3-A, the brush device 2000 may transmit the A3 signal A3-A indicating the current state to the cleaner body 1000.

Accordingly, by continuously communicating with the brush device 2000 at certain time intervals (200 ms), the cleaner body 1000 may adaptively control operations of the brush device 2000, according to the usage environment state (for example, hard floor, carpet, mat, corner, or lifted state) of the brush device 2000.

FIG. 24 is a table for describing an operation by which the cleaner body 1000 identifies a type of the brush device 2000, based on a signal received from the brush device 2000, according to an embodiment of the disclosure.

Referring to FIG. 24, the brush device 2000 may indicate the type of the brush device 2000 by using a start bit of the data 2203 transmitted during the signal line communication. For example, the brush device 2000 may define the start bit to 11 when the brush device 2000 is an A type brush, define the start bit to 10 when the brush device 2000 is a B type brush, define the start bit to 01 when the brush device 2000 is a C type brush, and define the start bit to 00 when the brush device 2000 is a D type brush, but an embodiment of the disclosure is not limited thereto.

According to an embodiment of the disclosure, the brush device 2000 may identify the type of the brush device 2000 by analyzing the start bit of the data 2203 transmitted by the brush device 2000. For example, when the start bit includes 11, the cleaner body 1000 may identify the brush device 2000 as the A type brush, and when the start bit includes 10, the cleaner body 1000 may identify the brush device 2000 as the B type brush.

According to an embodiment of the disclosure, when the types of brush device 2000 exceed 4, the number of start bits may increase. According to an embodiment of the disclosure, a separate bit for indicating the type of the brush device 2000, instead of the start bit, may be added to a data signal.

Figure 25:
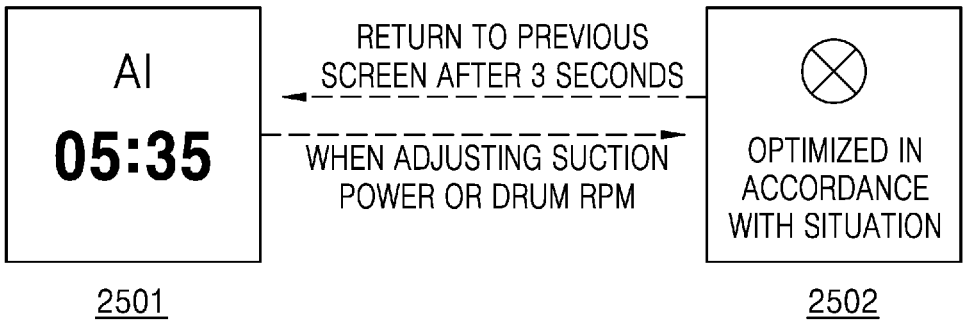
FIG. 25 is a graphical diagram for describing an operation by which a cordless vacuum cleaner outputs an operating state notification, according to an embodiment of the disclosure.

FIG. 25 is a graphical diagram for describing an operation by which the cordless vacuum cleaner 100 outputs an operating state notification, according to an embodiment of the disclosure.

According to an embodiment of the disclosure, when the user selects the AI mode, the cleaner body 1000 may display a first GUI 2501 on an output interface (for example, an LCD). The first GUI 2501 may indicate that the cordless vacuum cleaner 100 is operating in the AI mode and may indicate a possible cleaning time (remaining hours of battery use) in the AI mode.

A second GUI 2502 may be displayed on the output interface of the cleaner body 1000 when the cleaner body 1000 has identified the usage environment state of the brush device 2000 by using the AI model and adjusted the suction power strength of the suction motor 1110 or the drum RPM of the brush device 2000, according to the usage environment state of the brush device 2000. For example, the second GUI 2502 may include a notification "optimized according to situation".

The first GUI 2501 may be displayed again when a certain time (for example, 3 seconds) has elapsed after the second GUI 2502 is displayed on the output interface. Then, the second GUI 2502 may be displayed again when the suction power strength of the suction motor 1110 or the drum RPM of the brush device 2000 is changed again according to the usage environment state of the brush device 2000.

FIG. 26 is a collection of images for describing a GUI of the cordless vacuum cleaner 100, according to an embodiment of the disclosure.

According to an embodiment of the disclosure, when the user selects the AI mode and the cleaner body 1000 and the brush device 2000 are communicable, the cleaner body 1000 may display a first GUI 2601 on the output interface (for example, an LCD). The first GUI 2601 may indicate that the cordless vacuum cleaner 100 is operating in the AI mode.

According to an embodiment of the disclosure, when the cleaner body 1000 and the brush device 2000 are not communicable, the cleaner body 1000 may display a second GUI 2602 on the output interface (for example, an LCD). The second GUI 2602 may include a notification indicating that operating in the AI mode is not possible. For example, when the second signal is not received for a certain time after the first signal is transmitted through the signal line 30, the cleaner body 1000 may determine that communication with the brush device 2000 is not possible. When it is determined that the communication with the brush device 2000 is not possible, the cleaner body 1000 may output, through the output interface, the notification indicating that operating in the AI mode is not possible.

According to an embodiment of the disclosure, when the user pressed a power button and selected the AI mode, but an operating current of the brush device 2000 is not detected, the brush device 2000 may not have been properly combined to the cordless vacuum cleaner 100. Accordingly, the cleaner body 1000 may display a third GUI 2603 indicating to check a state of the brush device 2000. Also, according to an embodiment of the disclosure, the cleaner body 1000 may display the third GUI 2603 indicating to check the state of the brush device 2000 when it is determined that communication with the brush device 2000 is not possible or when the load of the brush device 2000 is equal to or greater than a threshold value (overloaded state).

Meanwhile, according to an embodiment of the disclosure, upon determining that communication with the brush device 2000 is not possible, the cleaner body 1000 may switch the operating mode from the AI mode to a normal mode, and display a GUI corresponding to the normal mode through the output interface.

Figure 27:
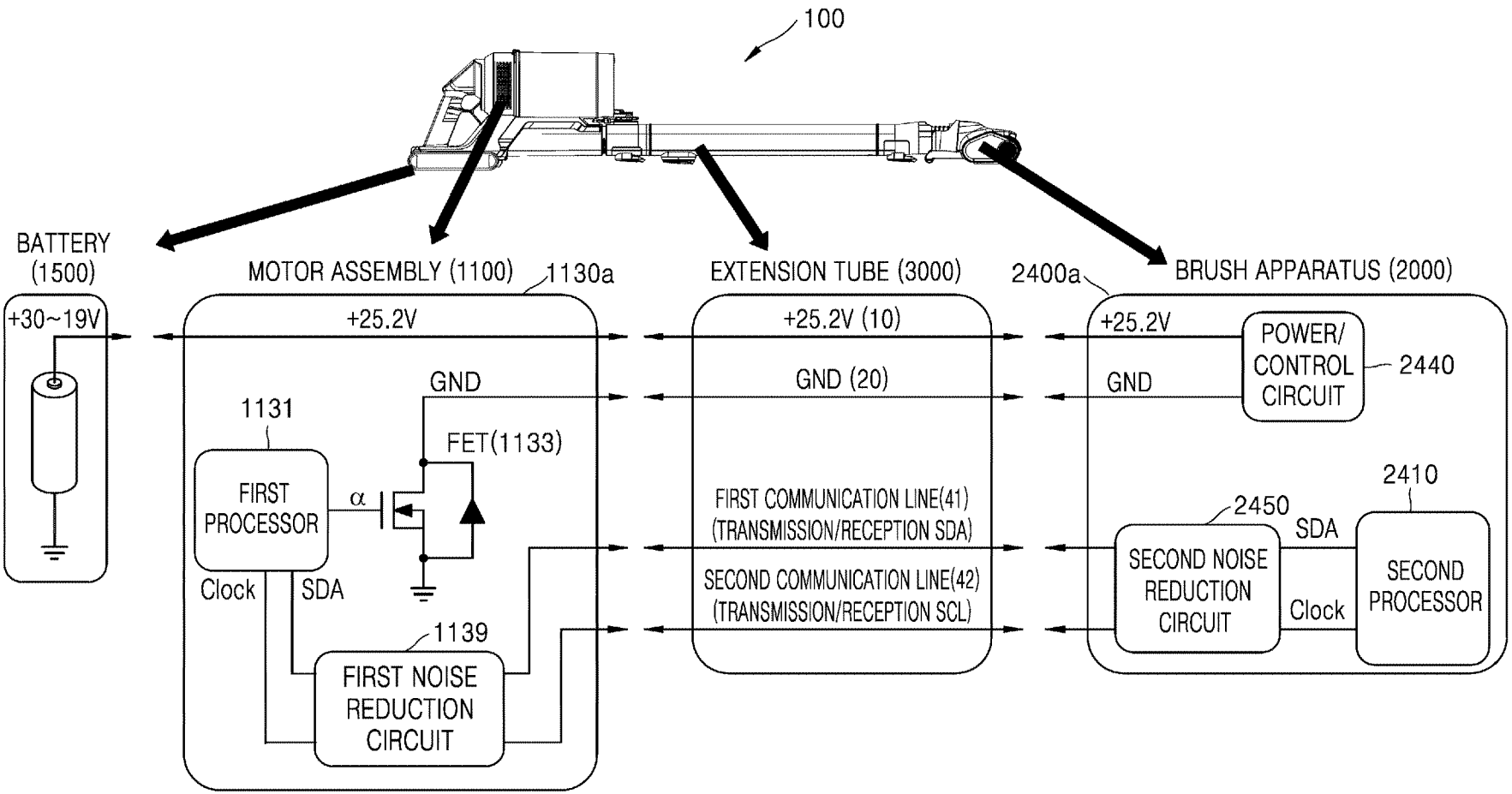
FIG. 27 is a schematic diagram for describing a circuit for inter-integrated circuit (I2C) communication of a cordless vacuum cleaner, according to an embodiment of the disclosure.

FIG. 27 is a schematic diagram for describing a circuit for I2C communication of the cordless vacuum cleaner 100, according to an embodiment of the disclosure.

Referring to FIG. 27, the cleaner body 1000 may include a PCB 1130*a* for I2C communication, and the brush device 2000 may also include a PCB 2400*a* for I2C communication. The PCB 1130*a* of the cleaner body 1000 shown in FIG. 27 may correspond to the PCB 1130 of the cleaner body 1000 shown in FIG. 8, and a PCB 2400*a* of the brush device 2000 shown in FIG. 27 may correspond to the PCB 2400 shown in FIG. 8, and thus redundant descriptions are omitted.

According to an embodiment of the disclosure, the cordless vacuum cleaner 100 may include a first communication line 41 and a second communication line 42 for the I2C communication, instead of the signal line 30 connected to the power lines 10 and 20.

The I2C communication is one of synchronization communication methods, and a transmission timing of data is adjusted by using a clock signal. Accordingly, the cordless vacuum cleaner 100 may include the first communication line 41 for transmitting and receiving serial data (SDA) and the second communication line 42 for transmitting and receiving a serial clock (SCL).

Due to characteristics of the cordless vacuum cleaner 100, noise caused by attachment/detachment of the brush device 2000, movement or knocking of the cordless vacuum cleaner 100 tends to occur often. Accordingly, to reduce electrical or mechanical damage or stress during the I2C communication between the cleaner body 1000 and the brush device 2000, a noise reduction circuit may be applied to an input end to which SDA or SCL is input. For example, the cleaner body 1000 may include a first noise reduction circuit 1139 and the brush device 2000 may include a second noise reduction circuit 2450.

The first noise reduction circuit 1139 and the second noise reduction circuit 2450 may include at least one of a low pass filter, a high pass filter, a band pass filter, a damping resistor, or a distribution resistor, but is not limited thereto.

SDA and SCL transmitted by the second processor 2410 through the first communication line 41 and the second communication line 42 may be input to the first processor 1131 through the first noise reduction circuit 1139, thereby reducing an effect of noise. Also, SDA and SCL transmitted by the first processor 1131 through the first communication line 41 and the second communication line 42 may be input to the second processor 2410 through the second noise reduction circuit 2450, thereby reducing an effect of noise.

According to an embodiment of the disclosure, the I2C communication may be performed as the cleaner body 1000 operates as a master device and the brush device 2000 operates as a slave device. An I2C communication signal may include a start signal (start bit), a data signal (command bit), and a stop signal (end bit).

The first processor 1131 may transmit a signal indicating an operating condition to the second processor 2410 through the first communication line 41 and the second communication line 42. The operating condition may include at least one of the target RPM of the drum 2200 of the brush device 2000, the target trip level of the brush device 2000, or the power consumption of the suction motor 1110 included in the cleaner body 1000.

The second processor 2410 of the brush device 2000 may execute an instruction, based on operating information corresponding to the received operating condition. For example, the brush device 2000 may adjust the drum RPM and the trip level. Also, the second processor 2410 of the brush device 2000 may transmit a response signal indicating the current state to the first processor 1131 of the cleaner body 1000 through the first communication line 41 and the second communication line 42.

Figure 28:
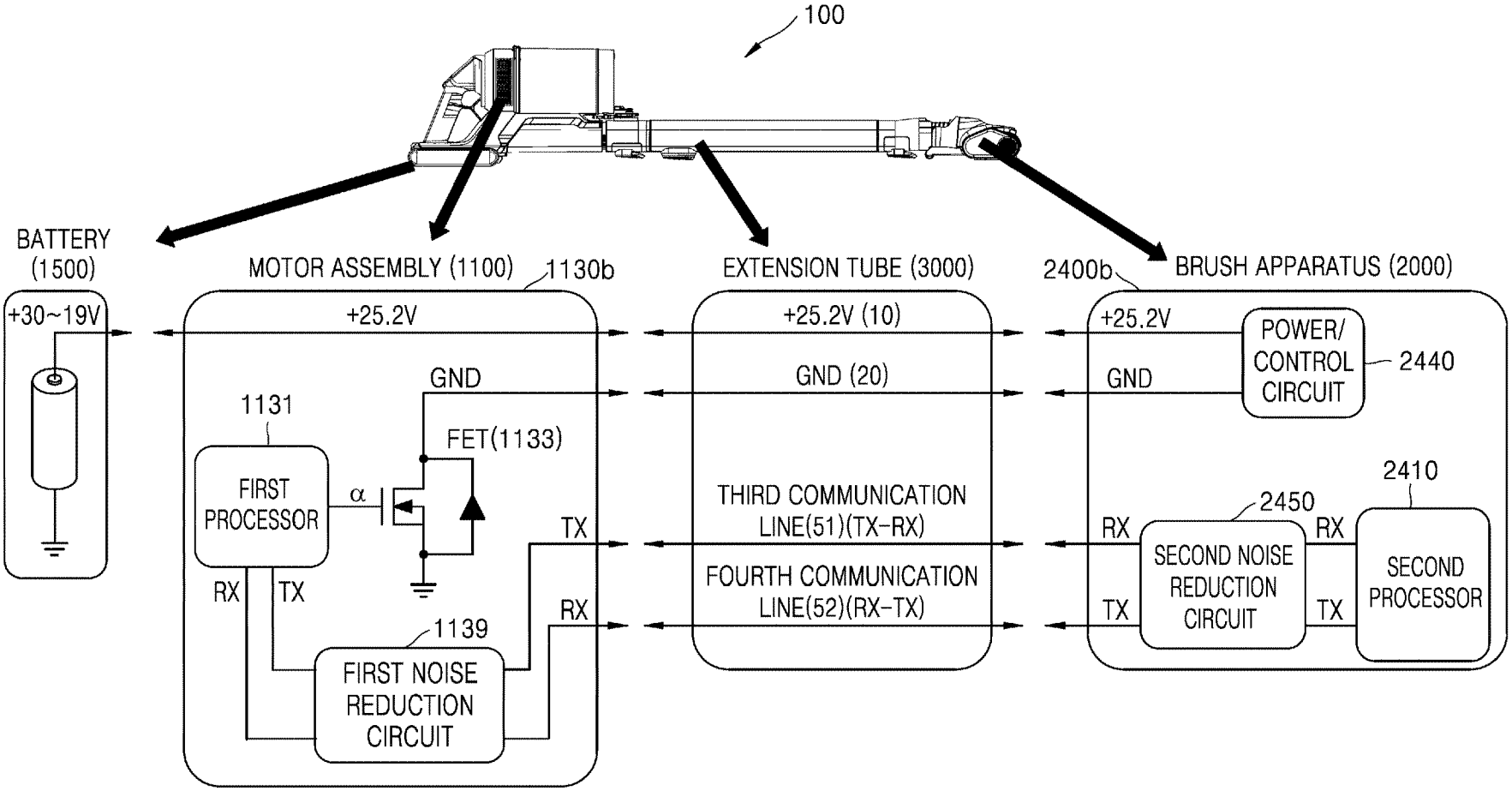
FIG. 28 is a schematic diagram for describing a circuit for universal asynchronous receiver/transmitter (UART) full duplex communication of a cordless vacuum cleaner, according to an embodiment of the disclosure.

FIG. 28 is a schematic diagram for describing a circuit for UART full duplex communication of the cordless vacuum cleaner 100, according to an embodiment of the disclosure.

Referring to FIG. 28, the cleaner body 1000 may include a PCB 1130*b* for UART full duplex communication, and the brush device 2000 may also include a PCB 2400*b* for UART full duplex communication. The PCB 1130*b* of the cleaner body 1000 shown in FIG. 28 may correspond to the PCB 1130 of the cleaner body 1000 shown in FIG. 8, and the PCB 2400*b* of the brush device 2000 shown in FIG. 28 may correspond to the PCB 2400 shown in FIG. 8, and thus redundant descriptions are omitted.

According to an embodiment of the disclosure, the cordless vacuum cleaner 100 may include two wires for UART full duplex communication, instead of the signal line 30 connected to the power lines 10 and 20. For example, the cordless vacuum cleaner 100 may include a third communication line 51 and a fourth communication line 52. The third communication line 51 may be a line for the first processor 1131 to transmit a signal to the second processor 2410, and the fourth communication line 52 may be a line for the second processor 2410 to transmit a signal to the first processor 1131. The first processor 1131 and the second processor 2410 may each simultaneously transmit and receive signals through the third communication line 51 and the fourth communication line 52.

Due to characteristics of the cordless vacuum cleaner 100, noise caused by attachment/detachment of the brush device 2000, movement or knocking of the cordless vacuum cleaner 100 tends to occur often. Accordingly, to reduce electrical or mechanical damage or stress during the UART communication between the cleaner body 1000 and the brush device 2000, a noise reduction circuit may be applied to an input end to which a signal is input. For example, the cleaner body 1000 may include the first noise reduction circuit 1139 and the brush device 2000 may include the second noise reduction circuit 2450.

The first noise reduction circuit 1139 and the second noise reduction circuit 2450 may include at least one of a low pass filter, a high pass filter, a band pass filter, a damping resistor, or a distribution resistor, but is not limited thereto.

A data signal transmitted by the first processor 1131 through the third communication line 51 may be input to the second processor 2410 through the second noise reduction circuit 2450, thereby reducing an effect of noise. Also, a data signal transmitted by the second processor 2410 through the fourth communication line 52 may be input to the first processor 1131 through the first noise reduction circuit 1139, thereby reducing an effect of noise.

According to an embodiment of the disclosure, the UART full duplex communication may be performed as the cleaner body 1000 operates as a master device and the brush device 2000 operates as a slave device. A UART communication signal may include a start signal (start bit), a data signal (command bit), and a stop signal (end bit).

The first processor 1131 may transmit a signal indicating an operating condition to the second processor 2410 through the third communication line 51. The operating condition may include at least one of the target RPM of the drum 2200 of the brush device 2000, the target trip level of the brush device 2000, or the power consumption of the suction motor 1110 included in the cleaner body 1000.

The second processor 2410 of the brush device 2000 may execute an instruction, based on operating information corresponding to the received operating condition. For example, the brush device 2000 may adjust the drum RPM and the trip level. Also, the second processor 2410 of the brush device 2000 may transmit a response signal indicating the current state to the first processor 1131 of the cleaner body 1000 through the fourth communication line 52.

Figure 29:
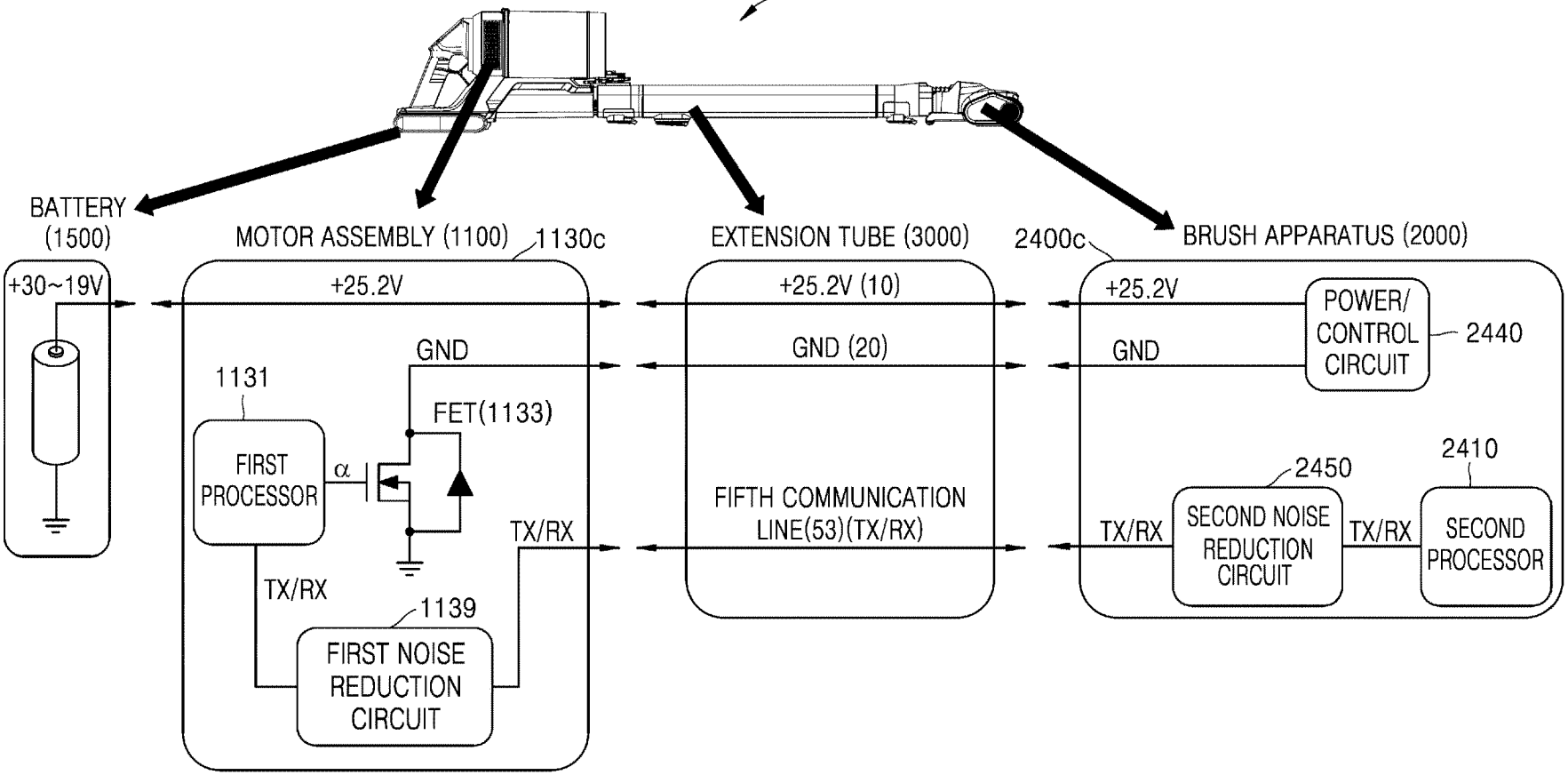
FIG. 29 is a schematic diagram for describing a circuit for UART half-duplex communication of a cordless vacuum cleaner, according to an embodiment of the disclosure.

FIG. 29 is a schematic diagram for describing a circuit for UART half-duplex communication of the cordless vacuum cleaner 100, according to an embodiment of the disclosure.

Referring to FIG. 29, the cleaner body 1000 may include a PCB 1130*c* for UART half-duplex communication, and the brush device 2000 may also include a PCB 2400*c* for UART half-duplex communication. The PCB 1130*c* of the cleaner body 1000 shown in FIG. 29 may correspond to the PCB 1130*b* of the cleaner body 1000 shown in FIG. 28, and a PCB 2400*c* of the brush device 2000 shown in FIG. 29 may correspond to the PCB 2400*b* shown in FIG. 28, and thus redundant descriptions are omitted.

According to an embodiment of the disclosure, the cordless vacuum cleaner 100 may include one wire for UART half-duplex communication, instead of the signal line 30 connected to the power lines 10 and 20. For example, the cordless vacuum cleaner 100 may include a fifth communication line 53. The fifth communication line 53 may be a line for the first processor 1131 and the second processor 2410 to alternately transmit a signal. The second processor 2410 may receive the first signal through the fifth communication line 53 when the first processor 1131 transmits the first signal through the fifth communication line 53, and the first processor 1131 may receive the second signal through the fifth communication line 53 when the second processor 2410 transmits the second signal through the fifth communication line 53.

Meanwhile, a data signal transmitted by the first processor 1131 through the fifth communication line 53 may be input to the second processor 2410 through the second noise reduction circuit 2450, thereby reducing an effect of noise. Also, a data signal transmitted by the second processor 2410 through the fifth communication line 53 may be input to the first processor 1131 through the first noise reduction circuit 1139, thereby reducing an effect of noise.

According to an embodiment of the disclosure, the UART half-duplex communication may be performed as the cleaner body 1000 operates as a master device and the brush device 2000 operates as a slave device. A UART communication signal may include a start signal (start bit), a data signal (command bit), and a stop signal (end bit).

The first processor 1131 may transmit a signal indicating an operating condition to the second processor 2410 through the fifth communication line 53. The operating condition may include at least one of the target RPM of the drum 2200 of the brush device 2000, the target trip level of the brush device 2000, or the power consumption of the suction motor 1110 included in the cleaner body 1000.

The second processor 2410 of the brush device 2000 may execute an instruction, based on operating information corresponding to the received operating condition. For example, the brush device 2000 may adjust the drum RPM and the trip level. Also, the second processor 2410 of the brush device 2000 may transmit a response signal indicating the current state to the first processor 1131 of the cleaner body 1000 through the fifth communication line 53.

Figure 30:
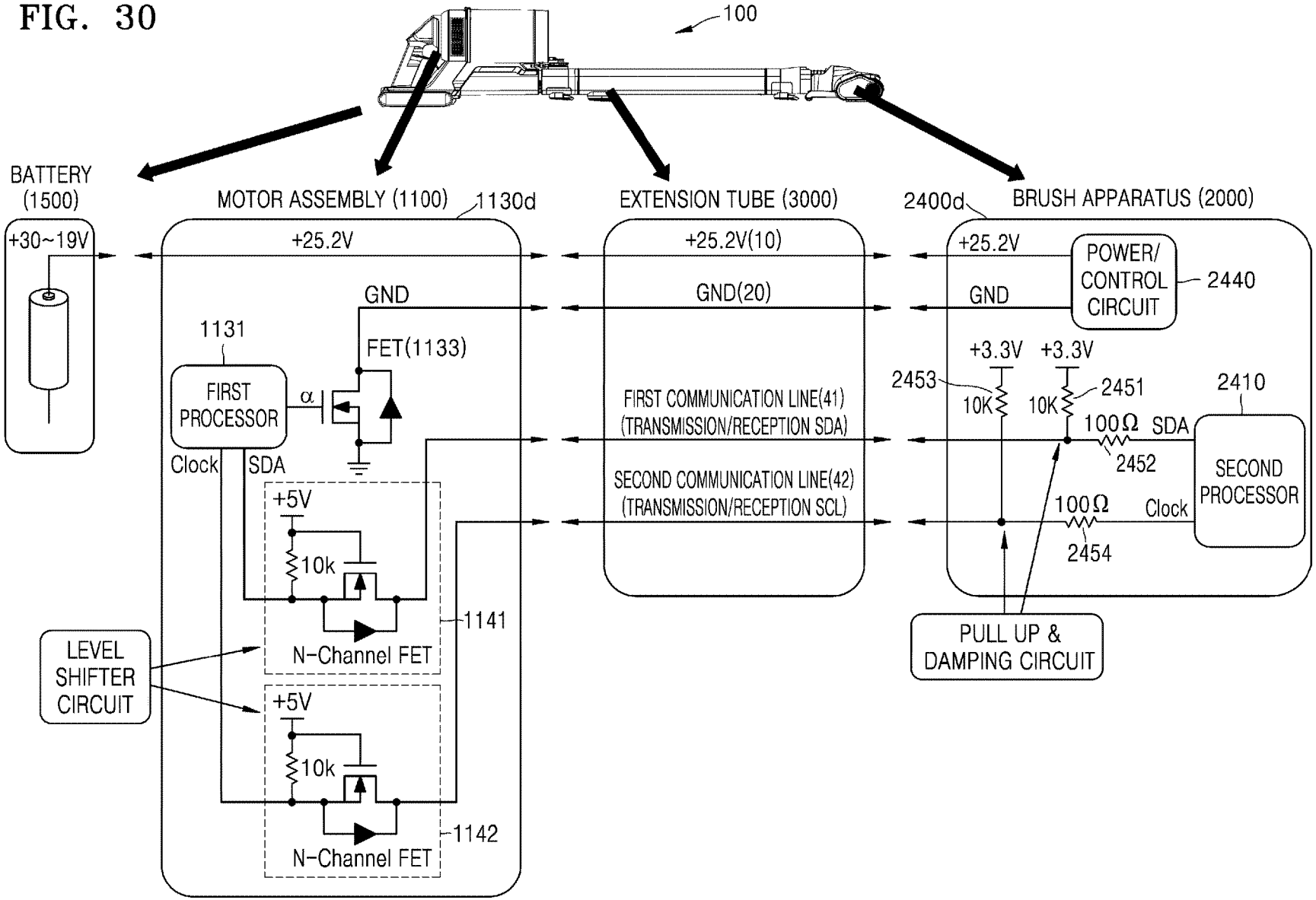
FIG. 30 is a schematic diagram for describing a circuit for I2C communication of a cordless vacuum cleaner, according to an embodiment of the disclosure.

FIG. 30 is a schematic diagram for describing a circuit for I2C communication of the cordless vacuum cleaner 100, according to an embodiment of the disclosure.

Referring to FIG. 30, the cleaner body 1000 may include a PCB 1130*d* for I2C communication, and the brush device 2000 may also include a PCB 2400*d* for I2C communication. The PCB 1130*d* of the cleaner body 1000 shown in FIG. 30 may correspond to the PCB 1130 of the cleaner body 1000 shown in FIG. 8, and a PCB 2400*d* of the brush device 2000 shown in FIG. 30 may correspond to the PCB 2400 shown in FIG. 8, and thus redundant descriptions are omitted.

According to an embodiment of the disclosure, the cordless vacuum cleaner 100 may include the first communication line 41 and the second communication line 42 for the I2C communication, instead of the signal line 30 connected to the power lines 10 and 20. The first communication line 41 may be a line for transmitting/receiving SDA, and the second communication line 42 may be a line for transmitting/receiving SCL.

According to an embodiment of the disclosure, for communication resistant to noise, the PCB 1130*d* of the cleaner body 1000 may include a first level shifter circuit 1141 and a second level shifter circuit 1142. Each of the first level shifter circuit 1141 and the second level shifter circuit 1142 may be a level shift integrated circuit (IC) in which a switching device and a peripheral circuit are packed. The PCB 2400*d* of the brush device 2000 may include a first pull-up resistor 2451, a first damping resistor 2452, a second pull-up resistor 2453, and a second damping resistor 2454.

The cleaner body 1000 may operate as a master device to transmit a signal indicating an operating condition to the second processor 2410 through the first communication line 41 and the second communication line 42. For example, when the first processor 1131 outputs a high signal (5 V)

towards the first level shifter circuit 1141, a switching device (for example, an N-channel FET) included in the first level shifter circuit 1141 becomes an off-state, and thus 3.3 V (high) connected to the first pull-up resistor 2451 may be applied to the first communication line 41 and 3.3 V (high) may be input to the second processor 2410 through the first damping resistor 2452. On the other hand, when the first processor 1131 outputs a low signal (0 V) towards the first level shifter circuit 1141, the switching device (for example, the N-channel FET) included in the first level shifter circuit 1141 becomes an on-state, and thus a voltage of the first communication line 41 may be 0 V (low) and 0 V (low) may be input to the second processor 2410. In other words, when the first processor 1131 outputs the high signal towards the first level shifter circuit 1141, the high signal may be input to the second processor 2410 through the first communication line 41, and when the first processor 1131 outputs the low signal towards the first level shifter circuit 1141, the low signal may be input to the second processor 2410 through the first communication line 41.

Similarly, when the first processor 1131 outputs the high signal towards the second level shifter circuit 1142, the high signal may be input to the second processor 2410 through the second communication line 42, and when the first processor 1131 outputs the low signal towards the second level shifter circuit 1142, the low signal may be input to the second processor 2410 through the second communication line 42.

Meanwhile, the second processor 2410 of the brush device 2000 may transmit a response signal indicating the current state to the first processor 1131 of the cleaner body 1000 through the first communication line 41 and the second communication line 42. For example, when the second processor 2410 outputs the high signal (3.3 V) towards the first damping resistor 2452, 3.3 V (high) is also applied to the first communication line 41. Here, because the switching device (for example, N-channel FET) included in the first level shifter circuit 1141 does not operate, 5 V (high) is input to the first processor 1131. In other words, because +5 V power is unable to flow from the first level shifter circuit 1141 to the first communication line 41 through 10 KΩ resistance and a body diode (BD) of the switching device (for example, N-channel FET) (a current path is not formed), 5 V is input to the first processor 1131 and SDA of the first processor 1131 becomes high (+5 V). On the other hand, when the second processor 2410 outputs the low signal (0 V) towards the first damping resistor 2452, a voltage close to 0 (low) is also applied to the first communication line 41 because a size of the first damping resistor 2452 is very small compared to the first pull-up resistor 2451. For example, a voltage of the first communication line 41 may be 0.032673 V (=3.3 V*[100/(10 K+100)], and thus in a low state. Also, because resistance (10 KΩ) included in the first level shifter circuit 1141 is large, a voltage drop is high, and thus a voltage close to 0 (low) is also input to the first processor 1131. In other words, the switching device (for example, N-channel FET) included in the first level shifter circuit 1141 is in an off-state, but a current path through which +5 V moves to the first communication line 41 via the resistance (10 KΩ) and the BD of the switching device (for example, N-channel FET) is formed, and thus SDA of the first processor 1131 becomes low. For example, when it is assumed that a voltage (VF) of the BD of the switching device (for example, N-channel FET) is 0.6 V, a voltage (also referred to as an SDA voltage) input to the first processor 1131 may be as follows.

SDA Voltage of First Processor 1131=N-FET BD VF (0.6 V)+Voltage of First Communication Line 41=0.6 V+0.032673 V=0.632673 V (about 4.367 V is applied to 10 KΩ resistance)

Accordingly, the high signal (5 V) is also input to the first processor 1131 through the first communication line 41 when the second processor 2410 outputs the high signal (3.3 V) towards the first damping resistor 2452, and the low signal (≈0 V) is also input to the first processor 1131 through the first communication line 41 when the second processor 2410 outputs the low signal (0 V) towards the first damping resistor 2452.

Similarly, the high signal (5 V) is also input to the first processor 1131 through the second communication line 42 when the second processor 2410 outputs the high signal (3.3 V) towards the second damping resistor 2454, and the low signal (≈0 V) is also input to the first processor 1131 through the second communication line 42 when the second processor 2410 outputs the low signal (0 V) towards the second damping resistor 2454.

When the cordless vacuum cleaner 100 includes the first level shifter circuit 1141 and the second level shifter circuit 1142, the I2C communication between the cleaner body 1000 and the brush device 2000 is possible even when a voltage output from the first processor 1131 and a voltage output from the second processor 2410 are different from each other.

According to an embodiment of the disclosure, the PCB 1130*d* of the cleaner body 1000 may include the first pull-up resistor 2451, the first damping resistor 2452, the second pull-up resistor 2453, and the second damping resistor 2454, and the PCB 2400*d* of the brush device 2000 may include the first level shifter circuit 1141 and the second level shifter circuit 1142.

Figure 31:
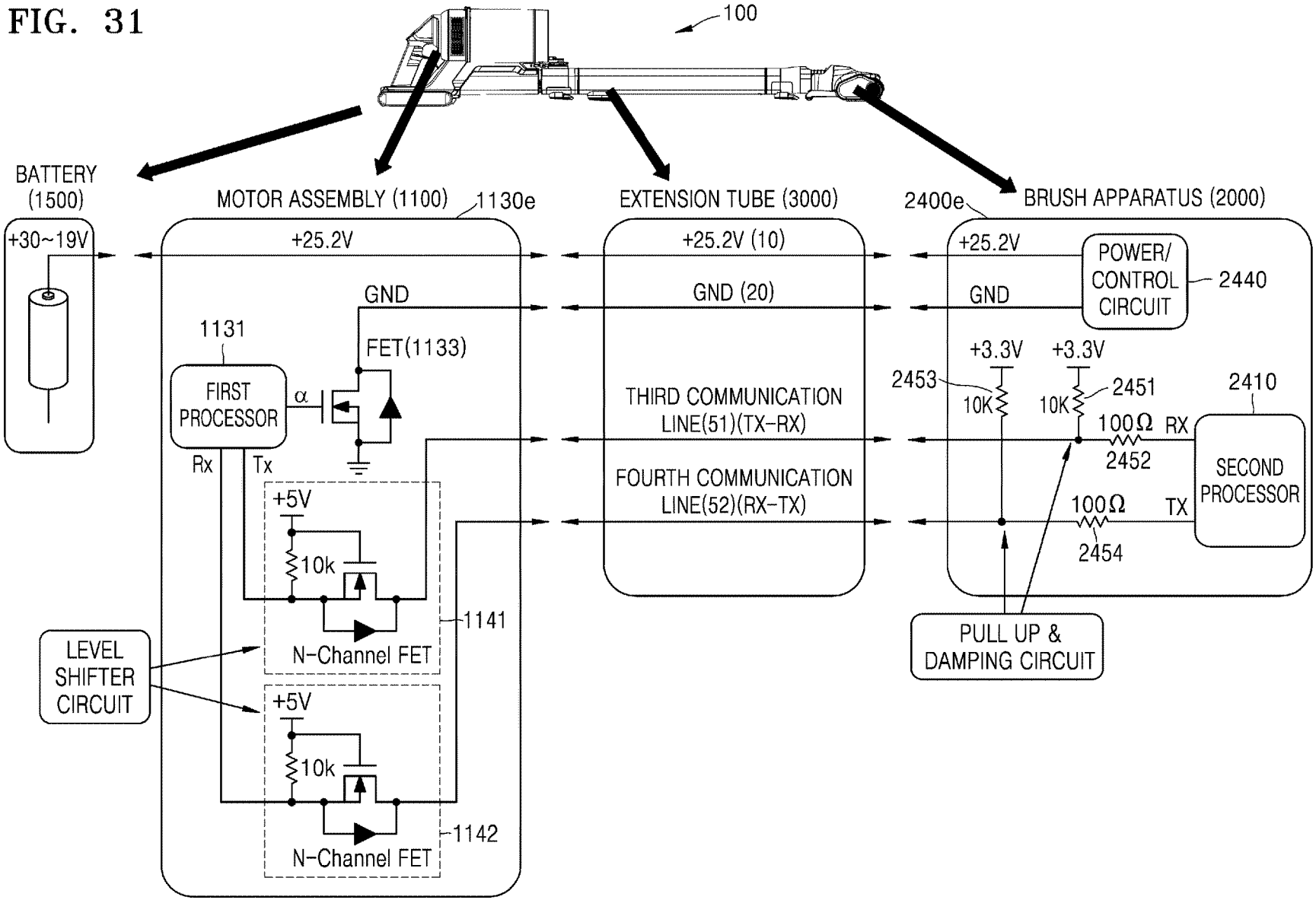
FIG. 31 is a schematic diagram for describing a circuit for UART communication of a cordless vacuum cleaner, according to an embodiment of the disclosure.

FIG. 31 is a schematic diagram for describing a circuit for UART communication of the cordless vacuum cleaner 100, according to an embodiment of the disclosure.

Referring to FIG. 31, the cleaner body 1000 may include a PCB 1130*e* for UART communication and the brush device 2000 may also include a PCB 2400*e* for UART communication. The PCB 1130*e* of the cleaner body 1000 shown in FIG. 31 may correspond to the PCB 1130 of the cleaner body 1000 shown in FIG. 8, and a PCB 2400*e* of the brush device 2000 shown in FIG. 31 may correspond to the PCB 2400 shown in FIG. 8, and thus redundant descriptions are omitted.

According to an embodiment of the disclosure, the cordless vacuum cleaner 100 may include two wires for UART full duplex communication, instead of the signal line 30 connected to the power lines 10 and 20. For example, the cordless vacuum cleaner 100 may include the third communication line 51 and the fourth communication line 52. The third communication line 51 may be a line for the first processor 1131 to transmit a signal to the second processor 2410, and the fourth communication line 52 may be a line for the second processor 2410 to transmit a signal to the first processor 1131. The first processor 1131 and the second processor 2410 may each simultaneously transmit and receive signals through the third communication line 51 and the fourth communication line 52.

According to an embodiment of the disclosure, for communication resistant to noise, the PCB 1130*e* of the cleaner body 1000 may include the first level shifter circuit 1141 and the second level shifter circuit 1142. Each of the first level shifter circuit 1141 and the second level shifter circuit 1142 may be a level shift IC in which a switching device and a peripheral circuit are packed. The PCB 2400*e* of the brush device 2000 may include the first pull-up resistor 2451, the first damping resistor 2452, the second pull-up resistor 2453, and the second damping resistor 2454.

The cleaner body 1000 may operate as a master device to transmit a signal indicating an operating condition to the second processor 2410 through the third communication line 51. For example, when the first processor 1131 outputs the high signal (5 V), the switching device (for example, N-channel FET) included in the first level shifter circuit 1141 becomes in an off-state, and thus 3.3 V (high) connected to the first pull-up resistor 2451 is applied to the third communication line 51, and 3.3 V (high) may also be input to the second processor 2410 through the first damping resistor 2452. On the other hand, when the first processor 1131 outputs the low signal (0 V), the switching device (for example, N-channel FET) included in the first level shifter circuit 1141 becomes an on-state, and thus the voltage of the third communication line 51 becomes 0 V (low) and 0 V (low) may also be input to the second processor 2410. In other words, the high signal (3.3 V) may be input to the second processor 2410 through the third communication line 51 when the first processor 1131 outputs the high signal (5 V), and the low signal (0 V) may be input to the second processor 2410 through the third communication line 51 when the first processor 1131 outputs the low signal (0 V).

Meanwhile, the second processor 2410 of the brush device 2000 may transmit a response signal indicating the current state to the first processor 1131 of the cleaner body 1000 through the fourth communication line 52. For example, when the second processor 2410 outputs the high signal (3.3 V), 3.3 V (high) is also applied to the fourth communication line 52. Here, because the switching device (for example, N-channel FET) included in the second level shifter circuit 1142 does not operate, 5 V (high) is input to the first processor 1131. On the other hand, when the second processor 2410 outputs the low signal (0 V), a voltage close to 0 (low) is also applied to the fourth communication line 52 because a size of the second damping resistor 2454 is very small compared to the second pull-up resistor 2453. Also, because resistance (10 KΩ) included in the second level shifter circuit 1142 is large, a voltage drop is high, and thus a voltage close to 0 (low) is also input to the first processor 1131. In other words, the high signal (3.3 V) may be input to the first processor 1131 through the fourth communication line 52 when the second processor 2410 outputs the high signal (3.3 V), and the low signal (≈0 V) may be input to the first processor 1131 through the fourth communication line 52 when the second processor 2410 outputs the low signal (0 V). Operations of the first and second level shifter circuits 1141 and 1142 of FIG. 31 are the same as those of the first and second level shifter circuits 1141 and 1142 of FIG. 30, and thus redundant descriptions thereof are omitted.

When the cordless vacuum cleaner 100 includes the first level shifter circuit 1141 and the second level shifter circuit 1142, the UART communication between the cleaner body 1000 and the brush device 2000 is possible even when a voltage output from the first processor 1131 and a voltage output from the second processor 2410 are different from each other.

According to an embodiment of the disclosure, the PCB 1130*e* of the cleaner body 1000 may include the first pull-up resistor 2451, the first damping resistor 2452, the second pull-up resistor 2453, and the second damping resistor 2454, and the PCB 2400*e* of the brush device 2000 may include the first level shifter circuit 1141 and the second level shifter circuit 1142.

Figure 32:
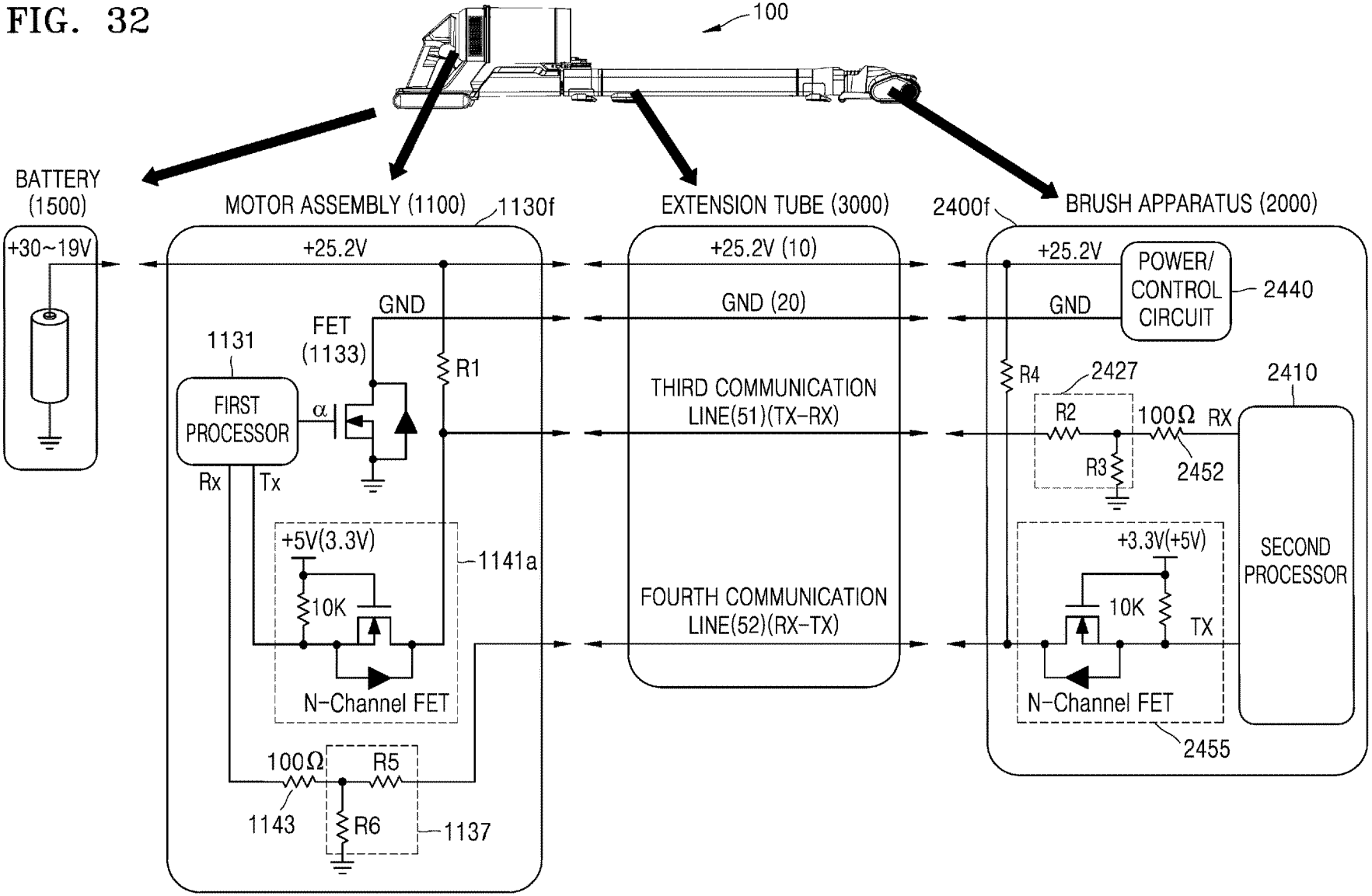
FIG. 32 is a schematic diagram for describing a circuit for UART full duplex communication of a cordless vacuum cleaner, according to an embodiment of the disclosure.

FIG. 32 is a schematic diagram for describing a circuit for UART communication of the cordless vacuum cleaner 100, according to an embodiment of the disclosure.

Referring to FIG. 32, the cleaner body 1000 may include a PCB 1130*f* for UART communication and the brush device 2000 may also include a PCB 2400*f* for UART communication. The PCB 1130*f* of the cleaner body 1000 shown in FIG. 32 may correspond to the PCB 1130 of the cleaner body 1000 shown in FIG. 8, and a PCB 2400*f* of the brush device 2000 shown in FIG. 32 may correspond to the PCB 2400 shown in FIG. 8, and thus redundant descriptions are omitted.

According to an embodiment of the disclosure, the cordless vacuum cleaner 100 may include two wires for UART communication. For example, the cordless vacuum cleaner 100 may include the third communication line 51 and the fourth communication line 52. The third communication line 51 may be a line for the first processor 1131 to transmit a signal to the second processor 2410, and the fourth communication line 52 may be a line for the second processor 2410 to transmit a signal to the first processor 1131. The first processor 1131 and the second processor 2410 may each simultaneously transmit and receive signals through the third communication line 51 and the fourth communication line 52.

According to an embodiment of the disclosure, for communication resistant to noise, the PCB 1130*f* of the cleaner body 1000 may include a first circuit 1141*a* similar to the first level shifter circuit 1141, a third damping resistor 1143, and the first voltage distributer 1137. The PCB 2400*f* of the brush device 2000 may include the second voltage distributor 2427, the first damping resistor 2452, and a second circuit 2455 similar to the first level shifter circuit 1141.

The cleaner body 1000 may operate as a master device to transmit a signal indicating an operating condition to the second processor 2410 through the third communication line 51. For example, when the first processor 1131 outputs the high signal (5 V), a switching device (for example, N-channel FET) included in the first circuit 1141*a* becomes an off-state, and thus a voltage (25.2 V) (high) of the +power line 10 connected through an R1 resistor is applied to the third communication line 51. Here, a high signal (=battery voltage (25.2 V)*R3/(R1+R2+R3)) may be input to the second processor 2410 through the second voltage distributor 2427. On the other hand, when the first processor 1131 outputs the low signal (0 V), the switching device (for example, N-channel FET) included in the first circuit 1141*a* becomes an on-state, and thus the voltage of the third communication line 51 becomes 0 V (low) and 0 V (low) may also be input to the second processor 2410. In other words, the high signal (3.3 V) may be input to the second processor 2410 through the third communication line 51 when the first processor 1131 outputs the high signal (5 V), and the low signal (0 V) may be input to the second processor 2410 through the third communication line 51 when the first processor 1131 outputs the low signal (0 V).

Meanwhile, the second processor 2410 of the brush device 2000 may transmit a response signal indicating the current state to the first processor 1131 of the cleaner body 1000 through the fourth communication line 52. For example, when the second processor 2410 outputs the high signal (3.3 V), a switching device (for example, N-channel FET) included in the second circuit 2455 becomes an off-state, and thus a voltage (25.2 V) (high) of the +power line 10 connected through an R4 resistor is applied to the fourth communication line 52. Here, a high voltage (=battery voltage (25.2 V)*R6/(R4+R5+R6)) may be input to the first processor 1131 through the first voltage distributer 1137. On the other hand, when the second processor 2410 outputs the low signal (0 V), the switching device (for example, N-channel FET) included in the second circuit 2455 becomes an on-state, and thus the voltage of the fourth communication line 52 becomes 0 V (low) and 0 V (low) may also be input to the first processor 1131. In other words, the high signal may be input to the first processor 1131 through the fourth communication line 52 when the second processor 2410 outputs the high signal (3.3 V), and the low signal (0 V) may be input to the first processor 1131 through the fourth communication line 52 when the second processor 2410 outputs the low signal (0 V).

According to an embodiment of the disclosure, during the UART communication between the cleaner body 1000 and the brush device 2000, high voltage signals may be transmitted and received through the third communication line 51 and the fourth communication line 52, and thus the cordless vacuum cleaner 100 may be resistant to noise.

Figure 33:
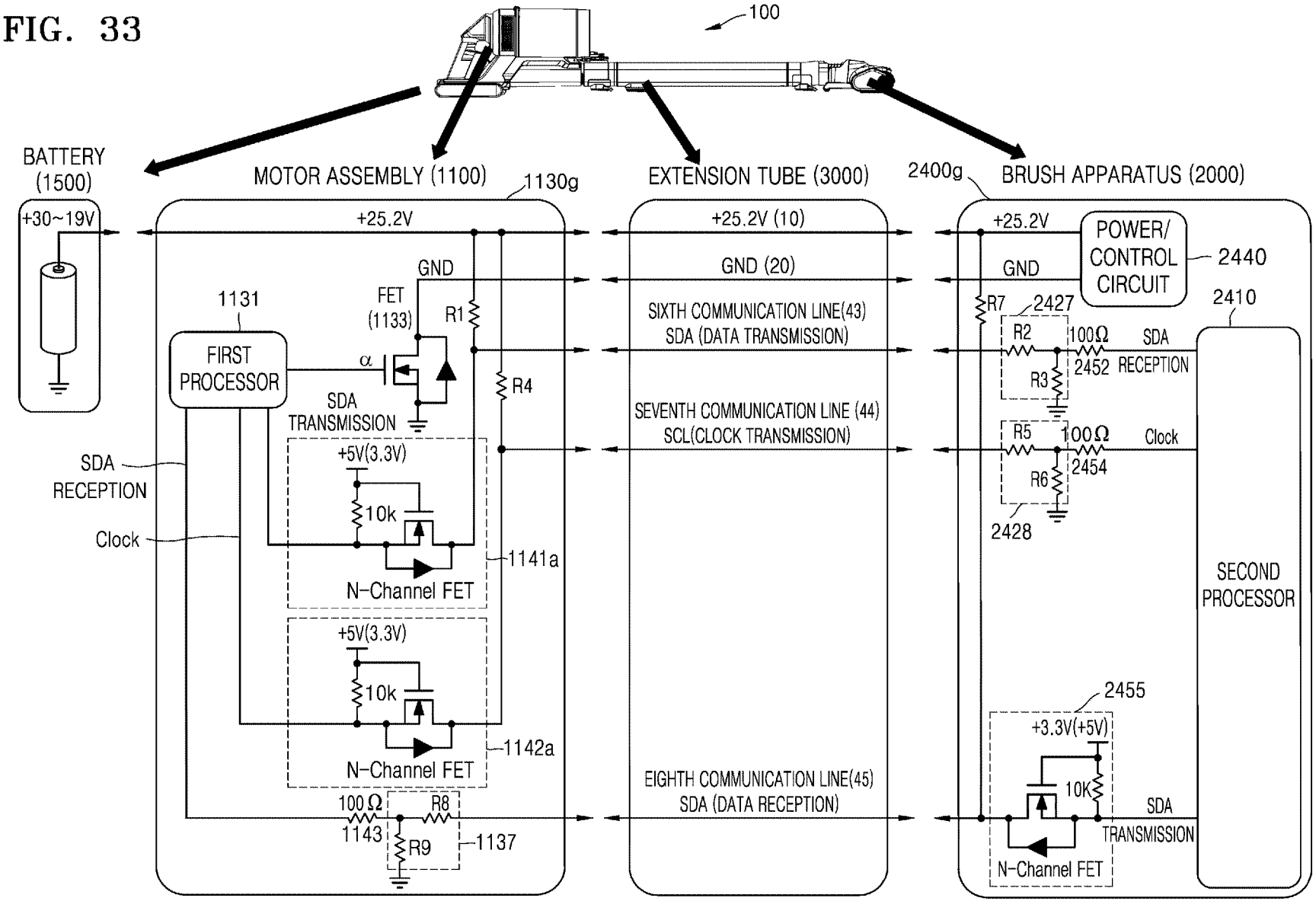
FIG. 33 is a schematic diagram for describing a circuit for I2C communication of a cordless vacuum cleaner, according to an embodiment of the disclosure.

FIG. 33 is a schematic diagram for describing a circuit for I2C communication of the cordless vacuum cleaner 100, according to an embodiment of the disclosure.

Referring to FIG. 33, the cleaner body 1000 may include a PCB 1130*g* for I2C communication, and the brush device 2000 may also include a PCB 2400*g* for I2C communication. The PCB 1130*g* of the cleaner body 1000 shown in FIG. 33 may correspond to the PCB 1130 of the cleaner body 1000 shown in FIG. 8, and a PCB 2400*g* of the brush device 2000 shown in FIG. 33 may correspond to the PCB 2400 shown in FIG. 8, and thus redundant descriptions are omitted.

According to an embodiment of the disclosure, the cordless vacuum cleaner 100 may include a sixth communication line 43, a seventh communication line 44, and an eighth communication line 45. The sixth communication line 43 may be a line for transmitting SDA from the cleaner body 1000 to the brush device 2000, the seventh communication line 44 may be a line for transmitting SDA from the brush device 2000 to the cleaner body 1000, and the eighth communication line 45 may be a line for transmitting SCL from the cleaner body 1000 to the brush device 2000.

According to an embodiment of the disclosure, for communication resistant to noise, the PCB 1130*g* of the cleaner body 1000 may include the first circuit 1141*a* similar to the first level shifter circuit 1141, a third circuit 1142*a* similar to the second level shifter circuit 1142, the third damping resistor 1143, and the first voltage distributer 1137. The PCB 2400*g* of the brush device 2000 may include the second voltage distributor 2427, the first damping resistor 2452, the second damping resistor 2454, and the second circuit 2455 similar to the first level shifter circuit 1141.

The cleaner body 1000 may operate as a master device to transmit a signal indicating an operating condition to the second processor 2410 through the sixth communication line 43 and the seventh communication line 44. For example, when the first processor 1131 outputs the high signal (5 V) towards the first circuit 1141*a*, the switching device (for example, N-channel FET) included in the first circuit 1141*a* becomes an off-state, and thus a voltage (25.2 V) (high) of the +power line 10 connected through the R1 resistor is applied to the sixth communication line 43. Here, a high signal (=battery voltage (25.2 V)*R3/(R1+R2+R3)) may be input to the second processor 2410 through the second voltage distributor 2427. On the other hand, when the first processor 1131 outputs a low signal (0 V) towards the first circuit 1141*a*, the switching device (for example, the N-channel FET) included in the first circuit 1141*a* becomes an on-state, and thus a voltage of the sixth communication line 43 may be 0 V (low) and 0 V (low) may be input to the second processor 2410. In other words, the high signal (3.3 V) may be input to the second processor 2410 through the sixth communication line 43 when the first processor 1131 outputs the high signal (5 V) to transmit a data signal (SDA), and the low signal (0 V) may be input to the second processor 2410 through the sixth communication line 43 when the first processor 1131 outputs the low signal (0 V) to transmit the data signal (SDA). Similarly, the high signal (3.3 V) may be input to the second processor 2410 through the seventh communication line 44 when the first processor 1131 outputs the high signal (5 V) to transmit a clock signal (SCL), and the low signal (0 V) may be input to the second processor 2410 through the seventh communication line 44 when the first processor 1131 outputs the low signal (0 V) to transmit the clock signal (SCL).

Meanwhile, the second processor 2410 of the brush device 2000 may transmit a response signal indicating the current state to the first processor 1131 of the cleaner body 1000 through the eighth communication line 45 and the seventh communication line 44. For example, when the second processor 2410 outputs the high signal (3.3 V), the switching device (for example, N-channel FET) included in the second circuit 2455 becomes an off-state, and thus a voltage (25.2 V) (high) of the +power line 10 connected through an R7 resistor is applied to the eighth communication line 45. Here, a high voltage (=battery voltage (25.2 V)*R9/(R7+R8+R9)) may be input to the first processor 1131 through the first voltage distributer 1137. On the other hand, when the second processor 2410 outputs the low signal (0 V), the switching device (for example, N-channel FET) included in the second circuit 2455 becomes an on-state, and thus the voltage of the eighth communication line 45 becomes 0 V (low) and 0 V (low) may also be input to the first processor 1131. In other words, the high signal may be input to the first processor 1131 through the eighth communication line 45 when the second processor 2410 outputs the high signal (3.3 V) to transmit the data signal (SDA), and the low signal (0 V) may be input to the first processor 1131 through the eighth communication line 45 when the second processor 2410 outputs the low signal (0 V) to transmit the data signal (SDA).

According to an embodiment of the disclosure, during the I2C communication between the cleaner body 1000 and the brush device 2000, high voltage signals may be transmitted and received through the sixth communication line 43, the seventh communication line 44, and the eighth communication line 45, and thus the cordless vacuum cleaner 100 may be resistant to noise.

An embodiment of the disclosure provides a circuit enabling the cleaner body 1000 and the brush device 2000 connected to the cleaner body 1000 to stably communicate with each other through the signal line 30, and a method of transmitting a signal between the cleaner body 1000 and the brush device 2000. In particular, an embodiment of the disclosure provides a circuit configured to transmit a signal for controlling the brush device 2000 from the cleaner body 1000 and receive a signal indicating a current state of the brush device 2000 from the brush device 2000.

The cordless vacuum cleaner 100 according to an embodiment of the disclosure may include the power lines 10 and 20 configured to transmit power supplied from the battery 1500 to the cleaner body 1000 and the brush device 2000 connected to the cleaner body 1000. The cordless vacuum cleaner 100 may include the signal line 30 different from the power lines 10 and 20 and configured to transmit and receive a signal between the cleaner body 1000 and the brush device 2000 when the brush device 2000 is connected to the cleaner body 1000. The cordless vacuum cleaner 100 may include the cleaner body 1000 including the first processor 1131 configured to control an operation of a first switching device 1132 connected to the signal line 30 to transmit the first signal to the brush device 2000 through the signal line 30 and receive the second signal from the brush device 2000 through the signal line 30. The cordless vacuum cleaner 100 may include the brush device 2000 including the second processor 2410 configured to control an operation of the second switching device 2435 connected to the signal line 30 to transmit the second signal to the cleaner body 1000 through the signal line 30 and receive the first signal from the cleaner body 1000 through the signal line 30.

The cleaner body 1000 according to an embodiment of the disclosure may include the first voltage distributer 1137 configured to distribute a voltage input from the signal line 30 to the input port of the first processor 1131.

According to an embodiment of the disclosure, the first signal may include data indicating at least one of the target RPM of the drum 2200 of the brush device 2000, the target trip level of the brush device 2000, or the power consumption of a suction motor 1110 included in the cleaner body 1000.

The second processor 2410 according to an embodiment of the disclosure may be further configured to perform at least one of an operation of adjusting the RPM of the drum 2200 to the target RPM or an operation of adjusting the trip level of the brush device 2000 to the target trip level, based on the first signal.

According to an embodiment of the disclosure, the target RPM of the drum 2200 may be determined based on the usage environment state of the brush device 2000.

According to an embodiment of the disclosure, the usage environment state of the brush device 2000 may include at least one of a state of a surface to be cleaned where the brush device 2000 is currently located, a relative location state of the brush device 2000 in the surface to be cleaned, or a state of the brush device 2000 being lifted from the surface to be cleaned.

The second processor 2410 according to an embodiment of the disclosure may be further configured to, when the first signal includes data for controlling the lighting device 2300 included in the brush device 2000, control an output of the lighting device 2300, based on the first signal.

The brush device 2000 according to an embodiment of the disclosure may include the ID resistor 2500 indicating a type of the brush device 2000. The first processor 1131 according to an embodiment of the disclosure may be further configured to identify the type of the brush device 2000 corresponding to the ID resistor 2500, based on a voltage value input to the input port of the first processor 1131.

According to an embodiment of the disclosure, the ID resistor 2500 may be located between the power lines 10 and 20 and the signal line 30 in the brush device 2000. According to an embodiment of the disclosure, the voltage value input to the input port of the first processor 1131 may decrease when a value of the ID resistor 2500 increases.

The cleaner body 1000 according to an embodiment of the disclosure may further include the third switching device 1133 configured to control power supply to the brush device 2000. The first processor 1131 according to an embodiment of the disclosure may be configured to control power supply to the brush device 2000 by controlling the third switching device 1133 according to the identified type of the brush device 2000.

According to an embodiment of the disclosure, the second signal may include data indicating the current state of the brush device 2000.

According to an embodiment of the disclosure, the second signal may include data indicating a type of the brush device 2000.

According to an embodiment of the disclosure, the cleaner body 1000 and the brush device 2000 may be physically connectable through the extension pipe 3000 including the power lines 10 and 20 and the signal line 30.

The first processor 1131 according to an embodiment of the disclosure may be further configured to obtain state data of the suction motor 1110 by being connected to the suction motor 1110 in the cleaner body 1000.

The first processor 1131 according to an embodiment of the disclosure may be further configured to stop an operation of the suction motor 1110 when abnormality of the suction motor 1110 is identified. The first processor 1131 may be further configured to transmit a signal for stopping an operation of the brush device 2000 to the brush device 2000 through the signal line 30 by controlling an on/off operation of the first switching device 1132.

The first processor 1131 according to an embodiment of the disclosure may be further configured to transmit, to the main processor 1800 included in the cleaner body 1000, the state data of the suction motor 1110 and the data indicating the current state of the brush device 2000, included in the second signal.

The first processor 1131 according to an embodiment of the disclosure may be further configured to turn on the first switching device 1132 to transmit code 0 by applying, to the signal line 30, a voltage of the first level lower than the threshold value. The first processor 1131 may be further configured to turn off the first switching device 1132 to transmit code 1 by applying, to the signal line 30, a voltage of the second level higher than the threshold value.

When the second signal is not received for a certain time after the first signal is transmitted through the signal line 30, the cleaner body 1000 according to an embodiment of the disclosure may be further configured to determine that communication with the brush device 2000 is not possible.

When it is determined that the communication with the brush device 2000 is not possible, the cleaner body 1000 according to an embodiment of the disclosure may be further configured to switch an operating mode from the AI mode, in which the suction power strength of the suction motor 1110 is automatically adjusted, to the normal mode, in which the suction power strength of the suction motor 1110 is manually adjusted.

When it is determined that the communication with the brush device 2000 is not possible, the cleaner body 1000 according to an embodiment of the disclosure may be further configured to output, through the output interface, a notification indicating that an operation in the AI mode is not possible.

A machine-readable storage medium may be provided in the form of a non-transitory storage medium. Here, the "non-transitory storage medium" only denotes a tangible device and does not contain a signal (for example, electromagnetic waves). This term does not distinguish a case where data is stored in the storage medium semi-permanently and a case where the data is stored in the storage medium temporarily. For example, the "non-transitory storage medium" may include a buffer where data is temporarily stored.

According to an embodiment of the disclosure, a method according to various embodiments of the disclosure in the present specification may be provided by being included in a computer program product. The computer program products are products that can be traded between sellers and buyers. The computer program product may be distributed in a form of machine-readable storage medium (for example, a compact disc read-only memory (CD-ROM)), or distributed (for example, downloaded or uploaded) through an application store or directly or online between two user devices (for example, smart phones). In the case of online distribution, at least a part of the computer program product (for example, a downloadable application) may be at least temporarily generated or temporarily stored in a machine-readable storage medium, such as a server of a manufacturer, a server of an application store, or a memory of a relay server.

The invention claimed is:

1. A cordless vacuum cleaner comprising:

a battery having a battery supply voltage;

a power line configured to transmit power from the battery to a cleaner body and a brush device; and a signal line different from the power line and configured to transmit and receive a signal between the cleaner body and the brush device when the brush device is connected to the cleaner body, wherein:

the cleaner body comprises a first processor configured to control an operation of a first switching device connected to the signal line to transmit a first signal to the brush device through the signal line and receive a second signal from the brush device through the signal line, and the brush device comprises a second processor configured to control an operation of a second switching device connected to the signal line to transmit the second signal to the cleaner body through the signal line and receive the first signal from the cleaner body through the signal line, wherein:

low signals output from the first and second processors turn the first and second switching devices off, respectively, and change a voltage of the signal line to a high state based on the battery supply voltage, and high signals output from the first and second processors form the first and second switching devices on, respectively, and change the voltage of the signal line to a low state corresponding to 0V.

2. The cordless vacuum cleaner of claim 1, wherein the cleaner body further comprises a first voltage distributer configured to distribute a voltage input from the signal line to an input port of the first processor.

3. The cordless vacuum cleaner of claim 1, wherein the first signal comprises data indicating target revolutions per minute (RPM) of a drum of the brush device, a target trip level of the brush device, and power consumption of a suction motor included in the cleaner body.

4. The cordless vacuum cleaner of claim 3, wherein the second processor is further configured to perform an operation of adjusting RPM of the drum to the target RPM and an operation of adjusting a trip level of the brush device to the target trip level based on the first signal.

5. The cordless vacuum cleaner of claim 3, wherein the target RPM of the drum is determined based on a usage environment state of the brush device.

6. The cordless vacuum cleaner of claim 5, wherein the usage environment state of the brush device comprises a state of a surface to be cleaned, where the brush device is currently located, a relative location state of the brush device in the surface to be cleaned, and a state of the brush device being lifted from the surface to be cleaned.

7. The cordless vacuum cleaner of claim 1, wherein the second processor is further configured to control an output of a lighting device included in the brush device, based on the first signal when the first signal includes data for controlling the lighting device included in the brush device.

8. The cordless vacuum cleaner of claim 1, wherein the brush device comprises an identification resistor indicating a type of the brush device, and the first processor is further configured to identify the type of the brush device corresponding to the identification resistor based on a voltage value input to the input port of the first processor.

9. The cordless vacuum cleaner of claim 8, wherein the identification resistor is located between the power line and the signal line in the brush device, and a voltage value input to an input port of the first processor decreases when a value of the identification resistor increases.

10. The cordless vacuum cleaner of claim 1, wherein the cleaner body further comprises a third switching device configured to control power supply to the brush device, and the first processor is further configured to control the power supply to the brush device by controlling the third switching device according to the identified type of the brush device.

11. The cordless vacuum cleaner of claim 1, wherein the second signal comprises data indicating a current state of the brush device.

12. The cordless vacuum cleaner of claim 1, wherein the second signal further comprises data indicating the type of the brush device.

13. The cordless vacuum cleaner of claim 1, wherein the cleaner body and the brush device are physically connectable through an extension pipe including the power line and the signal line.

14. The cordless vacuum cleaner of claim 1, wherein the first processor is further configured to obtain state data of a suction motor of the cleaner body.

15. The cordless vacuum cleaner of claim 1, wherein the first processor is further configured to:

turn on the first switching device to transmit code 0 by applying a voltage of a first level lower than a threshold value to the signal line; and turn off the first switching device to transmit code 1 by applying a voltage of a second level higher than the threshold value to the signal line.

16. A cordless vacuum cleaner comprising:

a battery:

a power line configured to transmit power from the battery to a cleaner body and a brush device; and a signal line different from the power line and configured to transmit and receive a signal between the cleaner body and the brush device when the brush device is connected to the cleaner body, wherein:

the cleaner body comprises a first processor configured to control an operation of a first switching device connected to the signal line to transmit a first signal to the brush device through the signal line and receive a second signal from the brush device through the signal line, and the brush device comprises a second processor configured to control an operation of a second switching device connected to the signal line to transmit the second signal to the cleaner body through the signal line and receive the first signal from the cleaner body through the signal line, wherein:

the first processor is further configured to obtain state data of the suction motor, and the first processor is further configured to:

stop an operation of the suction motor when an abnormality of the suction motor is identified; and transmit a signal for stopping an operation of the brush device to the brush device through the signal line by controlling an on/off operation of the first switching device.

17. A cordless vacuum cleaner comprising:

a battery:

a power line configured to transmit power from the battery to a cleaner body and a brush device; and a signal line different from the power line and configured to transmit and receive a signal between the cleaner body and the brush device when the brush device is connected to the cleaner body, wherein:

the cleaner body comprises a first processor configured to control an operation of a first switching device connected to the signal line to transmit a first signal to the brush device through the signal line and receive a second signal from the brush device through the signal line, and the brush device comprises a second processor configured to control an operation of a second switching device connected to the signal line to transmit the second signal to the cleaner body through the signal line and receive the first signal from the cleaner body through the signal line, wherein:

the first processor is further configured to obtain state data of the suction motor, and wherein the first processor is further configured to transmit the state data of the suction motor and the data indicating the current state of the brush device, included in the second signal to a main processor included in the cleaner body.

18. A cordless vacuum cleaner comprising:

a battery;

a power line configured to transmit power from the battery to a cleaner body and a brush device; and a signal line different from the power line and configured to transmit and receive a signal between the cleaner body and the brush device when the brush device is connected to the cleaner body, wherein:

the cleaner body comprises a first processor configured to control an operation of a first switching device connected to the signal line to transmit a first signal to the brush device through the signal line and receive a second signal from the brush device through the signal line, and the brush device comprises a second processor configured to control an operation of a second switching device connected to the signal line to transmit the second signal to the cleaner body through the signal line and receive the first signal from the cleaner body through the signal line, and wherein the cleaner body is configured to determine that communication with the brush device is not possible when the second signal is not received for a certain period of time after the first signal is transmitted through the signal line.

19. The cordless vacuum cleaner of claim 18, wherein the cleaner body comprises a suction motor and is further configured to switch an operating mode from an artificial intelligence (AI) mode, in which suction power strength of the suction motor is automatically adjusted, to a normal mode, in which the suction power strength of the suction motor is manually adjusted, when it is determined that the communication with the brush device is not possible.

20. The cordless vacuum cleaner of claim 19, wherein the cleaner body is further configured to output a notification indicating that an operation in the AI mode is not possible through an output interface when it is determined that the communication with the brush device is not possible.

* * * * *